US007634988B1

(12) United States Patent
Salminen

(10) Patent No.: US 7,634,988 B1
(45) Date of Patent: Dec. 22, 2009

(54) INTERNAL COMBUSTION ENGINE

(76) Inventor: Reijo K. Salminen, 373 Cove Rd., Bellingham, WA (US) 98229

( * ) Notice: Subject to any disclaimer, the term of this patent is extended or adjusted under 35 U.S.C. 154(b) by 3 days.

(21) Appl. No.: 12/108,728

(22) Filed: Apr. 24, 2008

Related U.S. Application Data

(60) Provisional application No. 60/914,273, filed on Apr. 26, 2007, provisional application No. 60/926,708, filed on Apr. 27, 2007.

(51) Int. Cl.
*F02B 23/00* (2006.01)
*F02B 25/00* (2006.01)
*F02B 19/00* (2006.01)
*F02B 75/02* (2006.01)

(52) U.S. Cl. ..... 123/663; 123/70 R; 123/253; 123/316

(58) Field of Classification Search ..... 123/68, 123/69 R, 70 R, 71 R, 253, 281, 283, 316, 123/663
See application file for complete search history.

(56) References Cited

U.S. PATENT DOCUMENTS 1,932,332 A * 10/1933 Rene ..... 123/70 R
3,885,386 A * 5/1975 Bachmann ..... 123/60.1
7,273,023 B2 * 9/2007 Tour et al. ..... 123/71 R

* cited by examiner

*Primary Examiner*—Noah Kamen
(74) *Attorney, Agent, or Firm*—Michael F. Hughes; Hughes Law Firm, PLLC

(57) ABSTRACT

An engine block is disclosed in one embodiment having a cylinder shape bore, which forms the outside wall surface of a cylindrical air chamber. Radially outwards from the cylindrical air chamber there is an annular shape combustion chamber, which has a circular inner wall surface, circular outer wall surface, closed annular shaped top surface, and an annular shaped open end opposite of the top surface. The bottom end of the circular inner wall surface of the annular shape combustion chamber and the bottom end of the outside wall surface of the cylindrical air chamber defines an annular shape surface. This surface fits inside the annular shape air chamber in the piston assembly. In one embodiment, in the lower part of the circular inner wall surface of the annular shape combustion chamber there is a circular groove for an oil scraper ring of conventional design.

20 Claims, 30 Drawing Sheets

FIG. 2B Section A-A of Fig. 2A

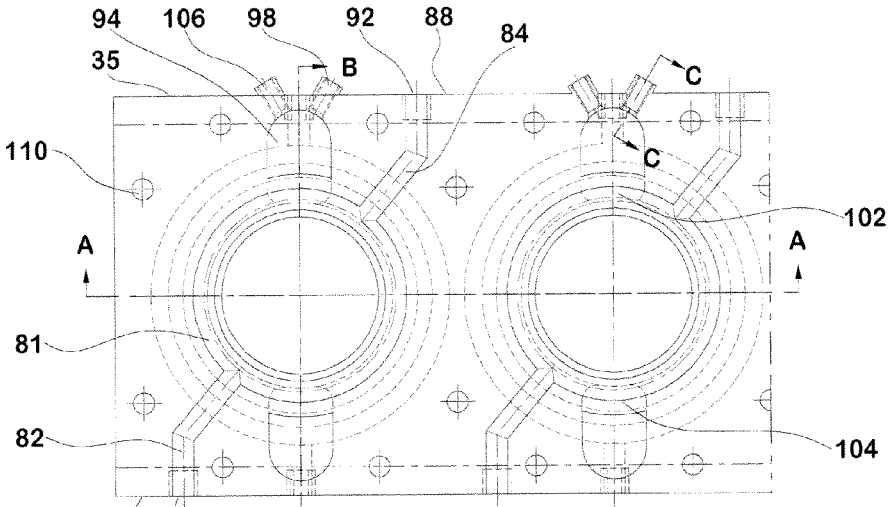
FIG. 3A
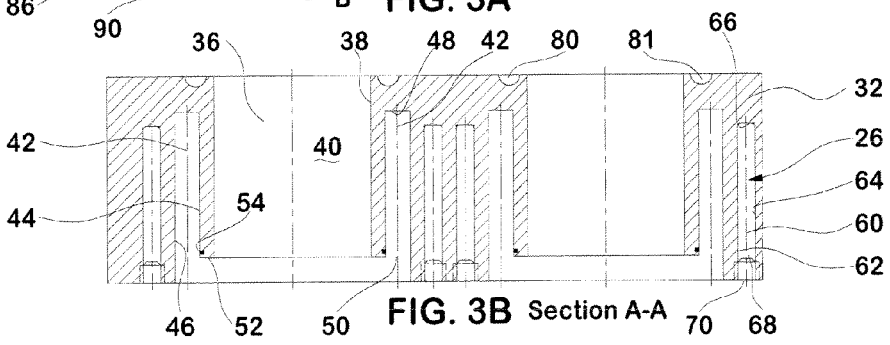
FIG. 3B Section A-A
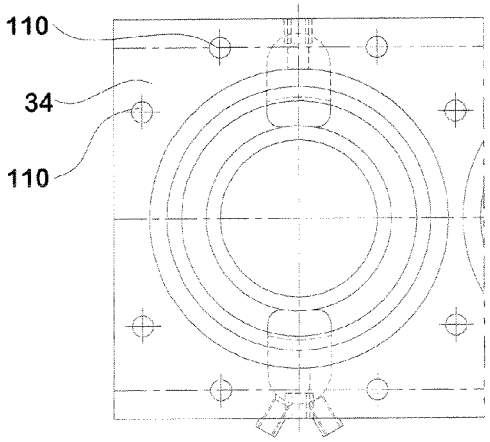
FIG. 3C
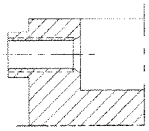
FIG. 3E Section C-C
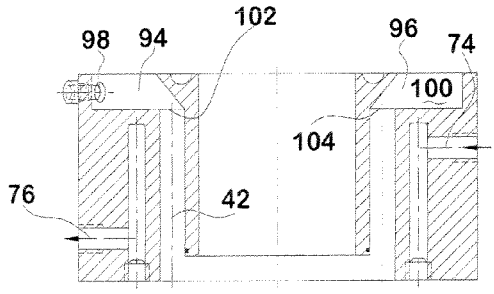
FIG. 3D Section B-B

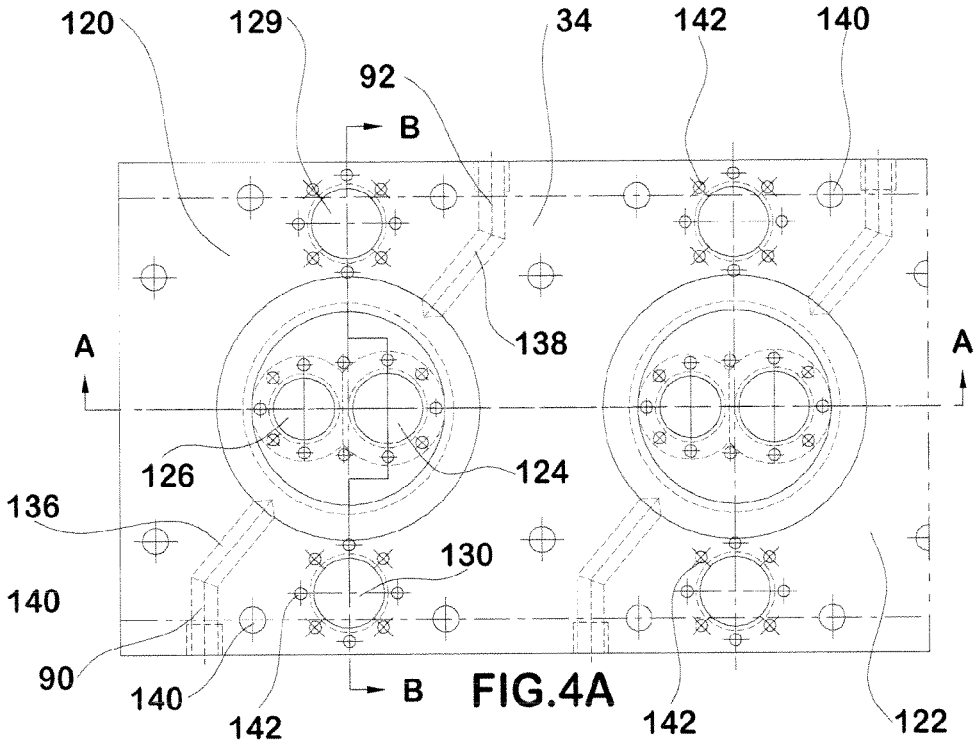
FIG.4A
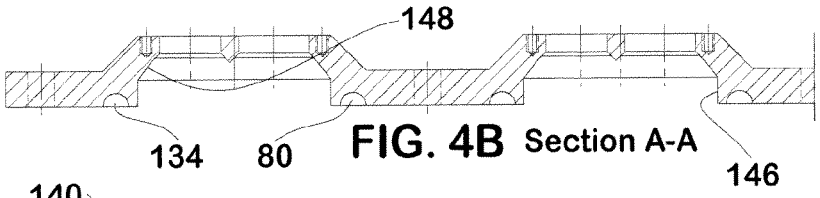
FIG. 4B Section A-A
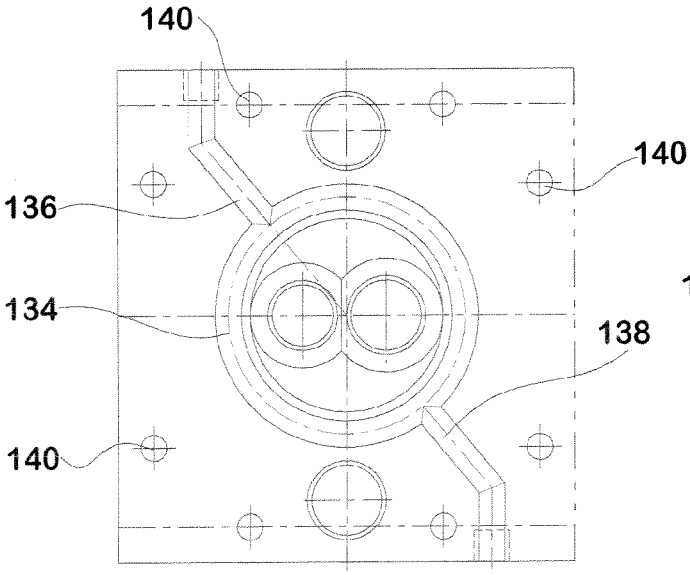
FIG. 4C
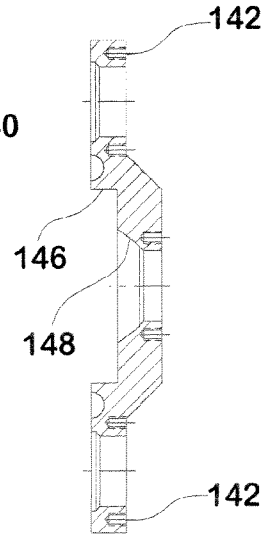
FIG. 4D Section B-B

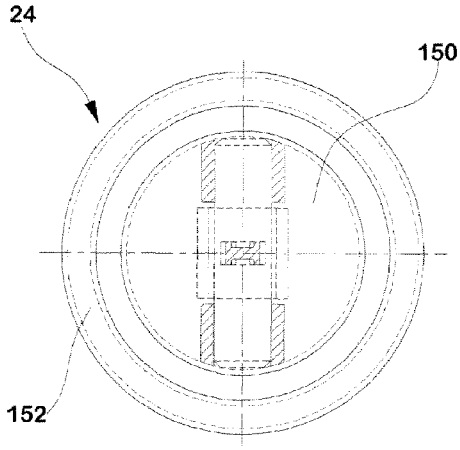
FIG. 5C Top View B-B
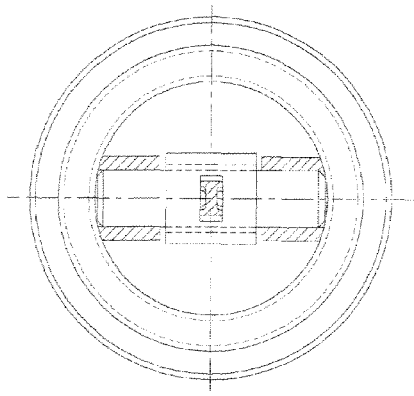
FIG. 5D Bottom View C-C
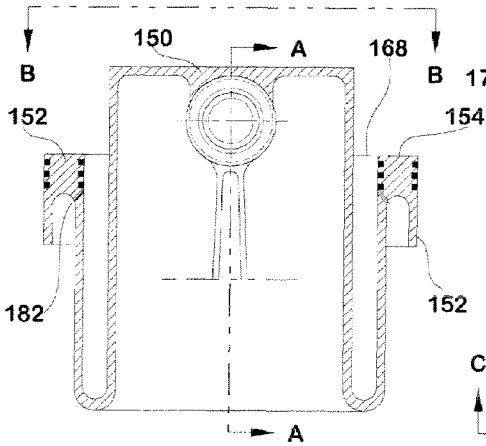
FIG. 5A
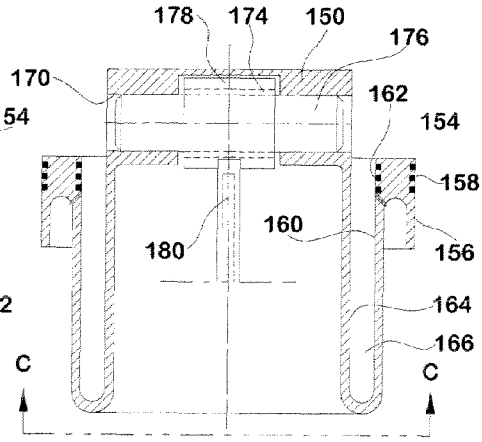
FIG. 5B Section A-A FIG. 21B Section B-B

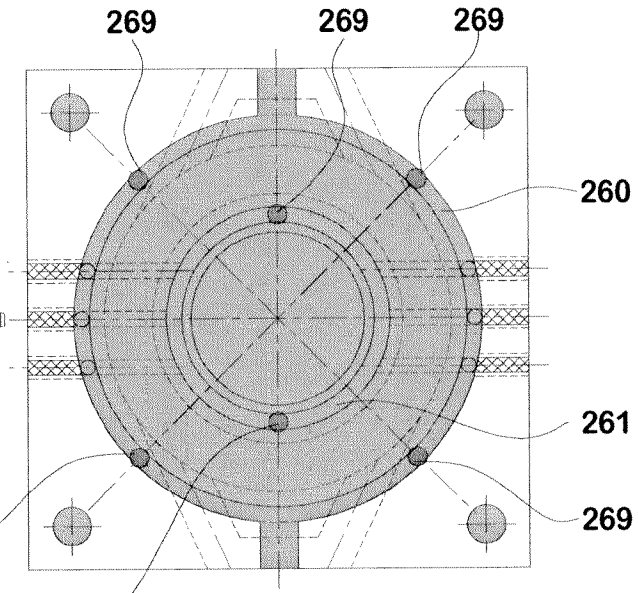
FIG. 21C Section C-C
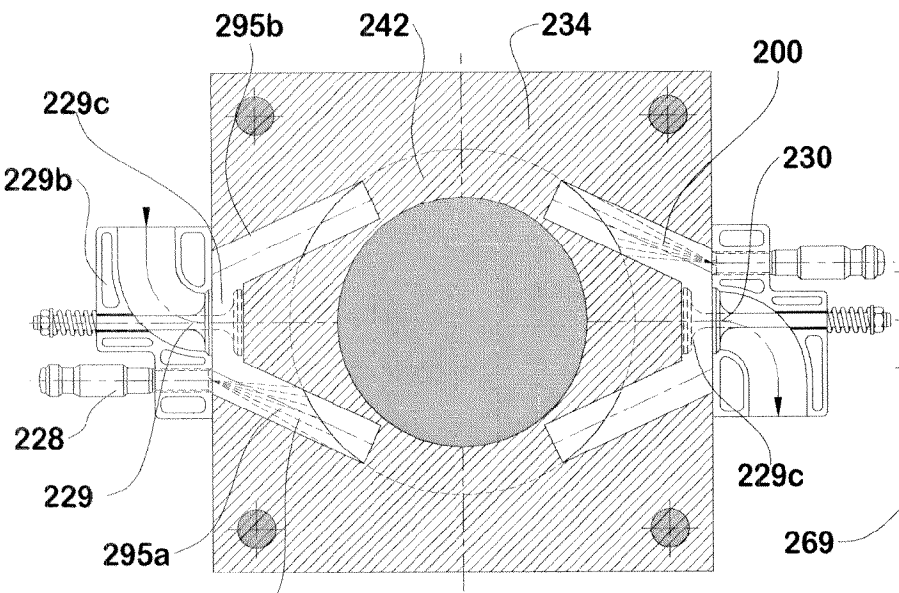
FIG. 21D Section A-A

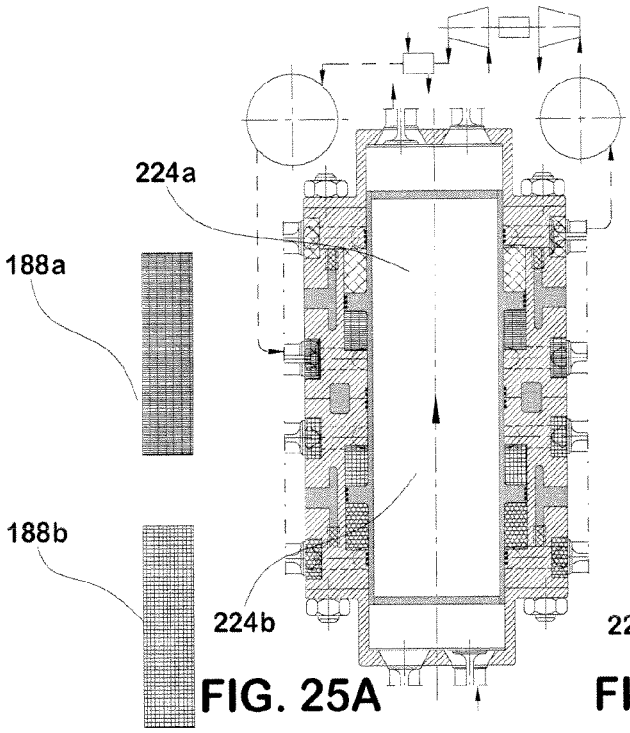
FIG. 25A
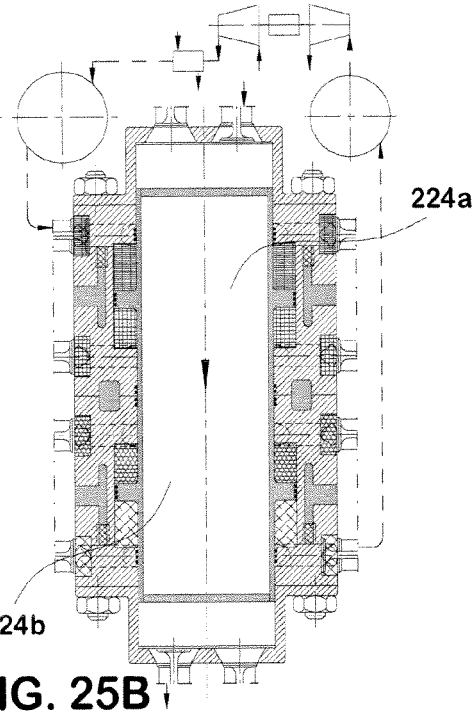
FIG. 25B
FIG. 25E
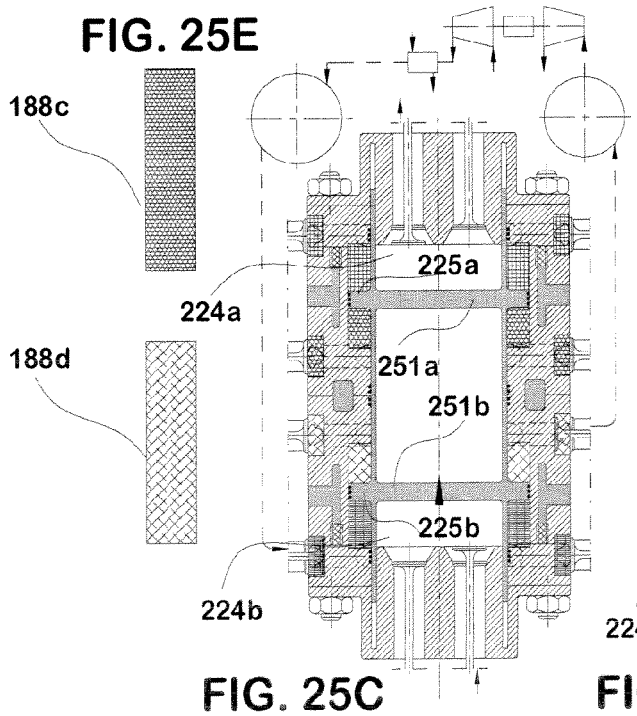
FIG. 25C
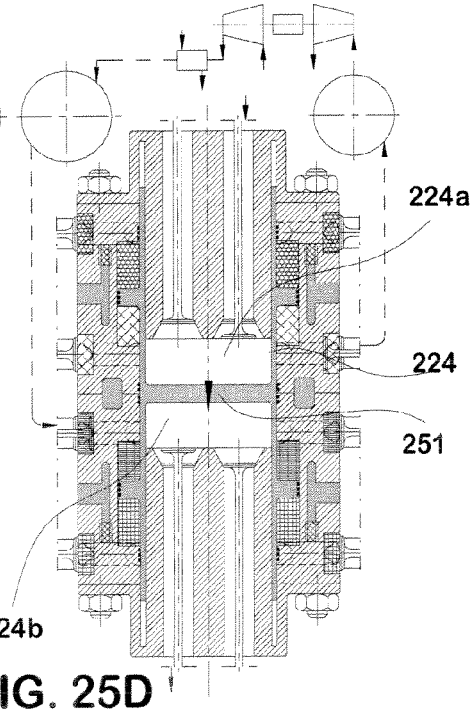
FIG. 25D

INTERNAL COMBUSTION ENGINE

RELATED APPLICATIONS

This applications claims priority of U.S. Provisional Ser. No. 60/914,273 filed Apr. 26, 2007, and Ser. No. 60/926,708 filed Apr. 27, 2007.

BACKGROUND OF THE INVENTION

The present invention relates to an apparatus and method for obtaining mechanical energy directly from the expenditure of the chemical energy of fuel burned in a combustion chamber that is an integral part of the apparatus, and more particularly to an internal-combustion engine.

Internal-Combustion Engine is any type of machine that obtains mechanical energy directly from the expenditure of the chemical energy of fuel burned in a combustion chamber that is an integral part of the engine.

In 1873 Brayton, an American, developed an engine, which had the unique features of constant-pressure combustion and complete expansion. One cylinder was used to compress air or the combustible mixture. Another cylinder was used as a working cylinder and was large enough to obtain complete expansion to atmospheric pressure. The compressor discharged the mixture into a receiver, and the mixture flowed from the receiver to the engine, being ignited and burned at constant pressure as it entered the engine. An ignition flame was supported by a mixture by-pass, and a flame-suppression grid prevented the flame from flashing back into the mixture receiver.

The Brayton engine could not compete with the Otto-cycle engine because of high heat and mechanical-friction losses, and it was abandoned when the Otto-engine was introduced in the United States. Although the Brayton process was abandoned for the piston engine, it is used for gas-turbine engine process.

Four principal types of internal-combustion engines are in general use: the Otto-cycle engine, the Diesel engine, the rotary engine, and the gas turbine.

The Otto-cycle engine, named after its inventor, the German technician Nikolaus August Otto, was first built in 1876 and is the familiar gasoline engine used in automobiles and airplanes.

The Diesel engine, (U.S. Pat. No. 542,846, granted on Jul. 16, 1895) named after the French-born German engineer Rudolf Christian Karl Diesel, operates on a different principle and usually uses oil as a fuel. It is employed in electric-generating and marine-power plants, in trucks and buses, and in some automobiles. Both Otto-cycle and Diesel engines are manufactured in two-stroke and four-stroke cycle models.

The essential parts of Otto-cycle and Diesel engines are the same. The combustion chamber consists of a cylinder, usually fixed, that is closed at one end and in which a close-fitting piston slides. The in-and-out motion of the piston varies the volume of the chamber between the inner face of the piston and the closed end of the cylinder. The outer face of the piston is attached to a crankshaft by a connecting rod. The crankshaft transforms the reciprocating motion of the piston into rotary motion. In multi-cylindered engines the crankshaft has one offset portion, called a crankpin, for each connecting rod, so that the power from each cylinder is applied to the crankshaft at the appropriate point in its rotation. Crankshafts have heavy flywheels and counterweights, which by their inertia minimize irregularity in the motion of the shaft. An engine may have from 1 to as many as 28 cylinders.

The fuel supply system of an internal-combustion engine consists of a tank, a fuel-pump, and a device for vaporizing or atomizing the liquid fuel. In Otto-cycle engines this device is either a carburetor or, more recently, a fuel-injection system. In most engines with a carburetor, vaporized fuel is conveyed to the cylinders through a branched pipe called the intake manifold and, in many engines, a similar exhaust manifold is provided to carry off the gases produced by combustion. The fuel is admitted to each cylinder and the waste gases exhausted through mechanically operated poppet valves or sleeve valves. The valves are normally held closed by the pressure of springs and are opened at the proper time during the operating cycle by cams on a rotating camshaft that is geared to the crankshaft. By the 1980s more sophisticated fuel-injection systems, also used in Diesel engines, had largely replaced this traditional method of supplying the proper mix of air and fuel. In engines with fuel injection, a mechanically or electronically controlled monitoring system injects the appropriate amount of gas directly into the cylinder or inlet valve at the appropriate time. The gas vaporizes as it enters the cylinder. This system is more fuel-efficient than the carburetor and produces less pollution.

In all engines some means of igniting the fuel in the cylinder must be provided. For example, the ignition system of Otto-cycle engines described below consists of a source of low-voltage, direct current electricity that is connected to the primary of a transformer called an ignition coil. The current is interrupted many times a second by an automatic switch called the timer. The pulsations of the current in the primary induce a pulsating, high-voltage current in the secondary. The high-voltage current is led to each cylinder in turn by a rotary switch called the distributor. The actual ignition device is the spark plug, an insulated conductor set in the wall or top of each cylinder. At the inner end of the spark plug is a small gap between two wires. The high-voltage current arcs across this gap yielding the spark that ignites the fuel mixture in the cylinder.

Because of the heat of combustion, all engines must be equipped with some type of cooling system. Some aircraft and automobile engines, small stationary engines, and outboard motors for boats are cooled by air. In this system the outside surfaces of the cylinder are shaped in a series of radiating fins with a large area of metal to radiate heat from the cylinder. Other engines are water-cooled and have their cylinders enclosed in an external water jacket. In automobiles, water is circulated through the jacket by means of a water pump and cooled by passing through the finned coils of a radiator. Some automobile engines are also air-cooled, and in marine engines seawater is used for cooling.

Unlike steam engines and turbines, internal-combustion engines develop no torque when starting, and therefore provision must be made for turning the crankshaft so that the cycle of operation can begin. Automobile engines are normally started by means of an electric motor or starter that is geared to the crankshaft with a clutch that automatically disengages the motor after the engine has started. Small engines are sometimes started manually by turning the crankshaft with a crank or by pulling a rope wound several times around the flywheel. Methods of starting large engines include the inertia starter, which consists of a flywheel that is rotated by hand or by means of an electric motor until its kinetic energy is sufficient to turn the crankshaft, and the explosive starter, which employs the explosion of a blank cartridge to drive a turbine wheel that is coupled to the engine. The inertia and explosive starters are chiefly used to start airplane engines.

Otto-Cycle Engines

The ordinary Otto-cycle engine is a four-stroke engine; that is, in a complete power cycle, its pistons make four strokes, two toward the head (closed head) of the cylinder and two away from the head. During the first stroke of the cycle, the piston moves away from the cylinder head while simultaneously the intake valve is opened. The motion of the piston during this stroke sucks a quantity of a fuel and air mixture into the combustion chamber. During the next stroke, the piston moves toward the cylinder head and compresses the fuel mixture in the combustion chamber. At the moment when the piston reaches the end of this stroke and the volume of the combustion chamber is at a minimum, the fuel mixture is ignited by the spark plug and burns, expanding and exerting a pressure on the piston, which is then driven away from the cylinder head in the third stroke. During the final stroke, the exhaust valve is opened and the piston moves toward the cylinder head, driving the exhaust gases out of the combustion chamber and leaving the cylinder ready to repeat the cycle.

The efficiency of a modern Otto-cycle engine is limited by a number of factors, including losses by cooling and by friction. In general, the efficiency of such engines is determined by the compression ratio of the engine. The compression ratio (the ratio between the maximum and minimum volumes of the combustion chamber) is usually about 8 to 1 or 10 to 1 in most modern Otto-cycle engines. Higher compression ratios, up to about 15 to 1, with a resulting increase of efficiency, are possible with the use of high-octane antiknock fuels. The efficiencies of good modern Otto-cycle engines range between 25 and 30 percent—in other words, only this percentage of the heat energy of the fuel is transformed into mechanical energy.

Diesel Engines

Theoretically, the Diesel cycle differs from the Otto cycle in that combustion takes place at constant volume rather than at constant pressure. Most Diesels are also four-stroke engines but they operate differently than the four-stroke Otto-cycle engines. The first, or suction, stroke draws air, but no fuel, into the combustion chamber through an intake valve. On the second, or compression, stroke the air is compressed to a small fraction of its former volume and is heated to approximately 440° C. (approximately 820° F.) by this compression. At the end of the compression stroke, vaporized fuel is injected into the combustion chamber and burns instantly because of the high temperature of the air in the chamber. Some Diesels have auxiliary electrical ignition systems to ignite the fuel when the engine starts and until it warms up. This combustion drives the piston back on the third, or power, stroke of the cycle. The fourth stroke, as in the Otto-cycle engine, is an exhaust stroke.

The efficiency of the Diesel engine, which is in general governed by the same factors that control the efficiency of Otto-cycle engines, is inherently greater than that of any Otto-cycle engine and in actual engines today is slightly more than 40 percent. Diesels are, in general, slow-speed engines with crankshaft speeds of 100 to 750 revolutions per minute (rpm) as compared to 2500 to 5000 rpm for typical Otto-cycle engines. Some types of Diesel, however, have speeds up to 2000 rpm and even higher. Because Diesels use compression ratios of 14 or more to 1, they are generally more heavily built than Otto-cycle engines, but this disadvantage is counterbalanced by their greater efficiency and the fact that they can be operated on less expensive fuel oils.

Two-Stroke Engines

By suitable design it is possible to operate an Otto-cycle or Diesel as a two-stroke or two-cycle engine with a power stroke every other stroke of the piston instead of once every four strokes. The efficiency of such engines is less than that of four-stroke engines, and therefore the power of a two-stroke engine is always less than half that of a four-stroke engine of comparable size.

The general principle of the two-stroke engine is to shorten the periods in which fuel is introduced to the combustion chamber and in which the spent gases are exhausted to a small fraction of the duration of a stroke instead of allowing each of these operations to occupy a full stroke. In the simplest type of two-stroke engine, sleeve valves or ports (openings in the cylinder wall that are uncovered by the piston at the end of its outward travel) replace the poppet valves. In the two-stroke cycle, the fuel mixture or air is introduced through the intake port when the piston is fully withdrawn from the cylinder. The compression stroke follows, and the charge is ignited when the piston reaches the end of this stroke. The piston then moves outward on the power stroke, uncovering the exhaust port and permitting the gases to escape from the combustion chamber.

Rotary Engine

In the 1950s the German engineer Felix Wankel developed an internal-combustion engine of a radically new design, in which a three-cornered rotor turning in a roughly oval chamber replaces the piston and cylinder. The fuel-air mixture is drawn in through an intake port and trapped between one face of the turning rotor and the wall of the oval chamber. The turning of the rotor compresses the mixture, which is ignited by a spark plug. The exhaust gases are then expelled through an exhaust port through the action of the turning rotor. The cycle takes place alternately at each face of the rotor, giving three power strokes for each turn of the rotor. Because of the Wankel engine's compact size and consequent lesser weight as compared with the piston engine, it appeared to be an important option for automobiles. In addition, its mechanical simplicity provided low manufacturing costs, its cooling requirements were low and its low center of gravity made it safer to drive. A line of Wankel-engine cars was produced in Japan in the early 1970s, and several United States automobile manufacturers researched the idea as well. However, production of the Wankel engine was discontinued as a result of its poor fuel economy and its high pollutant emissions.

Stratified Charge Engine

A modification of the conventional spark-ignition piston engine, the stratified charge engine is designed to reduce emissions without the need for an exhaust-gas re-circulation system or catalytic converter. Its key feature is a dual combustion chamber for each cylinder with a pre-chamber that receives a rich fuel-air mixture while the main chamber is charged with a very lean mixture. The spark ignites the rich mixture that in turn ignites the lean main mixture. The resulting peak temperature is low enough to inhibit the formation of nitrogen oxides, and the mean temperature is sufficiently high to limit emissions of carbon monoxide and hydrocarbon.

Research on modifications of conventional engines as well as alternatives to conventional engines continues. Some of these options include a modified version of the two-stroke engine, the twin engine (a combination of an internal-combustion engine and an electric engine), and the Stirling engine.

Stirling Engine

Stirling engine is a type of engine that derives mechanical power from the expansion of a confined gas at a high temperature. The engine was patented in 1816 by the Scottish clergyman Robert Stirling and was used as a small power source in many industries during the 19th and early 20th centuries. The need for automobile engines with low emission of toxic gases has revived interest in the Stirling engine, and prototypes have been built with up to 500 hp and with efficiencies of 30 to 45 percent. Common internal-combustion engines have efficiencies in the range of 20 to 30 percent.

The cycle that provides the work is called the Stirling cycle. It consists in its simplest form of the compression of a fixed amount of so-called working gas (hydrogen or helium) in a cool chamber. This cool compressed gas is transferred to a hot chamber, which is heated by an external burner, where the gas expands and drives a piston that delivers the work. The expanded hot gas is then cooled and returned to the cold chamber, and the cycle begins again. The engine is able to transform heat into work because the expansion of the gas at high temperature delivers more work than is required to compress the same amount of gas at low temperature.

An external continuous burner that can operate on gasoline, alcohol, natural gas, propane, or butane, provides the heat for the expansion chamber, and the exhaust generated has very low free carbon and toxic gas levels. The Stirling engine runs smoothly because pressure variations in the compression and expansion chambers are sinusoidal, that is, relatively gradual, rather than explosive as in internal-combustion cycles. The necessity of rapid removal of heat from the hot working gas requires a large radiator, which makes this type of engine less suited to small automobiles.

The Scuderi Split-Cycle Engine

The Scuderi Split-Cycle Engine presently under development divides (or splits) the four strokes of the Otto cycle over a paired combination of one compression cylinder and one power (or expansion) cylinder, operating in principle like the Brayton engine in 1873. These two cylinders perform their respective functions once per crankshaft revolution.

The concept is shown in FIG. 1 where an intake charge is drawn into the compression cylinder 10 through an intake gas passage way and through typical poppet-style valves. Gas is compressed in the compression cylinder 10 and transferred to a compressed gas accumulator 14 and/or the power cylinder 12 through a crossover gas passage, which acts as the intake port for the power cylinder 12. The crossover gas passage includes a set of uniquely timed valves, which maintain a pre-charged pressure in the compressed gas accumulator 14 through all four strokes of the cycle. A check valve is used to prevent reverse flow from the crossover gas passage to the compression cylinder 10. Likewise a poppet-style valve prevents reverse flow from the power cylinder 12 to the crossover passage during the power and exhaust strokes.

Shortly after the piston in the power cylinder 12 reaches its top dead center position, the gas is quickly transferred to the power cylinder 12 and fired (or combusted) to produce the power stroke. The exhaust gases are pumped out of the power cylinder 12 during its return exhaust stroke through a typical poppet valve to the exhaust passage way.

BRIEF DESCRIPTION OF THE DRAWINGS

FIG. 2B is a longitudinal cross section view showing 2 adjacent cylinders of the first embodiment of the apparatus of the present invention along line 2B-2B of FIG. 2A;

FIG. 3A is a plan view showing the top of the engine block of the first embodiment of the apparatus of the present invention;

FIG. 3B is a longitudinal cross section view of the engine block along line 3B-3B of FIG. 3A;

FIG. 3C is a plan view showing the bottom of the engine block of the first embodiment of the apparatus of the present invention;

FIG. 3D is a cross section view of the engine block along line 3D-3D of FIG. 3A;

FIG. 3E is a cross section view along line 3E-3E of FIG. 3A showing the nozzle for fuel injector or spark plug in the pre-combustion chamber in the engine block of the first embodiment of the apparatus of the present invention;

FIG. 4A is a plan view showing the top of the engine head-block of the first embodiment of the apparatus of the present invention;

FIG. 4B is a longitudinal cross section view of the engine head-block along line 4B-4B of FIG. 4A;

FIG. 4C is a plan view showing the bottom of the engine head-block of the first embodiment of the apparatus of the present invention;

FIG. 4D is a cross section view of the engine head-block along line 4D-4D of FIG. 4A:

FIG. 5A is a cross section view showing the piston assembly of the first embodiment of the apparatus of the present invention;

FIG. 5B is a cross section view of the piston assembly along line 5B-5B of FIG. 5A;

FIG. 5C is a top view of the piston assembly as seen from line 5C-5C of FIG. 5A;

FIG. 5D is a bottom view of the piston assembly as seen from line 5D-5D of FIG. 5A;

FIG. 21B is a cross section view along line B-B of FIG. 21A showing two opposing cylinders of the fourth and preferred embodiment of the apparatus of the present invention, where both piston rods are connected to the same crankshaft pin;

FIG. 21C is a cross section view along line C-C of FIG. 21B showing the location of the cooling liquid flow weir pins in the cooling chambers of the fourth and preferred embodiment of the apparatus of the present invention;

FIG. 21D is a cross section view along line A-A of FIG. 21A showing the pre-combustion chambers of the fourth and preferred embodiment of the apparatus of the present invention;

FIG. 25A is a cross section view showing two opposing 4-cycle cylinders of the fourth and preferred embodiment of the apparatus of the present invention in which the cylindrical shape air pistons and ring shaped combustion pistons are formed as one unit to function as a compressor. Cylinder 1 is in intake/exhaust stroke while cylinder 2 is in expansion/compression stroke;

FIG. 25B is a cross section view showing two opposing 4-cycle cylinders of the fourth and preferred embodiment of the apparatus of the present invention in which the cylindrical shape air pistons and ring shaped combustion pistons are formed as one unit to function as a compressor. Cylinder 1 is in intake/compression stroke while cylinder 2 is in expansion/exhaust stroke;

FIG. 25C is a cross section view showing two opposing 4-cycle cylinders of the fourth and preferred embodiment of the apparatus of the present invention in which the cylindrical shape air piston heads are aligned with the ring shaped combustion pistons and formed as one unit to function as a compressor. Cylinder 1 is in expansion/compression stroke while cylinder 2 is in intake/exhaust stroke;

FIG. 25D is a cross section view showing two opposing 4-cycle cylinders of the fourth and preferred embodiment of the apparatus of the present invention in which the cylindrical shape air pistons have one common head in the middle and form one unit with the ring shaped combustion pistons to function as a compressor. Cylinder 1 is in expansion/exhaust stroke while cylinder 2 is in intake/compression stroke; and FIG. 25E shows the hatch patterns of the intake, compression, expansion and exhaust used in the figures from 25A through 25D.

EMBODIMENTS OF THE PRESENT INVENTION

It is believed that a clearer understanding of the present invention will be obtained by first describing somewhat briefly the main components of the apparatus of the first embodiment of the present invention, followed by a general description of its operation. After this, there will be an introduction to basic thermodynamics followed by an air-standard analysis of the combustion-engine process comparing the performance of prior art engines with the present invention. Then there will be descriptions of further embodiments.

Figure 1:
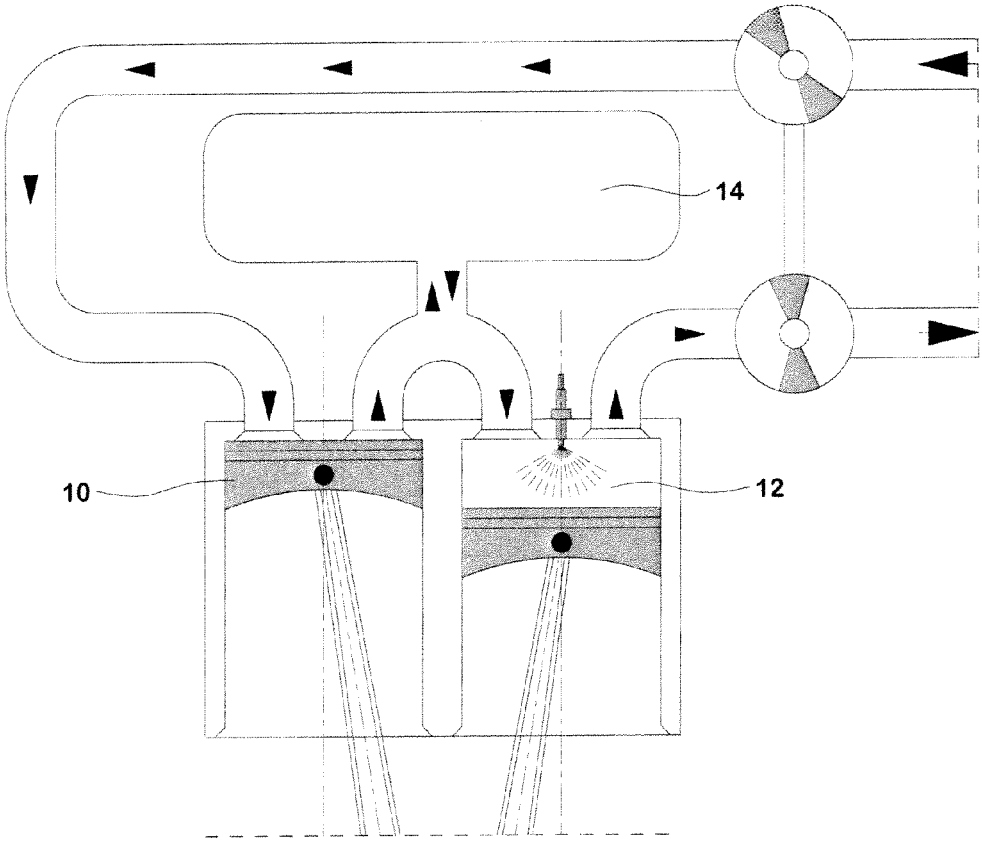
FIG. 1 Prior Art
FIG. 1 is a schematic view showing the concept of the prior art Scuderi Split-Cycle Engine.
Figure 2A:
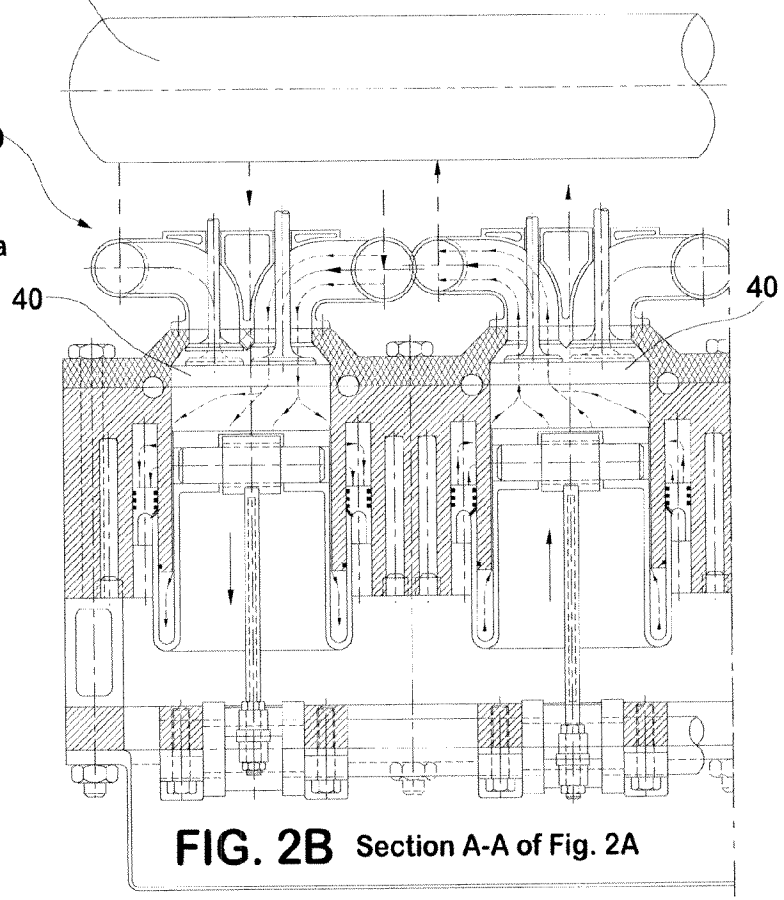
FIG. 2A is a cross section view showing the first embodiment of the apparatus of the present invention.

Reference is made to FIG. 2A, which shows the cross section view, and FIG. 2B, which shows the longitudinal cross section view of 2 adjacent cylinders.

Figure 2A:
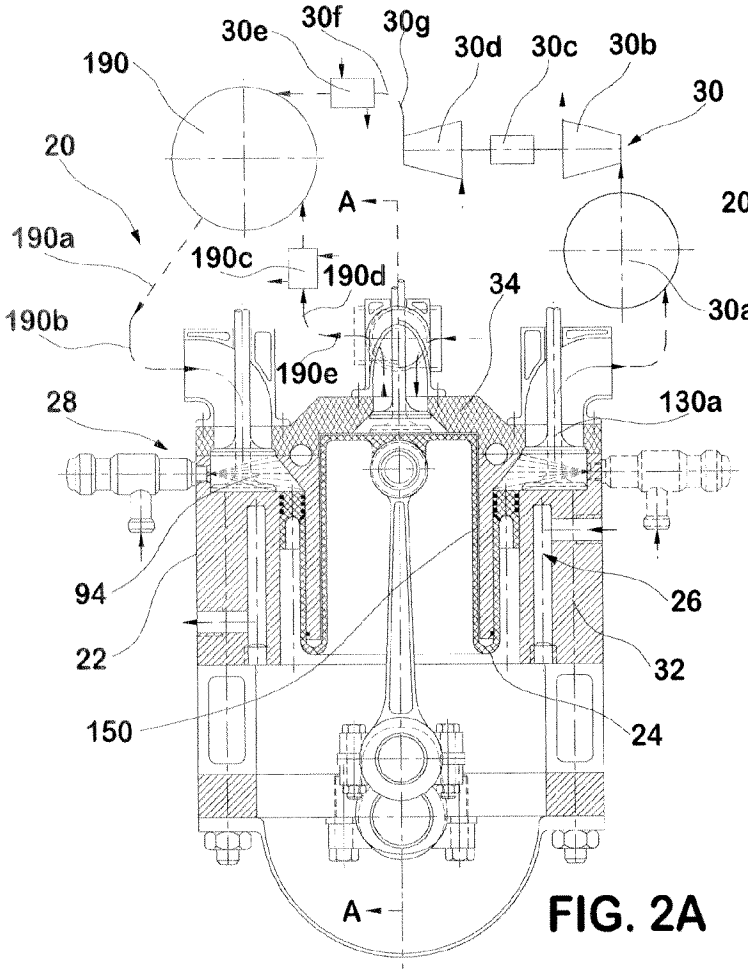

As shown in FIG. 2, there is an engine 20 schematically shown in a cross-sectional view. In the broader scope, an engine is defined as a device to convert energy; however, in a preferred form, the engine 20 is an internal combustion engine which is shown in various embodiments further described herein. In general, the engine 20 comprises a casing 22, a piston assembly 24, a cooling system 26, a fuel injection and ignition system 28 and an exhaust assembly 30.

Since the engine block 32, the head block 34 and the piston assembly primarily 24 are substantially different from the known prior art, only these three components of the first embodiment of the present invention will be described in detail. All the other components of the present invention as listed above are typically more or less of same design as in the prior art internal-combustion engines and will therefore be referred to by name and reference number only without further description.

Engine Block

Referring ahead now to FIGS. 3A-3E and FIGS. 4A-4D, it can be seen that the casing 22 in general comprises an engine block 32 and a head block 34.

With reference to FIG. 3B, which shows the longitudinal cross section of two adjacent cylinders, the engine block 32 has a cylinder shape bore 36, which forms the outside wall surface 38 of a cylindrical air chamber 40. Radially outwards from the cylindrical air chamber 40 there is an annular shape combustion chamber 42, which has a circular inner wall surface 44, circular outer wall surface 46, closed annular shaped top surface 48, and an annular shaped open end 50 opposite of the top surface 48. The bottom end of the circular inner wall surface 44 of the annular shape combustion chamber 42 and the bottom end of the outside wall surface 38 of the cylindrical air chamber 40 defines an annular shape surface 52. It will be shown later in connection with the description of the piston assembly how this surface 52 fits inside the annular shape air chamber in the piston assembly. In the lower part of the circular inner wall surface 44 of the annular shape combustion chamber 42 there is a circular groove 54 for an oil scraper ring of conventional design.

There will now be a discussion of the cooling system 26. In one form it forms a portion of the engine block number 32. For the sake of clarity, the right-hand portion in FIG. 3B will be used to disclose the chambers which in part define the cooling system 26.

Radially outward from the annular shape combustion chamber 42 there is an annular shaped cooling chamber 60, which has a circular inner wall surface 62, circular outer wall surface 64, closed annular shaped top surface 66 and an annular shaped open end 68 opposite of the top surface 66. This open end 68 is closed with an annular shaped threaded or welded cover 70. As shown in FIG. 3D, the cooling liquid inlet port 74 and outlet port 76 are typically threaded and connected to outside tubing for cooling liquid or gas transfer. As shown in FIG. 3B, on the top of the engine block there is a circular groove 81 surrounding the circular shape air chamber 40 forming the bottom half of the cross section of another cooling chamber 80. This circular groove 81, which can be seen in FIG. 3A, which shows the top plan view of the engine block, is connected by two additional grooves 82 and 84 opposite from each other with the outside edges 86 and 88 of the engine block 32 to form the bottom half of the cross section of the cooling liquid inlet 90 and outlet 92 channels. The inlet port 90 and outlet port 92 ends of these groves are typically threaded and connected to outside tubing for cooling liquid or gas transfer. The cooling liquid is typically water or oil, but air or other gases could as well be used for the cooling purpose.

With reference to FIG. 3D, on the top of the annular shape combustion chamber 42 there are two fixed volume pre-combustion chambers 94 and 96. The "fixed volume" description is used to differentiate these pre-combustion chambers from the main annular shape combustion chamber 42, which volume varies with the in-and-out stroke of the piston.

The left side pre-combustion chamber 94 has a fuel injector nozzle 98 for fuel injection in the Diesel-cycle engine version and an additional spark plug nozzle 106 in the Otto-cycle engine version. The right side fixed volume combustion chamber 96 does not have any nozzles in it making it a supercharged combustion air supply chamber 100. Its function will be described later in connection with the operation of the present invention.

Both the pre-combustion chamber 94 and the supercharged combustion air supply chamber 100 communicate with the main annular shape combustion chamber 42 through openings 102 and 104 in the bottom of the fixed volume chambers at their end just above the annular shape combustion chamber 42. These openings 102 and 104 can be seen in the plan view in FIG. 3A, which shows the top plan view of the engine block 32 with two adjacent cylinders. In the first embodiment of the present invention the pre-combustion chamber 94 and the supercharged combustion air supply chamber 100 are at opposite sides of the engine block. However, more than two of the fixed volume pre-combustion chambers can be used in large diameter engines of the preferred embodiments.

The fuel injector nozzle 98 and the spark plug nozzle 106 are shown side-by-side penetrating the engine block 32 sidewall 35 into the pre-combustion chamber 94 in FIG. 3A.

FIG. 3E shows the threaded cross section of the nozzles along line 3E-3E of FIG. 3A.

The bottom of the engine block is shown in plan view in FIG. 3C. 8 holes 110 through the engine block surrounding each cylinder are shown in this view as well as in the top plan view in FIG. 3A for the engine assembly tie rods.

Head Block

The construction of the head block 34 is shown in FIG. 4A through FIG. 4D.

The top of the engine head block 34 covering two adjacent cylinder regions 120 and 122 is shown in plan view in FIG. 4A. The ambient air intake port 124 and the supercharged air discharge port 126 are in the middle of the head block just above the cylindrical air chamber 40 in the engine block 32 of FIG. 3B. The ambient air intake port 124 is typically larger than the supercharged air discharge port 126 since the volume of the supercharged air is smaller. The supercharged air intake port 129 is shown on the topside of FIG. 4A just above the pre-combustion chamber 94 in the engine block (see FIG. 3B). The exhaust port 130 for the waste gases is shown on the bottom side of FIG. 4A just above the supercharged combustion air supply chamber 100 in the engine block 32.

FIG. 4B shows the longitudinal cross section view of the head block 34 along line A-A of FIG. 4A.

The bottom of the engine head block in plan view is shown in FIG. 4C.

In the bottom of the head block there is a circular groove 134 surrounding the top of the circular shape air chamber 40 (see FIG. 3B) forming the top half of the cross section of another cooling chamber 80. This circular groove 134 is connected by two additional grooves 136 and 138 opposite from the grooves 82 and 84 (see FIG. 3A) and in communication with the cooling liquid inlet 90 and outlet 92 channels. The inlet port 90 and outlet port 92 ends of these groves are typically threaded and connected to outside tubing for cooling liquid or gas transfer. The cooling liquid is typically water or oil, but air or other gases could as well be used for the cooling purpose.

The 8 larger holes 140 around each cylinder head are for the tie rods of the engine assembly and correspond in location with holes 110 as shown in FIG. 3C. The smaller holes 142 around the air ports are for the attachment of the respective valve blocks and overhead cam assemblies to the head block 34.

The cylindrical shape recess 146 in the bottom of the head block 34 is an extension of the cylindrical air chamber 40 of the engine block 32.

FIG. 4D is a cross section view of the engine head block along line B-B of FIG. 4A. The conical shaped recesses 148 in the head block form the seats for the valve heads.

Piston Assembly

The construction of the piston assembly is shown in FIG. 5A through FIG. 5D.

With reference to FIG. 5A the piston assembly 24 comprises a cylindrical shape air piston 150 that fits loosely, typically with a 1-2 mm clearance, inside the cylindrical air chamber 40 in the engine block 32, and an annular shape combustion piston 152 that fits tightly inside the annular shape combustion chamber 42 in the engine block 32. The top surface 154 of the annular shape combustion piston forms the moving bottom of the annular shape combustion chamber 42 and is typically coated with very heat resistant material, which may be constructed of either metal, ceramics, or other materials.

The outside cylindrical wall 156 of the annular shape piston 152 has typically 3 or more circular grooves 158 for piston rings. Two or more of the upper grooves are for compression rings and one or two of the lower grooves are for oil scraper rings. The inside cylindrical wall 160 of the annular shape piston 152 has typically 3 or more circular grooves 162 for piston rings. Two or more of the upper grooves are for compression rings and one or two of the lower grooves are for oil scraping rings. The function, shape and fit of the piston rings is typically the same as in the prior art internal-combustion engines and therefore will not be described here in more detail. Oil consumption is controlled principally by the use of slotted oil rings. However, it is the combination of compression and oil scraping rings that determines the oil consumption of the engine.

The inside cylindrical wall 160 of the annular shape piston 152 continues downward the distance of the stroke of the piston and meets the lower part of the outer wall 164 of the cylindrical shape air piston 150 to form an annular shape air chamber 166. The open annular shape top end 168 of this annular shape air chamber 166 is covered by the stationary annular shape face 52 that is formed between the bottom of the inner wall 44 of the combustion chamber 42 and the bottom of the inner wall 38 of the circular air chamber 40 in the engine block 32. (See FIG. 3B). The in-and-out motion of the piston assembly 24 varies the volume of this annular air chamber 166 in the piston assembly. Thus, during the induction and expansion strokes ambient air is drawn in from the cylindrical air chamber 40 to be compressed to supercharged air during the compression and exhaust strokes and to exit again through the cylindrical air chamber 40 into the supercharged air accumulator 190.

The small bore openings 182 below and around the periphery of the ring shape piston allow lubricating (and cooling) oil from the crankcase to enter and exit between the adjacent surfaces of the annular air chamber 166 in the piston assembly 24 and the annular shape combustion chamber 42.

With reference to FIG. 5B the top end of the cylindrical air piston 150 has a horizontal bore 170 to receive the piston pin 176. The piston pin bearing 174, bearing housing 178, and connecting rod 180 are of conventional design as used in prior art internal-combustion engines and will therefore not be described here in more detail.

General Description of Operation

1 Induction

Figure 6:
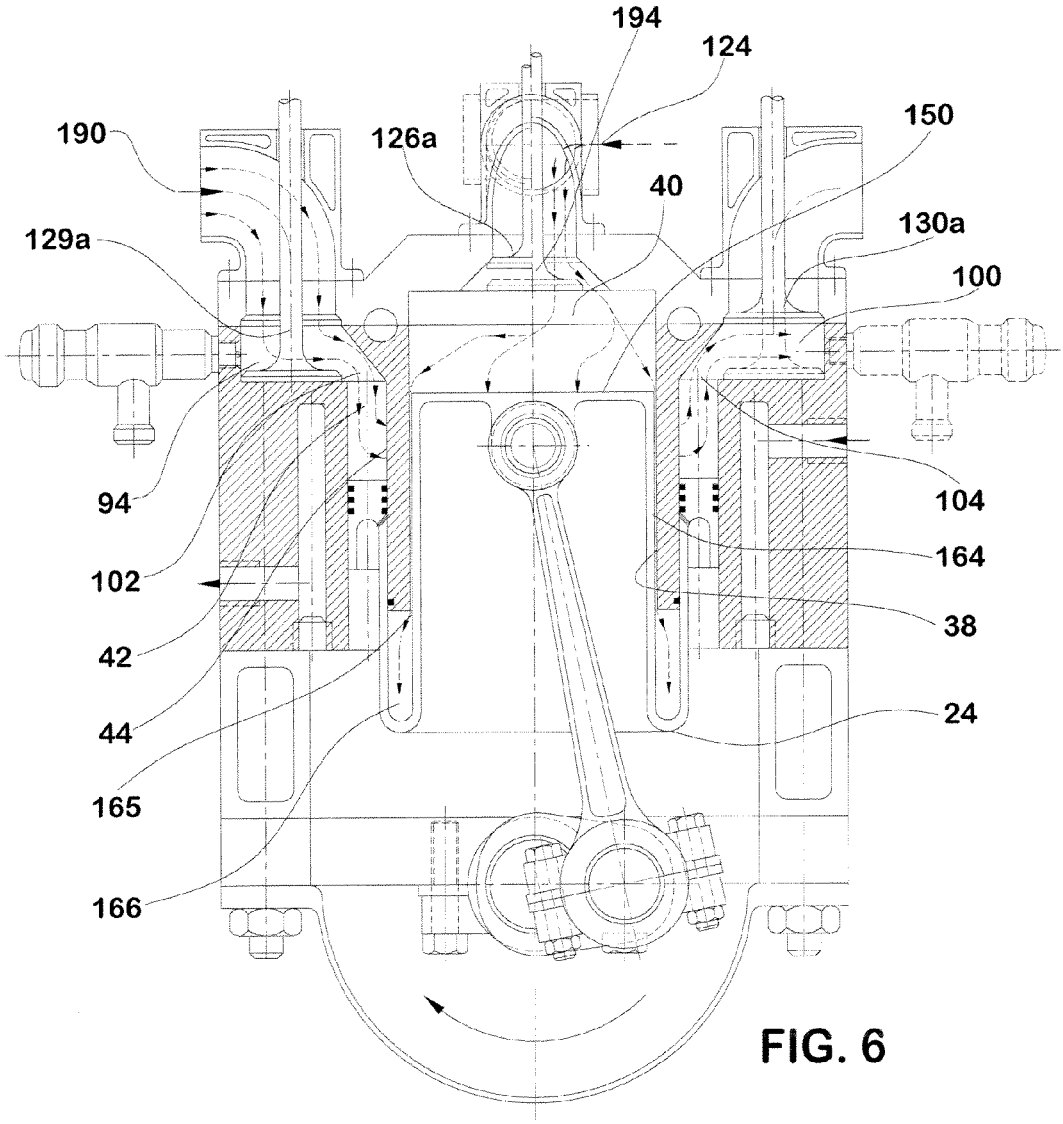
FIG. 6 is a cross section view showing the induction cycle of the first embodiment of the apparatus of the present invention.

Reference is made to FIG. 6 which is a cross section view showing the induction cycle of the first embodiment. As shown in FIG. 6, the induction stroke, during which the piston assembly 24 is moving outwards, starts with the supercharged air intake valve 129*a* open. The supercharged air discharge valve 126*a* and the exhaust valve 130*a* are closed. Supercharged air, typically at 3 atm pressure and 105°-110° C. temperature, from the supercharged air accumulator 190 enters the pre-combustion chamber 94 and flows from there through the opening 102 at the bottom end of the pre-combustion chamber 94 into the top of the annular shape combustion chamber 42 to fill it with supercharged air. At the opposite side from the pre-combustion chamber 94 the supercharged combustion air supply chamber 100 is filled with supercharged air flowing from the top of the annular shape combustion chamber through the opening 104 at the bottom end of the supercharged combustion air supply chamber 100.

The ambient air intake valve 194 at the top of the cylindrical air chamber 40 remains closed until the residual supercharged air in the air chamber has reached the ambient pressure, typically at crankshaft position about 35 degrees after top center, at which time the ambient air intake valve 194 opens. Ambient air is drawn through the ambient air intake port 124 into the cylindrical air chamber 40. Simultaneously air is drawn into the annular air chamber 166 in the piston assembly 24 from the cylindrical air chamber 40 through the typically 1-2 mm wide annular shape clearance between the inside wall surface 38 of the cylindrical air chamber 40 and the outside wall surface 164 of the cylindrical air piston 150.

The incoming air cools the inside wall 44 of the annular shape combustion chamber 42 while flowing through the typically 1-2 mm wide annular shape passage way 165 into the annular shape air chamber 166 in the piston assembly 24.

2 Compression

Figure 7:
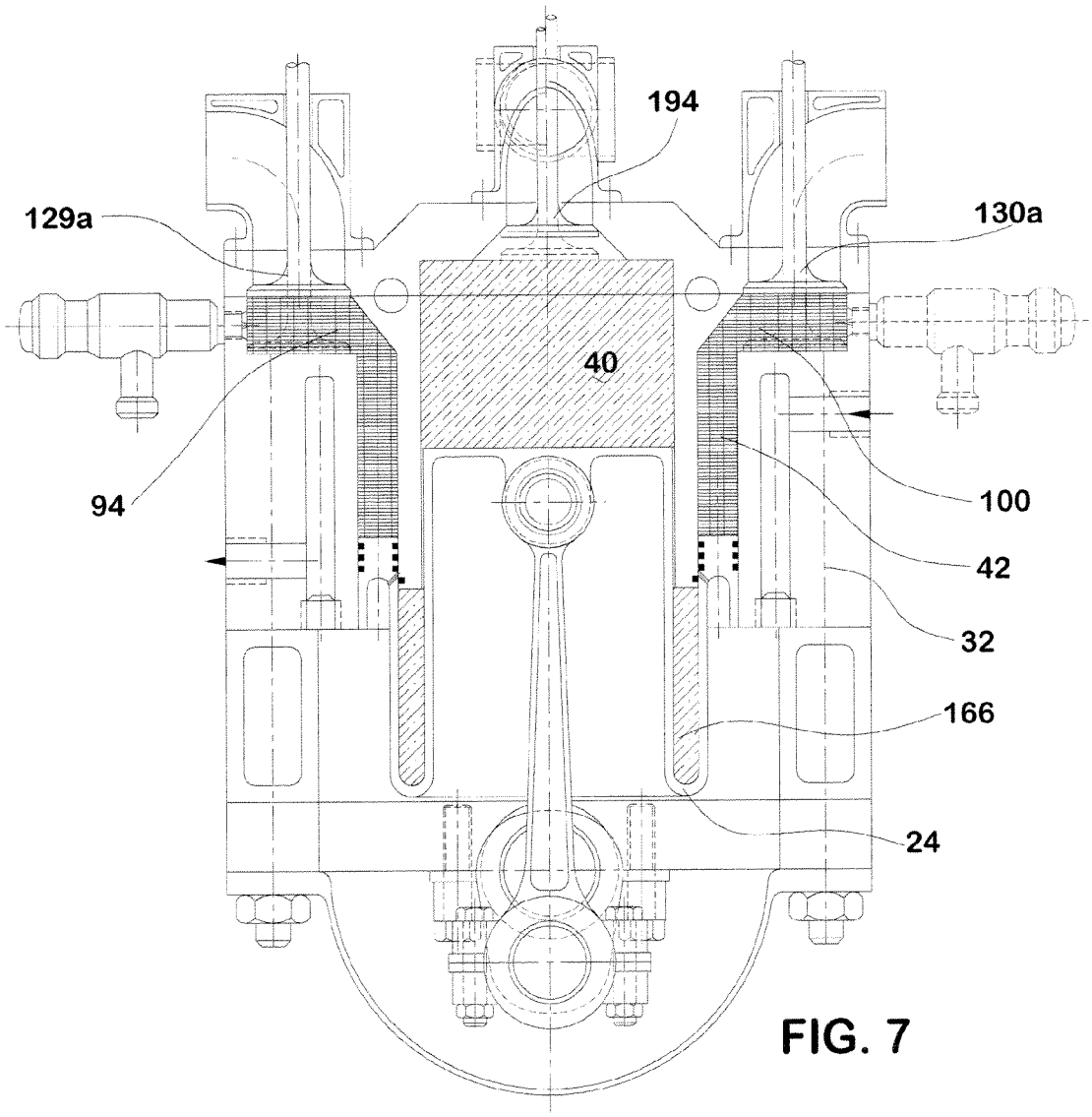
FIG. 7 is a cross section view showing the bottom center position of the piston assembly at the end of the induction cycle and at the start of the compression cycle of the first embodiment of the apparatus of the present invention.

FIG. 7 is a cross section view showing the bottom center position of the piston assembly at the end of the induction cycle and at the start of the compression cycle of the first embodiment of the apparatus of the present invention.

As shown in FIG. 7 the induction stroke ends and the compression stroke starts typically with all valves closed and the piston assembly at the bottom center position. However, in order to attain high output at high engine speed it has been found that the intake valves should be closed appreciably after bottom dead center or after the compression stroke has started. Thus use can be made of the inertia of the flowing air to ram considerably more charge into the cylinder.

FIG. 7 shows the pre-combustion chamber 94, the annular combustion chamber 42 and the supercharged combustion air supply chamber 100 filled with supercharged air, typically at 3 atm pressure and 105-110 degrees C. temperature. It also shows the cylindrical air chamber 40 in the engine block 32 and the annular air chamber 166 in the piston assembly 24 filled with ambient air.

Figure 8:
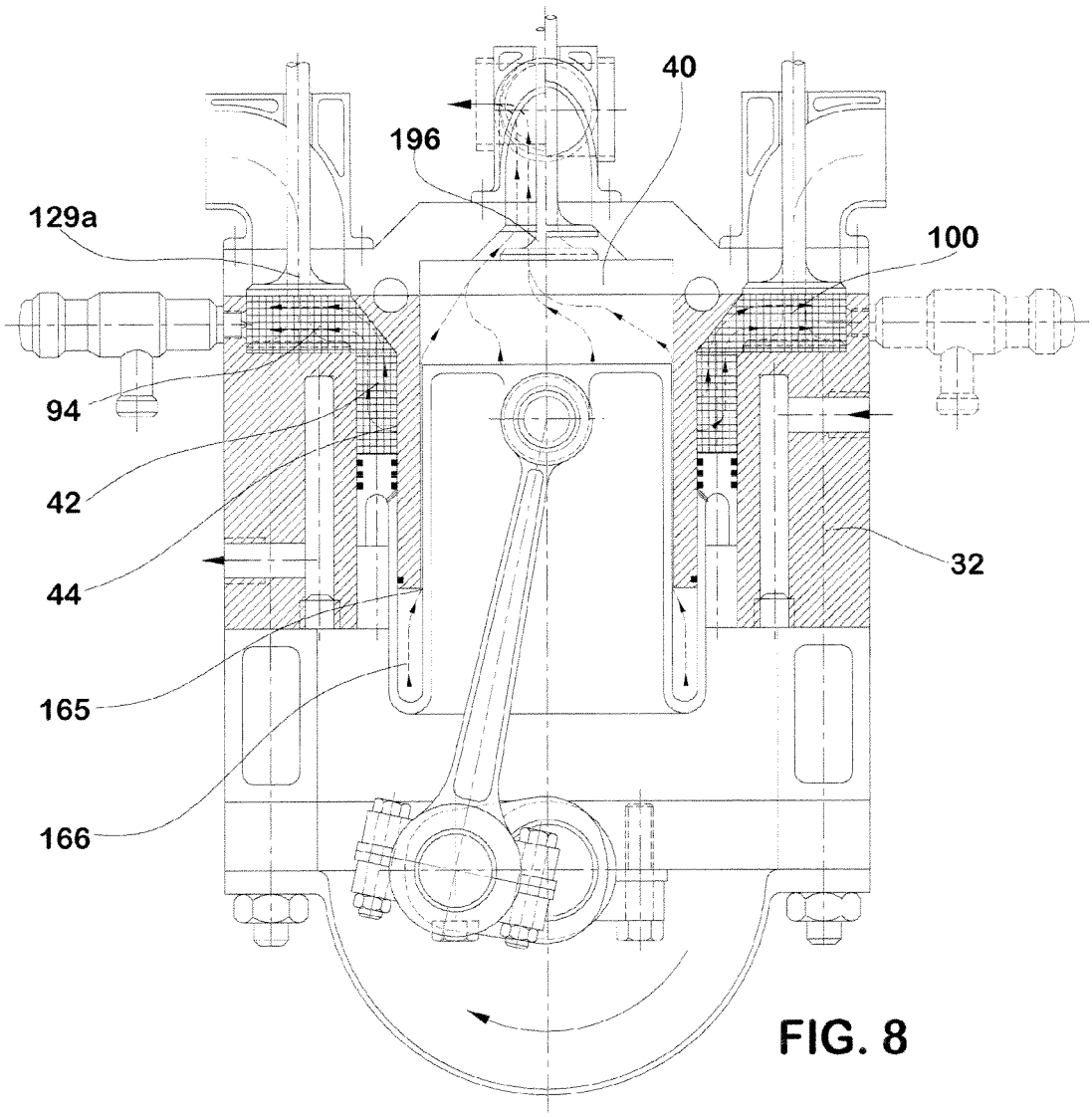
FIG. 8 is a cross section view showing the compression cycle of the first embodiment of the apparatus of the present invention.

FIG. 8 is a cross section view showing the compression cycle of the first embodiment of the apparatus of the present invention.

As shown in FIG. 8 the in-motion of the piston assembly compresses the air in all three combustion chambers 94, 42, and 100 as well as in the two air chambers, the annular air chamber 166 in the piston assembly and the cylindrical air chamber 40 in the engine block.

Typically at the crankshaft position about 75 degrees before top center the supercharged air pressure has reached 3 atm and the supercharged air discharge valve 196 opens to let the compressed air into the supercharged air accumulator 190 of FIG. 2. The supercharged air discharge valve 196 is closed again as the crankshaft reaches top dead center piston position.

To reach the 3 atm pressure with the supercharged air the nominal compression ratio of the air chambers is typically about 2.2:1. The nominal compression ratio (usually specified) is the ratio between the maximum and minimum volumes of the air chambers.

The outgoing air cools the inside wall 44 of the annular shape combustion chamber 42 while flowing through the typically 1-2 mm wide annular shape passage way 165 from the annular shape air chamber 166 in the piston assembly to the cylindrical shape air chamber 40 in the engine block 32.

At the end of the compression stroke the pressure in the combustion chambers is typically 40-45 atm and the temperature 350-400 degrees C. To reach this pressure with the supercharged air at 3 atm pressure and 105-110 degrees C. temperature the nominal compression ratio of the combustion chambers is typically about 7:1. The actual compression ratio is somewhat less than the nominal value because of late intake valve closing in high-speed engines.

3 Expansion

Figure 9:
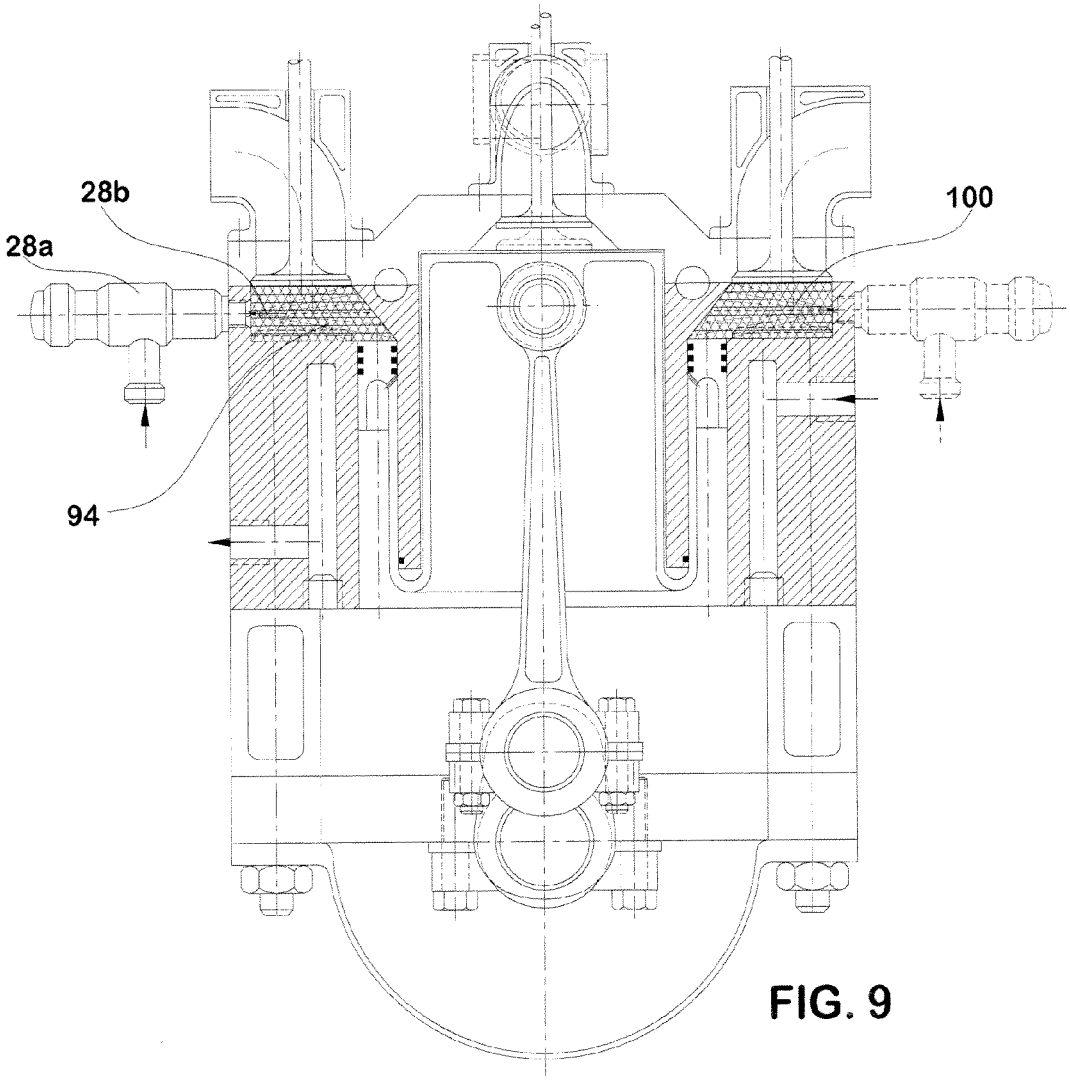
FIG. 9 is a cross section view showing the top center position of the piston assembly at the end of the compression cycle and at the start of the expansion cycle of the first embodiment of the apparatus of the present invention.

FIG. 9 is a cross section view showing the top center position of the piston assembly at the end of the compression cycle and at the start of the expansion cycle of the first embodiment of the apparatus of the present invention.

As shown in FIG. 9 the compression stroke ends and the expansion stroke starts typically with all valves closed and the piston assembly at the top center position. Typically about 2-5 degrees before top center the fuel injector 28*a* begins to introduce the fuel progressively into the supercharged air in the fixed volume pre-combustion chamber 94 prior to inflammation. At top center the spark plug 28*b* ignites the charge in Otto-cycle engine and in the Diesel-engine the temperature of the compressed air is sufficiently high to ignite the fuel. The pressure after ignition climbs typically to 90-135 atm and the temperature to 1200-1400 degrees C.

The flame in the combustion chambers continues to burn as long as the fuel injector feeds fuel into the pre-combustion chamber and the highly turbulent airflow from the compressed supercharged combustion air supply chamber 100 provides the oxygen for the combustion. Typically an air-fuel mixture ratio 7:1 by weight is used on the rich side and 20:1 on the lean side for gasoline engines. Rich mixtures are used to suppress combustion knock and to obtain maximum engine output, and lean mixtures are used to obtain minimum fuel consumption.

Figure 10:
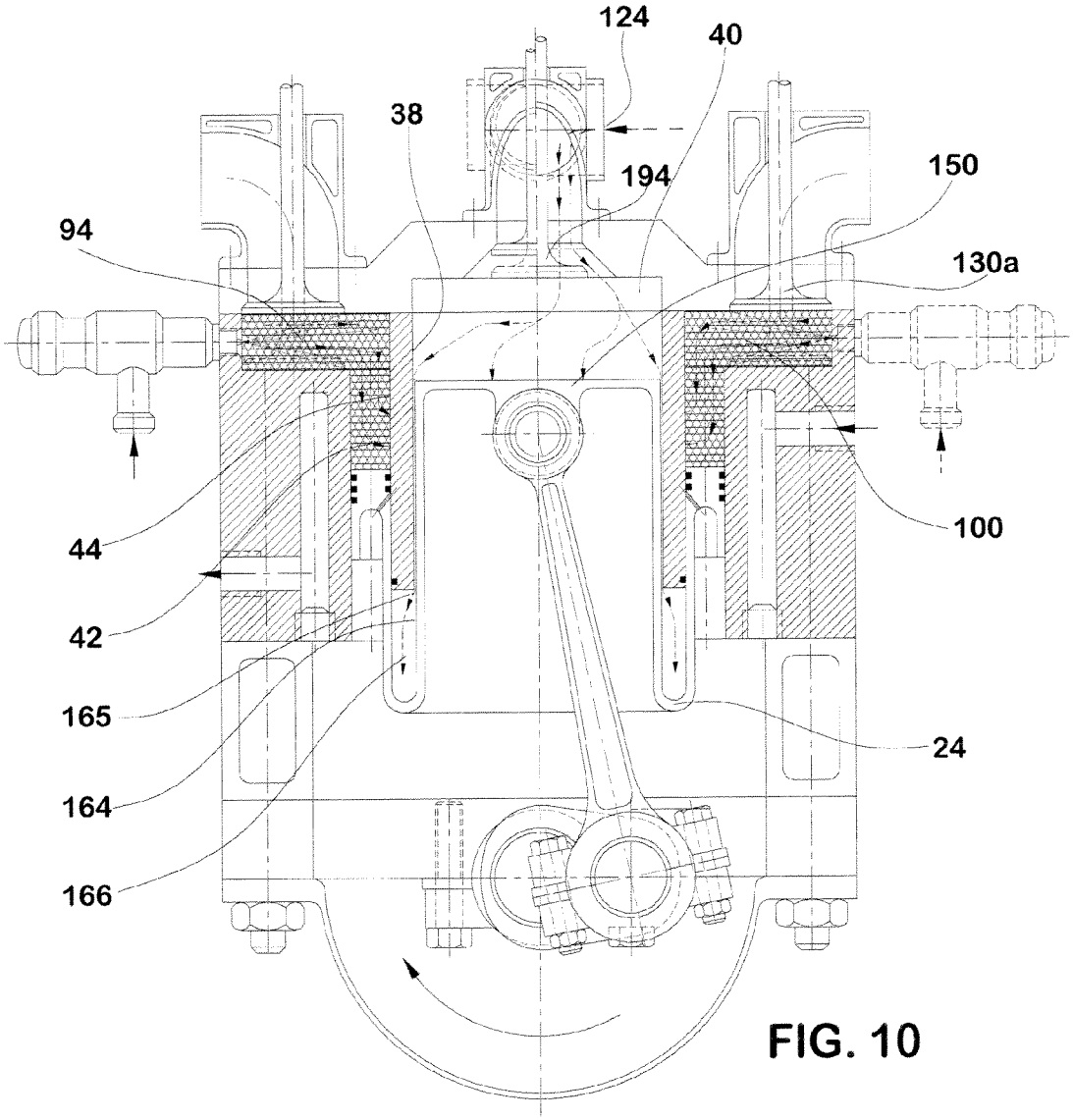
FIG. 10 is a cross section view showing the expansion cycle of the first embodiment of the apparatus of the present invention.

FIG. 10 is a cross section view showing the expansion cycle of the first embodiment of the apparatus of the present invention.

The apparatus of the disclosure in one form is ideally suited for using rich mixtures in the pre-combustion chamber 94 to suppress combustion knock and lean mixtures in the main annular shape combustion chamber 42 by sizing the volumes of the pre-combustion chamber 94 and the compressed supercharged combustion air supply chamber 100 relative to each other so that optimum conditions are reached between desired engine output and fuel consumption.

The ambient air intake valve 194 at the top of the cylindrical air chamber 40 remains closed until the residual supercharged air in the piston air chambers has reached the ambient pressure, typically at crankshaft position about 35 degrees after top center, at which time the ambient air intake valve 194 opens. Ambient air is drawn through the ambient air intake port 124 into the cylindrical air chamber 40. Simultaneously air is drawn into the annular air chamber 166 in the piston assembly 24 from the cylindrical air chamber 40 through the typically 1-2 mm wide annular shape clearance between the inside wall surface 38 of the cylindrical air chamber 40 and the outside wall surface 164 of the cylindrical air piston 150.

Again, as during the induction stroke, the incoming air cools the inside wall 44 of the annular shape combustion chamber 42 while flowing through the typically 1-2 mm wide annular shape passage way 165 into the annular shape air chamber 166 in the piston assembly 24.

20-30 degrees before the bottom center the exhaust valve 130*a* opens to release the waste gases.

4 Exhaust

Figure 11:
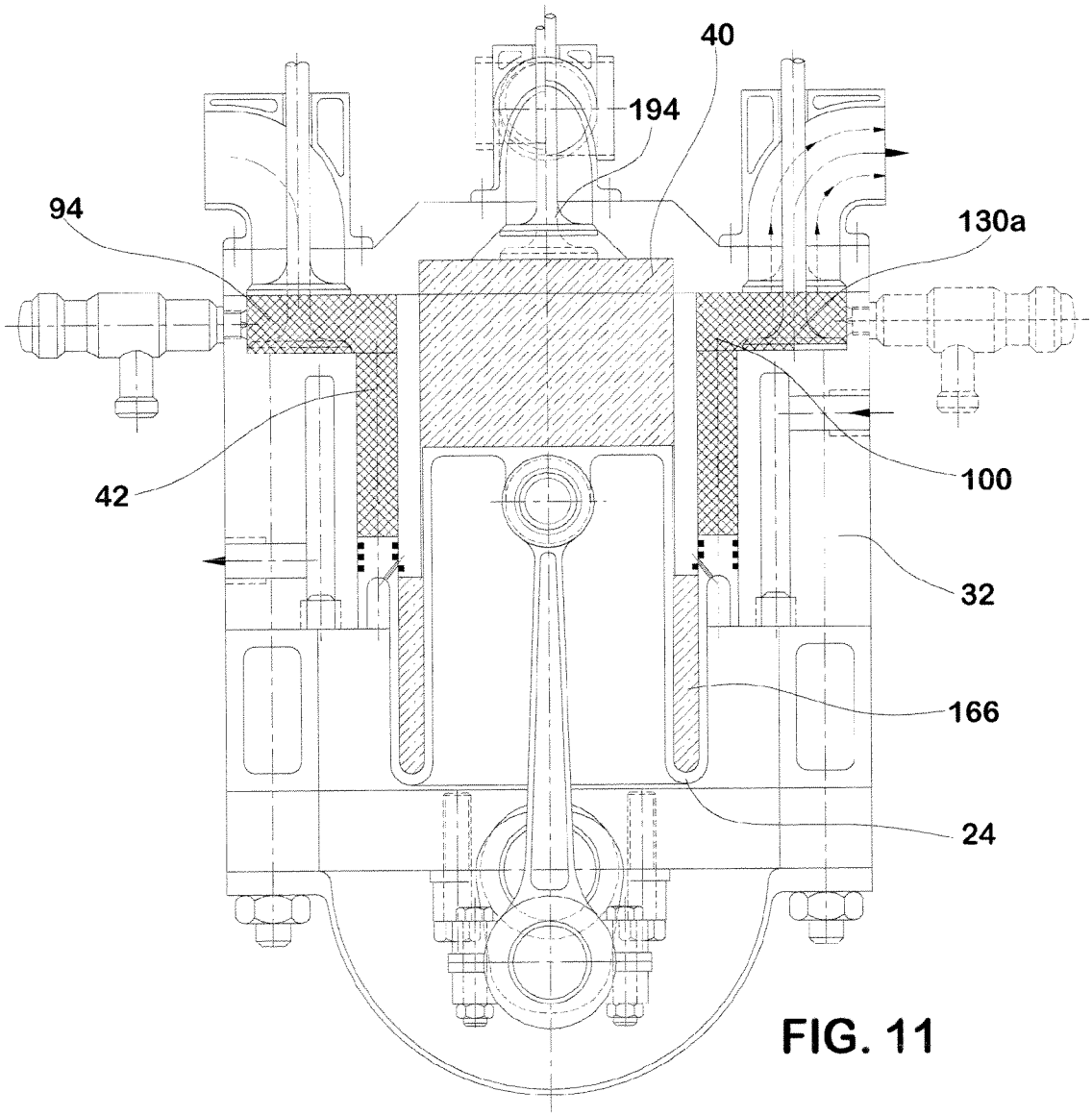
FIG. 11 is a cross section view showing the bottom center position of the piston assembly at the end of the expansion cycle and at the start of the exhaust cycle of the first embodiment of the apparatus of the present invention.

FIG. 11 is a cross section view showing the bottom center position of the piston assembly at the end of the expansion cycle and at the start of the exhaust cycle of the first embodiment of the apparatus of the present invention.

FIG. 11 shows the piston assembly 24 at the bottom center position. The ambient air intake valve 194 is closed and the exhaust stroke begins with the exhaust valve 130*a* already open. The pre-combustion chamber 94, the combustion chamber 42 and the supercharged combustion air supply chamber 100 are full with substancially waste gases. The cylindrical air chamber 40 in the engine block 32 and the annular air chamber 166 in the piston assembly 24 are filled with ambient air.

Figure 12:
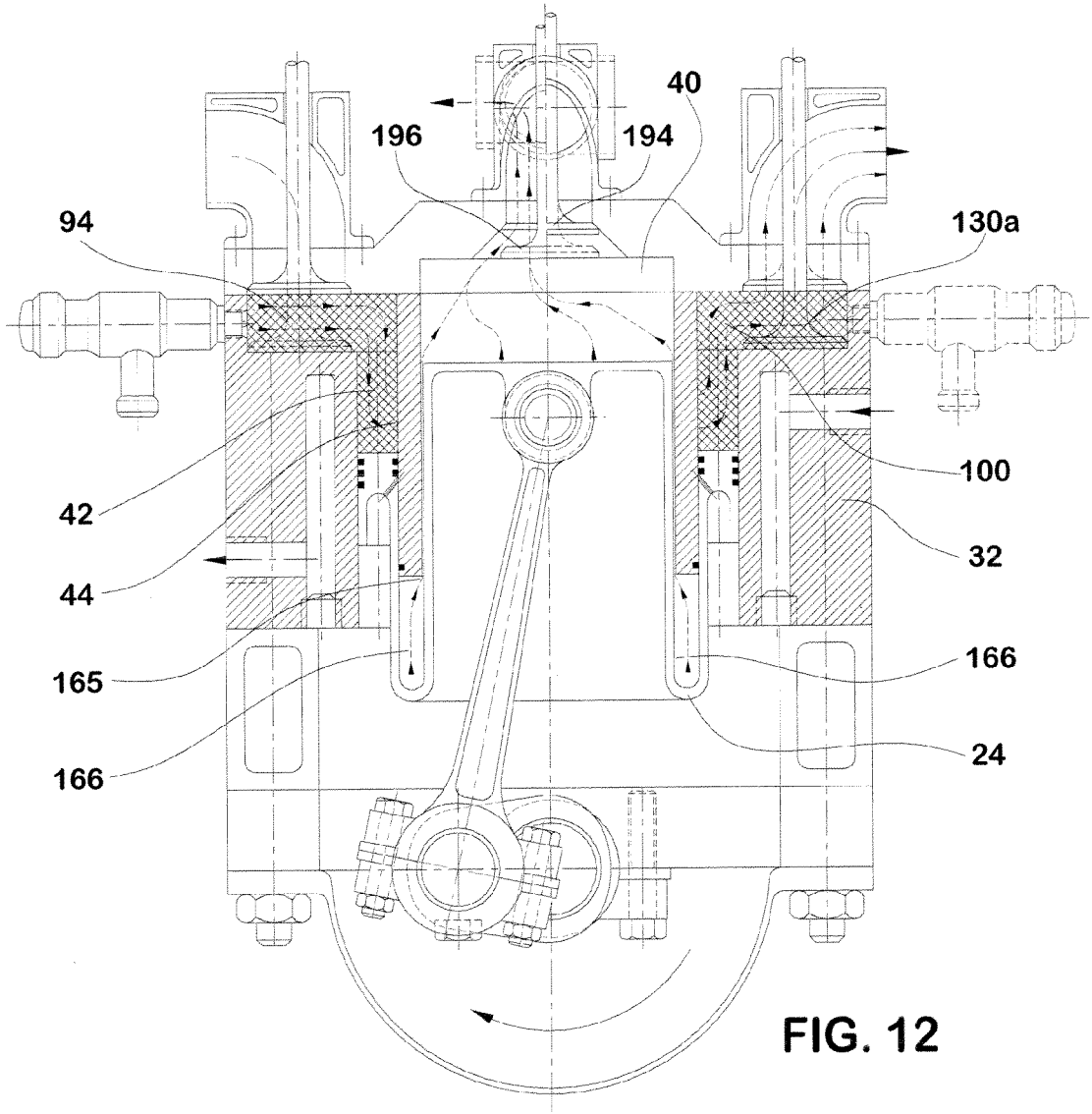
FIG. 12 is a cross section view showing the exhaust cycle of the first embodiment of the apparatus of the present invention.

FIG. 12 is a cross section view showing the exhaust cycle of the first embodiment of the apparatus of the present invention.

As shown in FIG. 12 the in-motion of the piston assembly displaces the waste gases from all three combustion chambers 94, 42, and 100 to flow out through the exhaust valve 130*a* into the exhaust gas accumulator 30*a*.

Again, typically at the crankshaft position about 75 degrees before top center the supercharged air pressure in the cylindrical air chamber 40 in the engine block 32 and the annular air chamber 166 in the piston assembly 24 has reached 3 atm and the supercharged air discharge valve 196 opens to let the compressed air into the supercharged air accumulator 190 of FIG. 2A. The supercharged air discharge valve 196 is closed again at top center piston position before the next induction stroke begins.

Again, as during the compression stroke, the outgoing air cools the inside wall 44 of the annular shape combustion chamber 42 while flowing through the typically 1-2 mm wide annular shape passage way 165 from the annular shape air chamber 166 in the piston assembly to the cylindrical shape air chamber 40 in the engine block 32.

Figure 13:
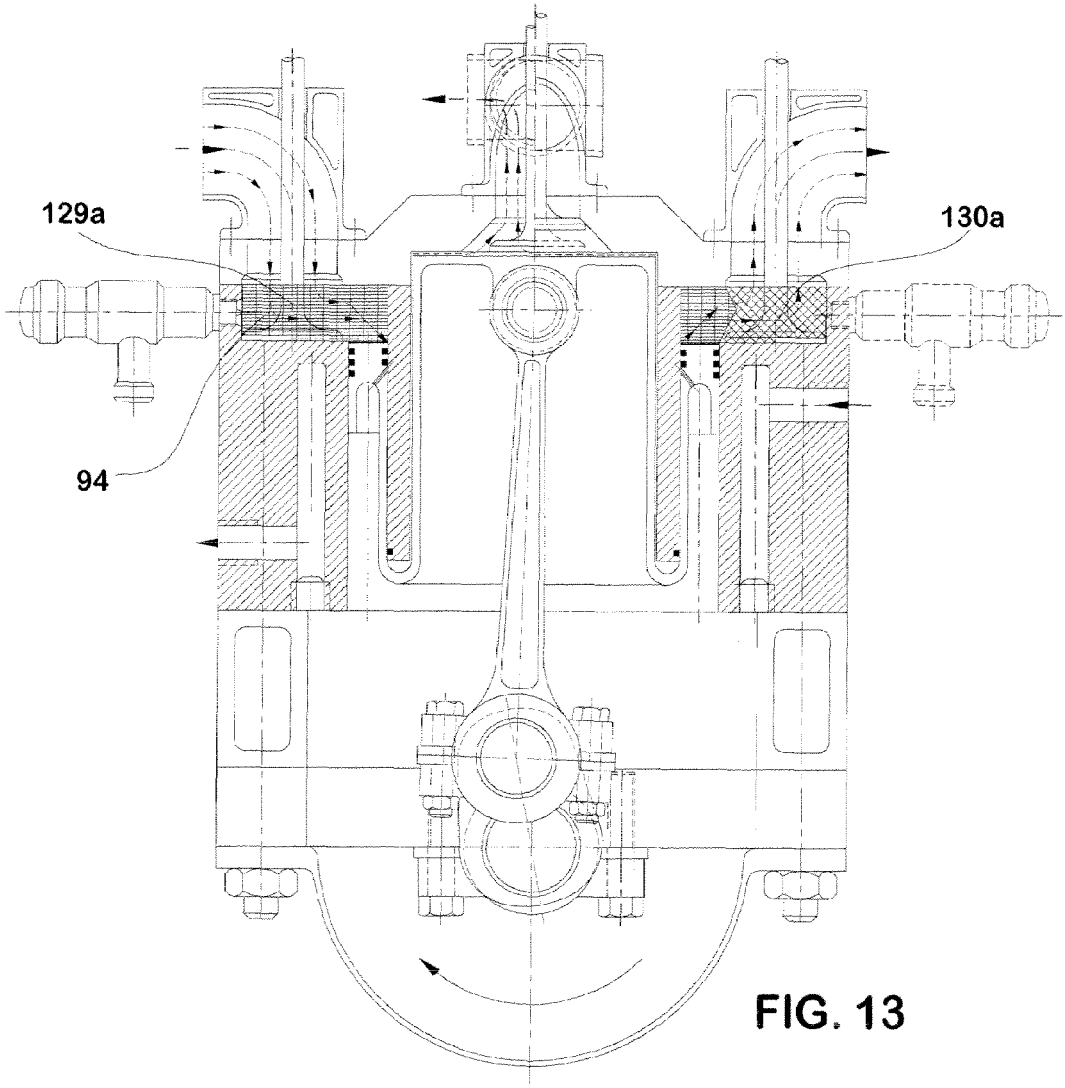
FIG. 13 is a cross section view showing the scavenging of the waste gases starting with the piston assembly at about 10 degrees before the top center in the first embodiment of the apparatus of the present invention.

FIG. 13 is a cross section view showing the scavenging of the waste gases starting with the piston assembly at about 10 degrees before the top center in the first embodiment of the apparatus of the present invention.

FIG. 13 shows how typically at about 10 degrees before top center the supercharged air intake valve 129*a*, opens to let supercharged air flow into the pre-combustion chamber 94 to scavenge the waste gases from the combustion chambers before the exhaust valve 130*a* is closed at top center and the next induction stroke begins.

With reference back to FIG. 2A there is a check valve 190*a* in the passage way 190*b* between the supercharged air accumulator 190 and the fixed volume pre-combustion chamber 94 to stop any waste gases from entering the accumulator at the start of the waste gas scavenging with the supercharged air at the end of the exhaust cycle.

The exhaust valve 130*a* releases the waste gases into a waste gas accumulator 30*a*. The waste gas accumulator pressure is maintained substantially below the pressure in the supercharged air accumulator 190 to enable the supercharged air to scavenge the combustion chambers from waste gases at the end of the exhaust cycle.

The waste gases are released from the waste gas accumulator 30*a* through a gas turbine 30*b* which drives an electric generator 30*c* and/or an air compressor 30*d*. The air compressor 30*d* is used to feed supercharged air into the accumulator 190 to supplement the air supply from the cylindrical air chamber of the engine or to completely eliminate the air supercharge function of the engine.

Before the supercharged hot air from the waste-gas-turbine-driven air compressor 30*d* enters the supercharged air accumulator 190 it is cooled with a heat exchanger 30*e* using typically either water or air for cooling to facilitate larger air charge into the engine during the induction cycle. There is a check valve 30*f* in the passage way 30*g* from the air compressor 30*d* to the supercharged air accumulator 190 to stop any back-flow from the accumulator.

Before the supercharged hot air from the cylindrical air chamber 40 enters the air accumulator 190 it is cooled with a heat exchanger 190*c* using typically either water or air for cooling to facilitate larger air charge into the engine during the induction cycle. There is a check valve 190*d* in the passage way 190*e* from the cylindrical air chamber 40 to the supercharged air accumulator 190 to stop any back-flow from the accumulator.

Basic Thermodynamics

It is believed that a better understanding of the air-standard analysis will be possible by referring first to the Ideal Gas Law of thermodynamics.

In a gas the molecules move at random, bounded only by the walls of their container.

Empirical laws have been developed that correlate macroscopic variables. For common gases, the macroscopic variables include pressure (P), volume (V), and temperature (T). Boyle's law states that in a gas held at a constant temperature the volume is inversely proportional to the pressure. Charles's law, or Gay-Lussac's law, states that if a gas is held at a constant pressure the volume is directly proportional to the absolute temperature. Combining these laws gives the ideal gas law: PV/T=R (per mole), also known as the equation of state of an ideal gas. The constant R on the right-hand side of the equation is a universal constant, the discovery of which is a cornerstone of modern science.

If V is expressed as volume per unit weight, the value of constant R will be different for different gases. If V is expressed as the volume of one molecular weight of gas, then the universal gas constant $R_u$ is the same for all gases in any chosen system of units. Hence $R=R_u/M$, where M is the molecular weight of the gas.

In general, for any amount of gas, the ideal gas equation becomes pV=NMRT, where V is now the total gas volume, N is the number of moles of gas in the volume V, M is the molecular weight, and $R_u$=MR the universal gas constant.

For all ideal gases, $R_u$=MR in lb-ft is 1,546. One pound mol of any perfect gas occupies a volume of 359 cu ft at 32 F and 1 atm.

The ideal gas equation of state is only approximately correct. Real gases do not behave exactly as predicted. In some cases the deviation can be extremely large. Thus, modifications of the ideal gas law, PV=RT, were proposed. Particularly useful and well known is the van der Waals equation of state: $(P+a/V^2)(V-b)=RT$, where a and b are adjustable parameters determined from experimental measurements carried out on actual gases. They are material parameters rather than universal constants, in the sense that their values vary from gas to gas.

In thermodynamics the term "specific heat" refers to the ratio of the amount of heat transferred to raise unit mass of a material 1 deg to that required to raise unit mass of water 1 deg at some specified temperature. Gases have a different specific heat at constant pressure ($c_p$) from the specific heat at constant volume ($c_v$).

The ratio of these two specific heats define the constant $k=c_p/c_v$.

For monatomic gases, the specific heats do not vary with temperature, and k, the value of $c_p/c_v$, is 1.66. For diatomic gases (oxygen, nitrogen, etc.) the specific heats vary with temperature but for many purposes may be assumed constant over considerable ranges of temperature. For diatomic gases, k is approximately 1.40.

Air-Standard Analysis

The accurate analysis of combustion-engine processes is a complex problem. Consequenty, simplifying assumptions have been introduced, resulting in the air-standard cycle analysis. This analysis implies that the medium is air and that no chemical reaction occurs during the cycle. The specific heat of the air is assumed to be constant. Also, losses by heat transfer from the apparatus to the atmosphere are assumed to be zero in this analysis.

The foregoing assumptions result in an analysis that is far from correct for most actual combustion-engine processes, but is of considerable value for indicating the upper limit of performance if infinitely lean air-fuel mixtures could be used. This analysis is also a simple means for indicating the relative effect of the principal variables, such as compression ratio, thermal efficiency of the cycle, and relative size of the apparatus. A measure of this is the mean effective pressure (mep), which is network per cubic inch of displacement.

In the air-standard analysis the medium at the end of the process is unchanged and is at the same conditions as at the beginning of the process. Thus the combustion-engine process is treated as a heat-engine cycle in this analysis.

In internal-combustion engines, the combustion process is assumed to occur at constant volume, at constant pressure or by a sequence of these two procedures, or in various other ways.

The constant-volume process is characteristic of the spark-ignition or Otto-cycle; the constant-pressure is found only in the slow-speed compression-ignition or Diesel-cycle; with both procedures, the cycle is sometimes called limited-pressure cycle and occurs in high-speed compression-ignition engines.

The nominal compression ratio (usually specified) is the displacement plus clearance volume divided by the clearance volume. The actual compression ratio is appreciably less than the nominal value because of late intake valve or port closing.

The compression pressure may be estimated from the relation $p=r_a^k p_m$, where $p_m$ is the intake-manifold pressure and $r_a$ is the actual compression ratio.

For air the value of k is about 1.40 up to compression ratio 10:1 and about 1.39 at compression ratio 14:1. Therefore, in the analysis below, these values have been used for the mean adiabatic exponent during the compression process in the Otto- and Diesel-cycles respectively. However, since the supercharged air is at a higher temperature in the present invention the value of 1.38 has been used for the mean adiabatic exponent during the compression process. For the expansion process the mean adiabatic exponent is typically about 1.22, varying from 1.20 at the beginning to 1.25 at the end of the process for the prior art Otto- and Diesel-cycles. For the analysis of the present invention these same typical values are assumed for the mean adiabatic exponent during the expansion process.

Spark-ignition EnginesSpark-ignition engines have compression ratios between 4:1 and 12:1 (limited by combustion knock of the fuel-air mixture), compression pressures from below 7 atm to above 30 atm, and they operate on the Otto-cycle. The combustion pressures are usually 3.5 to 5 times the compression pressures.

Advantages are low first cost, low specific weight, low cranking effort required, wide variation obtainable in speed and load, high mechanical efficiency, and fairly low specific fuel consumption at high compression ratios and wide-open throttle.

Figure 14D:
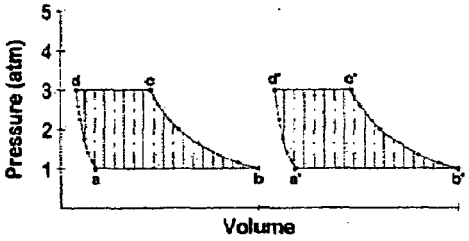
FIG. 14D shows the four-stroke super-charged Mixed-cycle (constant-volume and constant-pressure combustion) in pressure-volume plane of the apparatus of the present invention.
Figure 14B:
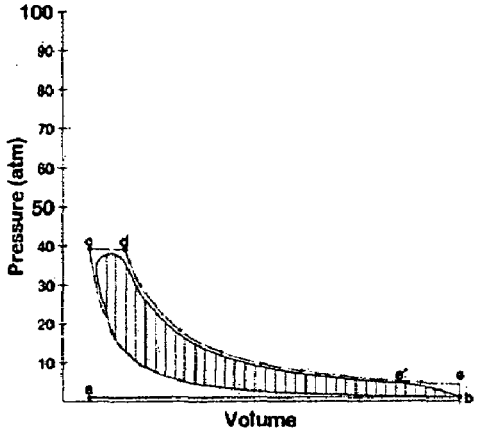
FIG. 14B shows a typical Diesel-cycle in pressure-volume plane.
Figure 14C:
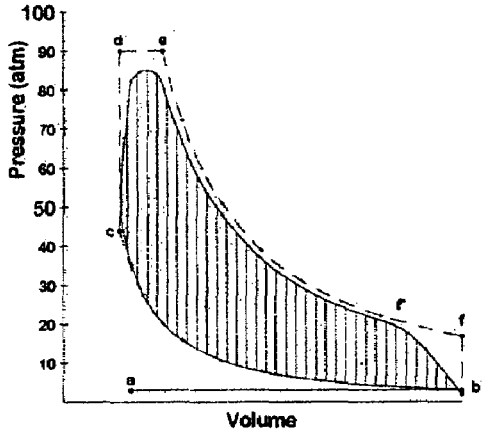
FIG. 14C shows the two-stroke super-charged Air-cycle in pressure-volume plane of the first embodiment of the apparatus of the present invention.
Figure 14A:
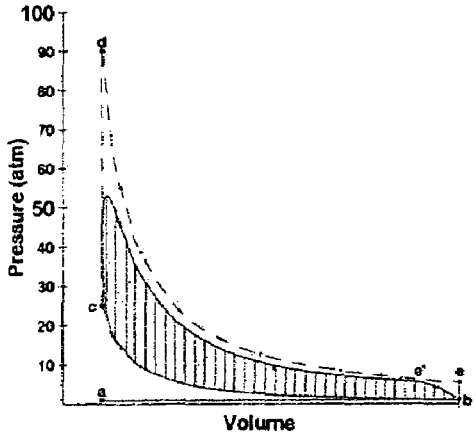
FIG. 14A shows a typical Otto-cycle in pressure-volume plane.

FIG. 14A shows the pressure-volume diagram of an ideal Otto-cycle engine with the fragmentary line. Air is admitted during the induction stroke from a to b. Air is compressed adiabatically and reversibly from b to c. Heat is added to the air during the constant-volume heating process from c to d. Adiabatic reversible expansion occurs from d to e and the exhaust valve opens at point e'. Waste gases are exhausted during the exhaust stroke from b to a.

The solid line shows the characteristics of the actual cycle. The hatched area inside the solid line represents the work done during the cycle. As shown in FIG. 14A the physical characters of this engine are: displacement 650 cu cm (40 cu in), stroke 80 mm (3.15 in), piston diameter 102 mm (4 in) and compression ratio 10:1.

The mean effective pressure (mep) within the hatched area is 10.5 atm (154 psi).

The horsepower equation of a four-stroke cycle engine is:

$hp=mep_{psi}\ displ_{cu\ in}\ rpm/792{,}000=154\times40\times2{,}000/792{,}000=16$ hp or 0.39 hp/cu in at 2,000 rpm (35 hp or 0.88 hp/cu in at 4500 rpm).

The typical range for United States automobile engines is from 0.7 to 1.0 hp/cu in at 4,500 rpm.

The torque equation of a four-stroke cycle engine is:

Torque in lb ft$=mep_{psi}\ displ_{cu\ in}/(4\pi\times12)=154\times40/48\pi=41$ lb ft.

Compression-Ignition Engines

Compression-ignition engines have compression ratios between 11.5:1 and 22:1 and compression pressures from 27 atm to 48 atm, and they operate on the Diesel-cycle. The combustion pressure is about the same as the compression pressure for constant-pressure combustion and usually 2 times the compression pressure for mixed cycle engines (constant-volume and constant-pressure combustion).

Advantages are low specific fuel consumption, ability to maintain economy and thermal efficiency at part loads, low fuel cost, no pre-ignition, practically no carbon monoxide emissions except near full-load or at over-load conditions, and suitability for two-stroke operation.

FIG. 14B shows the pressure-volume diagram of an ideal constant-pressure Diesel-cycle engine with the fragmented line. Air is admitted during the induction stroke from a to b. Air is compressed adiabatically and reversibly from b to c. Heat is added to the air during the constant-pressure heating process from c to d. Adiabatic reversible expansion occurs from d to e and the exhaust valve opens at point e'. Waste gases are exhausted during the exhaust stroke from b to a.

The solid line shows the characteristics of the actual cycle. The hatched area inside the solid line represents the work done during the cycle. As shown in FIG. 14B the physical characters of this engine are: displacement 650 cu cm (40 cu in), stroke 80 mm (3.15 in), piston diameter 102 mm (4 in) and compression ratio 14:1.

The mean effective pressure (mep) within the hatched area is 7.6 atm (112 psi).

$$hp=mep_{psi}\ displ_{cu\ in}\ rpm/792{,}000=112\times40\times2{,}000/792{,}000=11.3 \text{ hp or } 0.28 \text{ hp/cu in at } 2{,}000 \text{ rpm.}$$

The typical range for United States automobile Diesel engines is from 0.2 to 0.35 hp/cu in at 2,000 rpm.

The torque equation of a four-stroke cycle engine is:

$$\text{Torque in lb ft}=\text{mep}_{psi}\ \text{displ}_{cu\ in}/(4\pi\times12)=112\times40/48\pi=30\ \text{lb ft.}$$

Present Invention Engines

Present invention engines have compression ratios typically between 6:1 and 18:1 and compression pressures typically from 40 atm to 50 atm, and they operate on the Mixed-cycle, which means constant-volume and constant-pressure combustion. The combustion pressure is usually 2 times the compression pressure.

Advantages are low specific weight, high mechanical efficiency, low specific fuel consumption, ability to maintain economy and thermal efficiency at part loads, wide variation obtainable in speed and load, practically no carbon monoxide, hydrocarbon or nitrogen oxide emissions, and suitability for one- and two-stroke operation.

FIG. 14C shows the pressure-volume diagram of an ideal constant-volume and constant-pressure 4-cycle engine of the present invention with the fragmented line. Air is admitted during the induction stroke from a to b. Air is compressed adiabatically and reversibly from b to c. Heat is added to the air during the constant-pressure heating process from c to d. Additional heat is added to the combustion chamber during the constant-pressure heating process from d to e. Adiabatic reversible expansion occurs from e to f and the exhaust valve opens at point f. Waste gases are exhausted during the exhaust stroke from b to a.

The solid line shows the characteristics of the actual cycle. The hatched area inside the solid line represents the work done during the cycle.

As shown in FIG. 14C the physical characters of this engine are: displacement 649/514 cu cm (average 35.5 cu in), stroke 80 mm (3.15 in), piston diameter 130/165 mm (5.12/6.50 in) and 138/165 mm (5.43/6.50 in), compression ratio 7:1, and supercharged air pressure 3 atm.

The mean effective pressure (mep) within the hatched area is 28.2 atm (415 psi).

$\text{hp}=\text{mep}_{psi}\ \text{displ}_{cu\ in}\ \text{rpm}/792{,}000=415\times35.5\times2{,}000\times2/792{,}000=74$ hp or 2.1 hp/cu in at 2,000 rpm.

The typical range for 4-cycle engines would be from 1.5 to 3.0 hp/cu in at 2,000 rpm.

The typical range for 4-cycle engines would be from 1.5 to 3.0 hp/cu in at 2,000 rpm.

The torque equation of a two-stroke cycle engine is:

$$\text{Torque in lb ft}=\text{mep}_{psi}\ \text{displ}_{cu\ in}/(2\pi\times12)=415\times35.5/24\pi=195\ \text{lb ft.}$$

FIG. 14D shows the pressure-volume diagram of an ideal 2-stroke air-cycle of the cylindrical air piston of the present invention used in connection with the 4-cycle engine as shown in FIG. 14C. The physical characters of this air piston are: displacement 1230 cu cm (average 75 cu in), stroke 80 mm (3.15 in), piston diameter 140 mm (5.5 in) and compression ratio 7:1. Air is admitted during the induction stroke from a to b. Air is compressed adiabatically and reversibly from b to c and then released to the compressed air accumulator at constant pressure from c to d. Adiabatic reversible expansion occurs from d to a during the return stroke.

Another pressure-volume diagram is shown with letters a', b', c' and d' since the 2-cycle air piston needs only two strokes to complete a full cycle while the 4-cycle engine needs four strokes to complete a full cycle.

The mean pressure within the hatched area is 1.1 atm (16 psi).

The consumed horsepower equation of this two-stroke air cycle is:

$\text{hp}=\text{mep}_{psi}\ \text{displ}_{cu\ in}\ \text{rpm}/792{,}000=16\times75\times2{,}000\times2/792{,}000=6$ hp at 2,000 rpm.

With the above physical dimensions the air piston provides about 75% of the supercharged air volume for the four-cycle engine shown in FIG. 14C. The balance is produced by the exhaust gas driven air compressor.

Figure 14E:
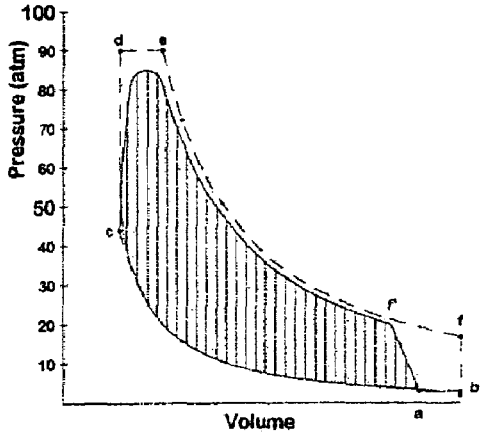
FIG. 14E shows the single-stroke super-charged Mixed-cycle (constant-volume and constant-pressure combustion) in pressure-volume plane of the apparatus of the present invention.

FIG. 14E shows the pressure-volume diagram of an ideal constant-volume and constant-pressure one stroke 2-cycle engine of the present invention with the fragmented line. General description of the operation of such embodiment of the present invention will be given later in connection with FIGS. 20A through 20G.

Air is admitted during the induction stroke from a to b. Air is compressed adiabatically and reversibly from b to c. Heat is added to the air during the constant-pressure heating process from c to d. Additional heat is added to the combustion chamber during the constant-pressure heating process from d to e. Adiabatic reversible expansion occurs from e to f and the exhaust valve opens at point f. Waste gases are scavenged by the incoming supercharged air, and exhausted during the induction stroke from a to b.

The solid line shows the characteristics of the actual cycle. The hatched area inside the solid line represents the work done during the stroke. As shown in FIG. 14E the physical characters of this engine are:

displacement 352/217 cu cm (average 17.5 cu in), stroke 80 mm (3.15 in), piston diameter 130/150 mm (5.12/5.91 in) and 138/150 mm (5.43/5.91 in), compression ratio 7:1, and supercharged air pressure 3 atm.

The mean effective pressure (mep) within the hatched area is 27.1 atm (400 psi).

$\text{hp}=\text{mep}_{psi}\ \text{displ}_{cu\ in}\ \text{rpm}/792{,}000=400\times17.5\times2{,}000\times4/792{,}000=71$ hp or 4.0 hp/cu in at 2,000 rpm.

The typical range for 1-stroke engines would be from 3 to 6 hp/cu in at 2,000 rpm.

The torque equation of a one-stroke cycle engine is:

$$\text{Torque in lb ft}=\text{mep}_{psi}\ \text{displ}_{cu\ in}/(\pi\times2)=400\times17.5/12\pi=185\ \text{lb ft.}$$

Emission Analysis

The key feature for the practically no carbon monoxide, hydrocarbon or nitrogen oxide emissions from the engine of present invention is the use of dual fixed volume combustion chambers for each cylinder. In the preferred embodiment of the present invention the pre-combustion chamber 294 receives a rich fuel-air mixture while the supercharged combustion air chamber 200 is charged with a very lean mixture or none at all. The rich mixture ignites the lean main mixture. The resulting peak temperature is low enough to inhibit the formation of nitrogen oxides, and the mean temperature is sufficiently high to limit emissions of carbon monoxide and hydrocarbon. The fuel-air ratio varies from rich at the pre-combustion chamber 294 to lean at the annular shape combustion chamber 242.

It is the peak temperatures, which occur at the tip of the flame front, that produce most of the nitrogen oxide emissions; the lower the peak temperatures the lower the nitrogen oxide emissions.

When piston is racing away from the flame front it produces a cooling effect that results in lower peak temperatures and lower nitrogen oxide emissions.

It is a well known fact that combustion efficiencies can be improved by running lean, significantly above 14.5 to 1 air/fuel ratio.

The annular shape combustion chamber 242 in combination with the tangential entry of the flame front (as shown later in FIG. 21D) from both the pre-combustion chamber 294 and the supercharged combustion air supply chamber 200 produce a massive turbulence that results in an extremely fast burn rate (combustion duration). Burn rate is the amount of time it takes for the trapped fuel/air mixture to completely combust.

Burn rate is a powerful multiplier of engine efficiency.

Description of the Second Embodiment

Figure 15:
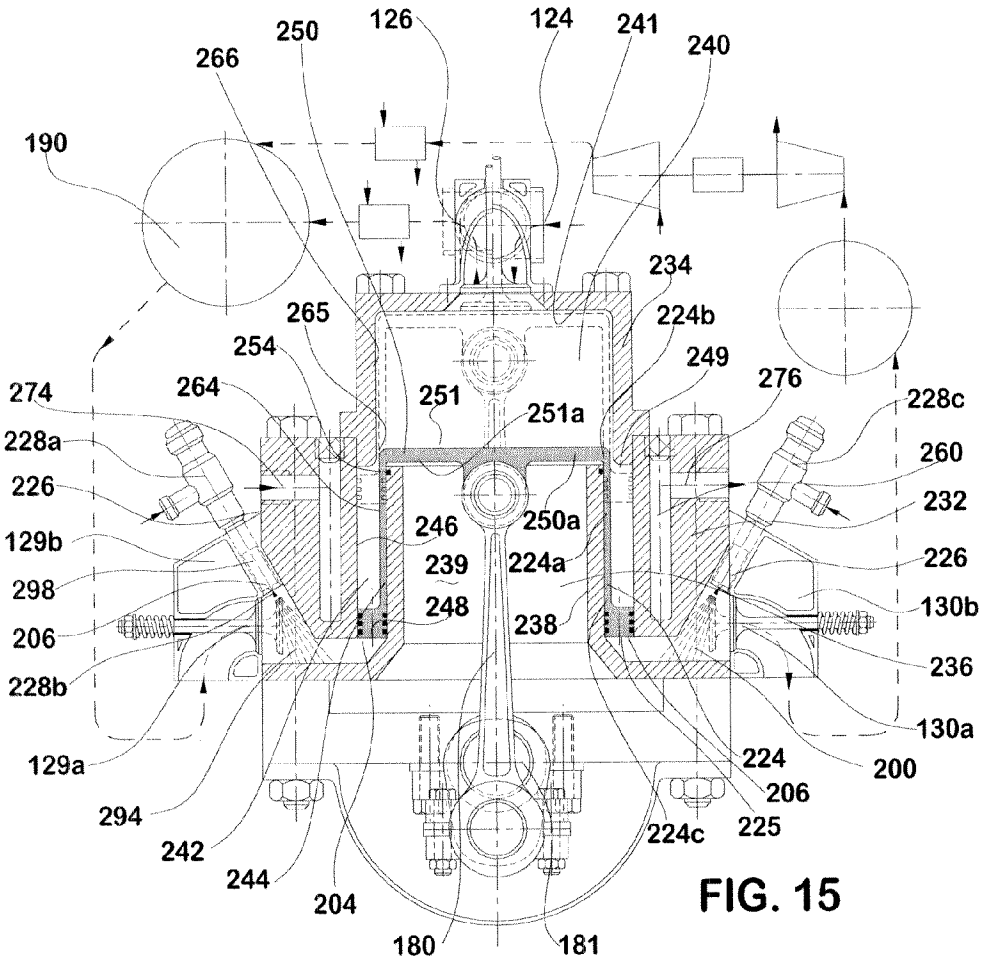
FIG. 15 is a cross section view showing the second embodiment of the apparatus of the present invention.

Reference is made to FIG. 15 which shows the cross section of the second embodiment of the apparatus of the present invention. It shows the cross section view of one cylinder comprising the following main components, which differ from the main components of the first embodiment:

engine block 32, head block 34, piston assembly 24, supercharged air intake valve 129*a*, exhaust valve 130*a*, supercharged air intake valve block 129*b*, exhaust valve block 130*b*, fuel injector 28*a*, and spark plug 28*b*.

Since only the engine block 32, the head block 34 and the piston assembly 24 are of unique design, only these three components of the second embodiment of the present invention will be described in detail. All the other components of the present invention as listed above are typically more or less of same design as in the prior art internal-combustion engines and will therefore be referred to by name and reference number only without further description.

Engine Block

With reference to FIG. 15, which shows the cross section view of one cylinder, the engine block 232 has a cylinder shape bore 236, which forms the inner wall face 238 of the engine block 232. This inner wall face defines a cylindrical passageway 239 through the engine block 232. The piston connecting rod 180 travels in this passage way 239 back and forth with each stroke of the piston 224 transferring the reciprocating motion of the piston into rotary motion of the crankshaft 181.

Radially outwards from the cylinder shape bore 236 there is an annular shape combustion chamber 242, which has a circular inner wall surface 244, circular outer wall surface 246, closed annular shaped bottom surface 248, and an annular shape open end 249 opposite of the bottom surface 248. In the upper part of the circular inner wall surface 244 of the annular shape combustion chamber 242 there is a circular groove 254 for an oil scraper ring.

There is also an annular shape cooling chamber 260 in the engine block 232 radially outwards from the annular shape combustion chamber 242. Each cylinder in the engine is surrounded with its own cooling chamber. Each cooling chamber has an inlet 274 and outlet 276 nozzle for forced water or oil circulation. The cooling liquid is typically water or oil, but air or other gases could as well be used for the cooling purpose.

With reference still to FIG. 15, at the bottom of the annular shape combustion chamber 242 there are two fixed volume combustion chambers 294 and 200. The "fixed volume" description is used to differentiate these combustion chambers from the main annular shape combustion chamber 242, which volume varies with the in-and-out stroke of the annular shape bottom end 225 of the piston assembly 224.

The left side pre-combustion chamber 294 has a fuel injector nozzle 298 for fuel injection in the Diesel-cycle engine version and an additional spark plug nozzle 206 in the Otto-cycle engine version. When the right side fixed volume combustion chamber 200 does not have a nozzle in it for fuel injection it functions as a supercharged combustion air supply chamber. However, it can also be equipped with a fuel injector 228*c* in which case it will function as a lean fuel-air mixture combustion chamber 200. The rich mixture in the pre-combustion chamber 294 ignites the lean mixture in the other fixed volume combustion chamber.

Both the pre-combustion chamber 294 and the supercharged combustion air supply chamber 200 communicate with the main annular shape combustion chamber 242 through openings 296 in the top of the fixed volume chambers at their end just below the annular shape combustion chamber 242.

In this second embodiment of the present invention the pre-combustion chamber 294 and the supercharged combustion air supply chamber 200 are at opposite sides of the engine block. However, more than two of the fixed volume combustion chambers can be used in large diameter engines of the present invention.

The fuel injector nozzle 298 and the spark plug nozzle 206 are shown side-by-side penetrating the engine block 232 sidewall 226 into the pre-combustion chamber. At right a fuel injector 228*c* is shown penetrating the engine block into the lean fuel/air mixture combustion chamber 200.

Head Block

The open end 249 of the annular shape variable combustion chamber 242 is covered with the engine head block 234 comprising a cylinder shape air chamber 240 that is closed at the top end 241 and in which a loose fitting cylinder shape piston 250 slides as described in connection with the first embodiment.

The in-and-out motion of the cylinder shape piston 250 varies the volume of the cylindrical air chamber 240 in the engine head block between the circular top end 251 of the cylinder-shaped piston 250 and the closed top end 241 of the cylindrical air chamber 240.

The ambient air intake port 124 and the supercharged air discharge port 126 are in the middle of the head block just above the cylindrical air chamber 240 in the head block 234 as already described with the first embodiment.

Ambient air enters the cylindrical air chamber 240 during the piston out-motion and compressed air from the cylindrical air chamber 240 flows to a supercharged air accumulator 190 during the piston in-motion.

The annular shape bottom end 225 of the piston assembly 224 and the cylinder shape piston 250 are manufactured as one piece to form a single combined piston assembly 224. The piston assembly 224 has a tube-like middle section 224*a*. One end 224*b* of the middle tube-like section 224*a* is closed forming the head 250*a* of the cylinder shaped air piston 250. At the other end 224*c* of the tube-like middle section 224*a* a flange-like section protrudes outwards from the outer surface of the tubular middle section 224*a* forming the annular shape piston head 225.

There is a clearance, typically one to two millimeters, between the outside surface 264 of the moving cylindrical piston 250 and the inside surface 266 of the stationary cylindrical air chamber 240 in the engine head block 234. This annular shape clearance space allows ambient air from the cylindrical air chamber 240 to enter the annular shape combustion chamber 242 during the air piston 250 out-motion and to let the compressed air in the annular shape combustion chamber 242 flow back to the cylindrical air chamber 240 during the air piston in-motion. This in-and-out airflow performs an efficient air-cooling function by transferring combustion heat from the walls of the annual shaped combustion chamber 242 to the air. Also it increases the thermal efficiency of the engine by transferring some of the combustion heat back to the combustion chamber with the supercharged air.

The inside face 251*a* of the head 250*a* of the cylinder-shaped part of the piston assembly is attached to a crankshaft 181 by a connecting rod 180 in a conventional way. The crankshaft transforms the reciprocating motion of the piston assembly into rotary motion.

At the closed end of the annular variable combustion chamber opposite from the engine head block end there are two or more fixed volume combustion chambers 242 and 200 in the engine block 232. The function of these fixed volume combustion chambers was already described above in connection with the description of the first embodiment and will therefore not be repeated here.

The supercharged air intake valve(s) 129*a*, the exhaust valve(s) 130*a*, the fuel injector(s) 228*a* and 228*c*, and/or spark plug(s) 206 are located at the side of the engine block 232 at the closed end of the annular combustion chamber 242 rather than on the top as was described earlier in connection with the first embodiment of the present invention.

The remainder of the earlier description of the first embodiment applies to this second embodiment as well.

Again, a four-stroke-cycle is the preferred form of this second embodiment of the present invention. The annular shape piston 225 in the combustion chamber 242 makes four strokes in a complete power cycle, two toward the head (closed head) of the combustion chamber 242 and two away from the head. However, the cylindrical piston in the cylindrical air chamber 240 in the engine head block 234 makes only two strokes in a complete supercharged air cycle sending a charge of supercharged air into the air accumulator twice during each power cycle.

The earlier description of the induction, compression, expansion and exhaust cycles of the first embodiment of the present invention apply also to this second embodiment of the present invention.

Figure 16B:
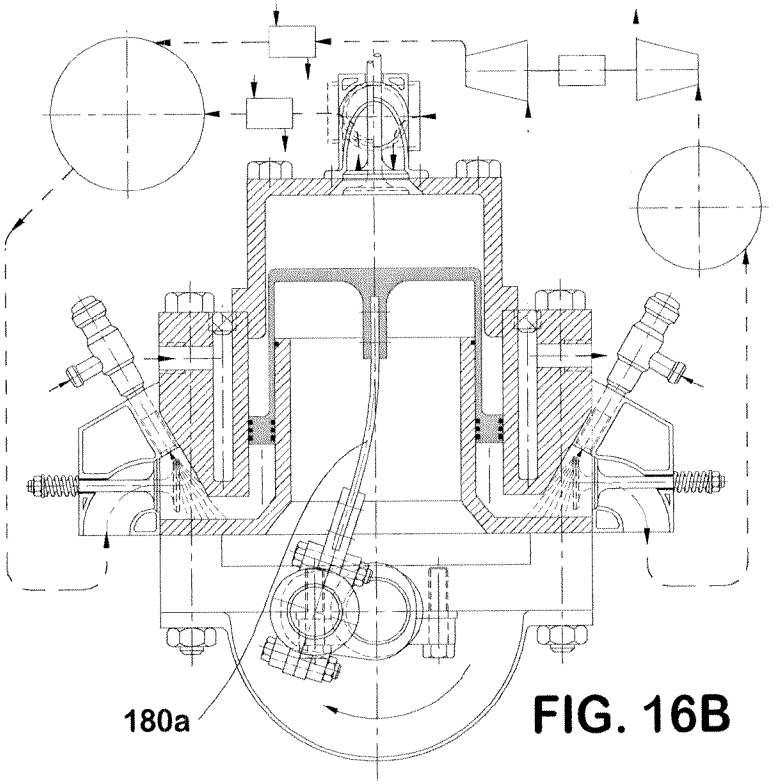
FIG. 16B is a cross section view showing a flexible piston rod in the mid-expansion piston position with the second embodiment of the apparatus of the present invention.
Figure 16A:
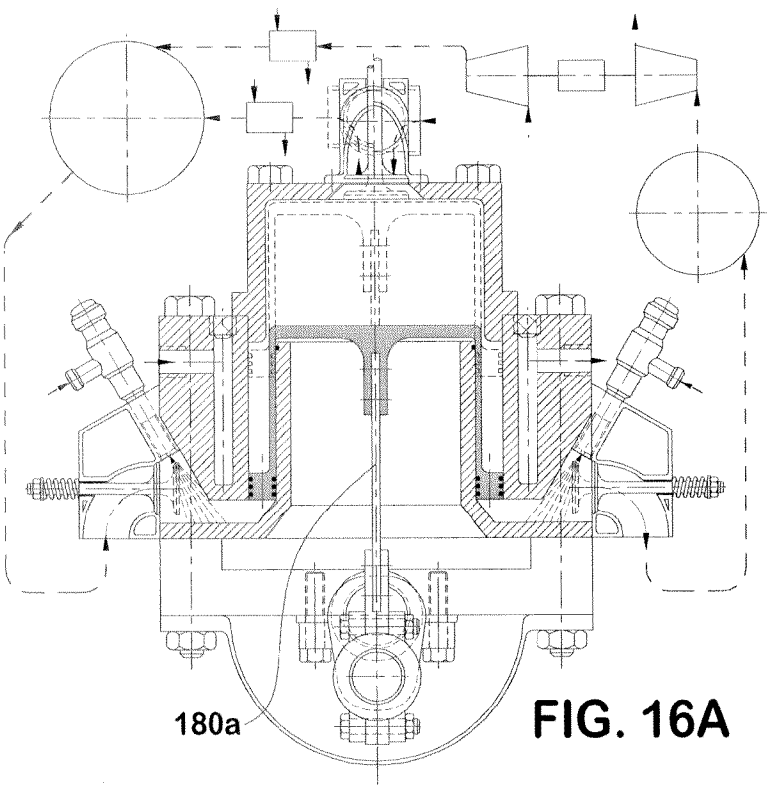
FIG. 16A is a cross section view showing a flexible piston rod at the bottom center piston position with the second embodiment of the apparatus of the present invention.

However, two major advantages are associated with this second embodiment over the first embodiment of the present invention:

a) The ambient air flow into the annular combustion chamber 242 from the cylindrical air chamber 240 during the compression and exhaust cycles of the engine performs an efficient air-cooling function increasing the thermal efficiency of the engine and allowing higher fuel charge per cubic inch of engine volume.

b) A flexible piston rod can be used to make the reciprocating masses lighter weight. Reference is made to FIG. 16A which is a cross section view showing a flexible piston rod 180*a* at the bottom center piston position and to FIG. 16B which is a cross section view showing a flexible piston rod 180*a* in the mid-expansion piston position.

By studying the two figures one can observe that the piston connecting rod 180*a* is always under tension during the expansion, exhaust and compression cycles allowing lighter rod construction and even the use of a flexible connecting rod. During the induction cycle the charge of supercharged air into the annular combustion chamber 240 balances some of the compression load on the connecting rod caused by the supercharge air pressure build-up in the cylindrical air chamber 240.

Description of the Third Embodiment

Figure 17:
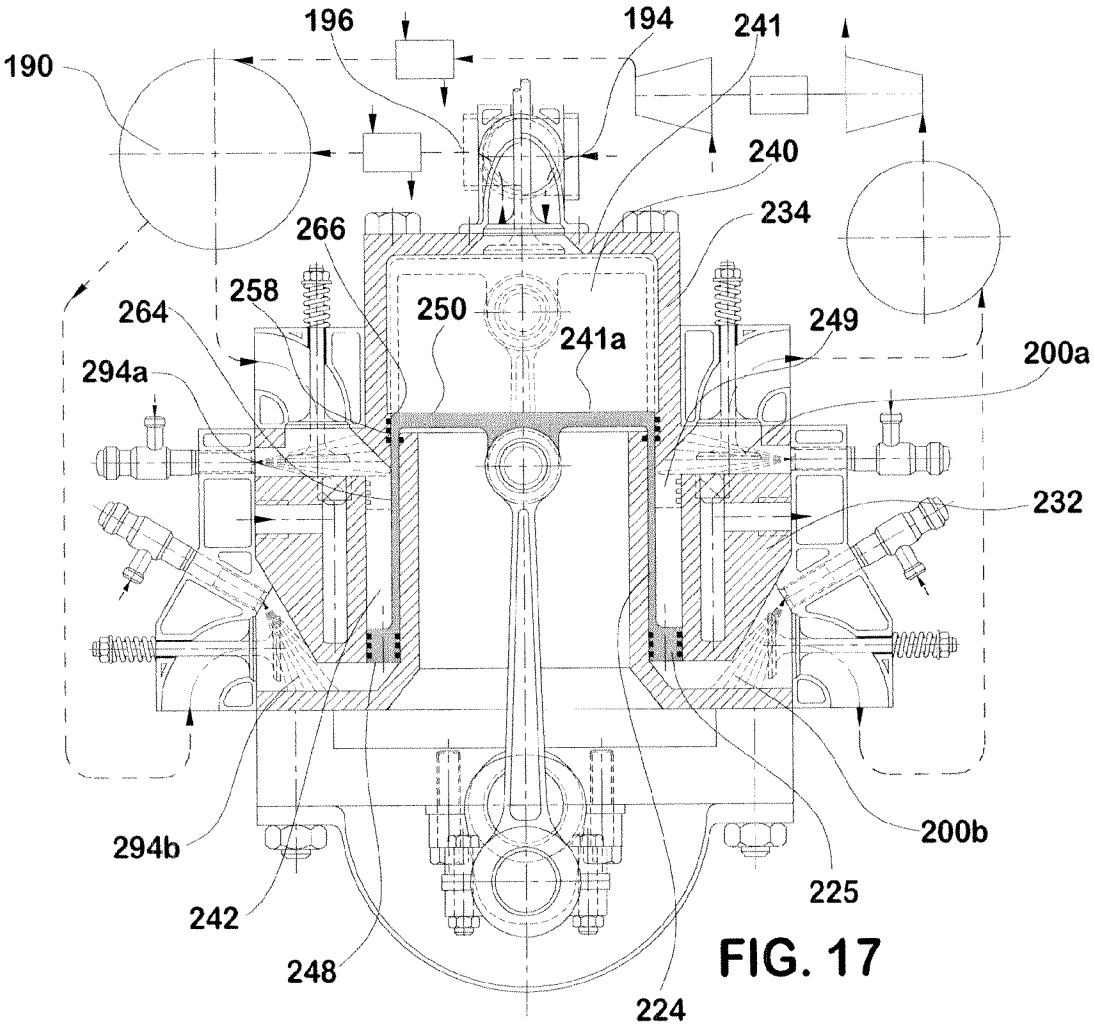
FIG. 17 is a cross section view showing the third embodiment of the apparatus of the present invention.

Reference is made to FIG. 17, which is a cross section view showing the third embodiment of the apparatus of the present invention.

The internal combustion engine of the third embodiment of the present invention is similar to the second embodiment comprising an annular shape variable combustion chamber 242 in the engine block 232 in which a close fitting annular shape piston 225 slides. The open end 249 of the annular shape variable combustion chamber 242 is also covered with the engine head block 234 comprising a cylinder shape air chamber 240 that is closed at one end 241 and in which a loose fitting cylinder-shaped piston 250 slides.

However, at the open end 241*a* of the cylinder shape air chamber 240 in the engine head block 234 the inner face 266 of the air chamber fits airtight against the outer face 264 of the cylinder shaped piston 250. This is accomplished with a set of 2 or more typical conventional piston rings 258.

In the engine head block 234 facing the top 249 of the engine block 232 there is another set of two or more fixed volume combustion chambers similar to the fixed volume combustion chambers in the engine block 232 at the other closed end 248 of the annular shape variable combustion chamber 242. The fixed volume combustion chambers in the engine head block will be later referred to as top with letter a, and the ones in the engine block as bottom fixed volume combustion chambers with letter b. Same top and bottom designation will be used in connection with respective valves, fuel injectors, spark plugs and ports. The function of these additional fixed volume combustion chambers is exactly the same as was already described above in connection with the description of the first and second embodiment and will therefore not be repeated here.

In this manner the fixed volume combustion chambers 294 and 200 are at both ends of the variable combustion chamber 242 thus making the close fitting annular shape piston 225 a double-acting piston.

At the top of the cylindrical air chamber 240 in the engine head block 234, there are two or more valves, at least one for ambient air intake 194 and at least one for supercharged air discharge 196 to the supercharged air accumulator 190 as described earlier.

The function of the in-and-out motion of the cylinder-shaped piston 250 inside the cylindrical air chamber 240 has been described earlier.

The annular shape piston 225 and the cylinder-shaped piston 250 are manufactured as one piece to form a single combined piston assembly 224 as was described earlier in the description of the second embodiment.

Rest of the earlier component description of the first and second embodiment applies to this third embodiment as well.

Again, a four-cycle operation is the preferred form of this third embodiment of the present invention. However, while the annular shape piston 225 in the combustion chamber 242 makes four strokes to complete the four-cycle operation, it makes two expansion strokes due to the double-acting annular shape piston 225. The third embodiment of the present invention becomes therefore a two-stroke four-cycle engine firing a power stroke once during every revolution of the crankshaft.

The earlier description of the induction, compression, expansion and exhaust cycles of the first and second embodiments of the present invention apply also to this third embodiment of the present invention.

However, three additional major advantages are associated with this third embodiment over the first and second embodiment of the present invention:

a) A two-stroke four-cycle engine firing a power stroke once during every revolution of the crankshaft produces twice the amount of power of a similar size four-stroke four-cycle engine.

b) This third embodiment of the present invention suits well for two-cycle operation making the engine a one-stroke two-cycle engine firing a power stroke twice during every revolution of the crankshaft (once every 180 degrees of the crankshaft revolution).

c) Operating two one-stroke two-cycle cylinders opposing each other makes the engine fire a power stroke four times during one revolution of the crankshaft: either twice every 180 degrees of the crankshaft revolution, if the two connecting rods are attached to the same crank pin or to two opposing crank pins, or once every 90 degrees of the crankshaft revolution, if the two connecting rods are attached to two crank pins that are 90 degrees apart.

A two cylinder engine will run as smoothly as a conventional eight cylinder engine.

Two-Stroke Four-Cycle Engine

Figure 18:
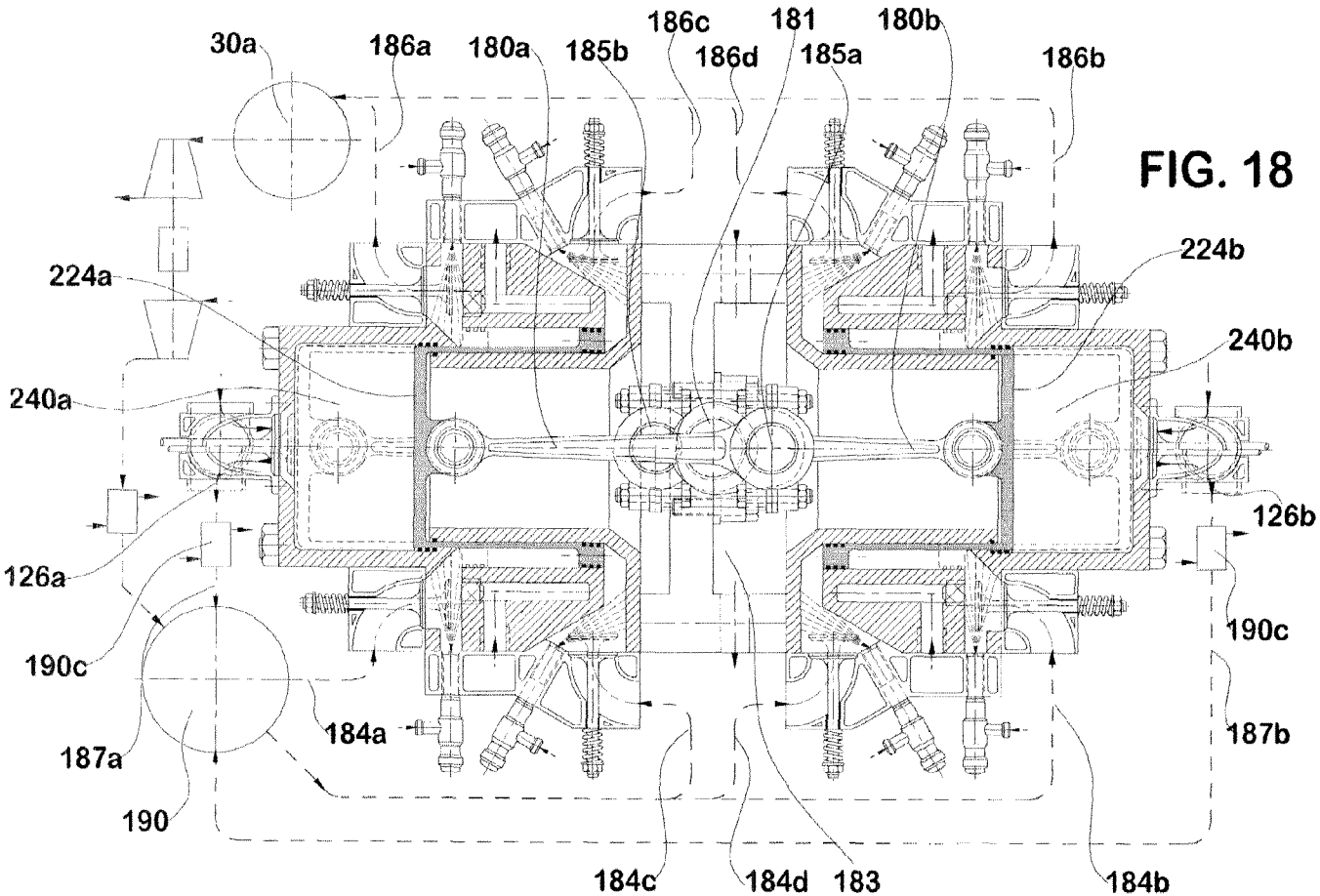
FIG. 18 is a cross section view showing two opposing cylinders of the third embodiment of the apparatus of the present invention.

Reference is made to FIG. 18 which shows the cross section of two opposing cylinders of the third embodiment of the present invention.

Looking at FIG. 18 in a landscape view one can observe that the left side piston assembly 224*a* and the right side piston assembly 224*b* are connected with their respective piston connecting rods 180 *a* and 180*b* to crank pins 185*a* and 185*b* that are 180 degrees apart from each other in the crank shaft assembly 181. Both pistons move at the same time either toward the crank case 183 or away from it. FIG. 18 shows the pistons in the most inward position toward the crank case.

The left engine 20*a* supercharged air top intake port communicates with the supercharged air accumulator 190 through passage way 184*a*, and the right engine 20*b* supercharged air top intake port communicates with the supercharged air accumulator 190 through passage way 184*b*. Similarly the bottom intake ports of supercharged air are communicating with the supercharged air accumulator 190 through passage ways 184*c* and 184*d*.

The left engine 20*a* top exhaust port communicates with the waste gas accumulator 30*a* through passage way 186*a*, and the right engine 20*b* top exhaust port communicates with the waste gas accumulator 30*a* through passage way 186*b*. Similarly the bottom exhaust ports are communicating with the waste gas accumulator 30*a* through passage ways 186*c* and 186*d*.

The supercharged air discharge port 126*a* at the top of the left engine cylindrical air chamber 240*a* communicates with the compressed air accumulator 190 through a passage way 187*a* and the supercharged air discharge port 126*b* at the top of the right engine cylindrical air chamber 240*b* communicates with the compressed air accumulator 190 through a passage way 187*b*. In both of these supercharged air discharge passage ways there are heat exchangers 190*c* which cool the supercharged air before it enters the supercharged air accumulator 190.

Figure 19B:
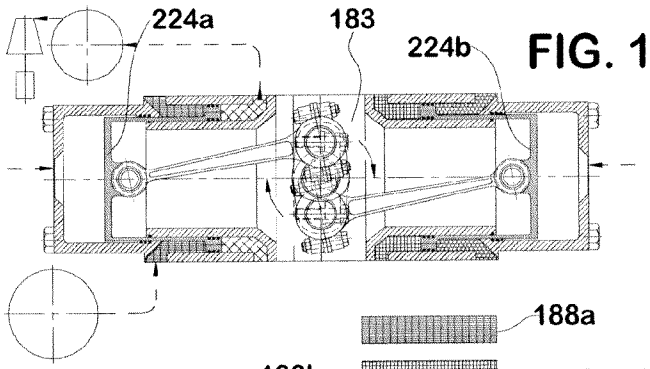
FIG. 19B is a cross section view showing two opposing 4-cycle cylinders of the third embodiment of the apparatus of the present invention, where cylinder 1 is in intake/exhaust stroke while cylinder 2 is in expansion/compression stroke.
Figure 19E:
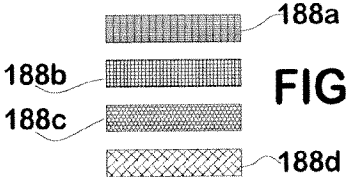
FIG. 19E shows the hatch patterns of the intake, compression, expansion and exhaust used in the figures from 19A through 19D.
Figure 19D:
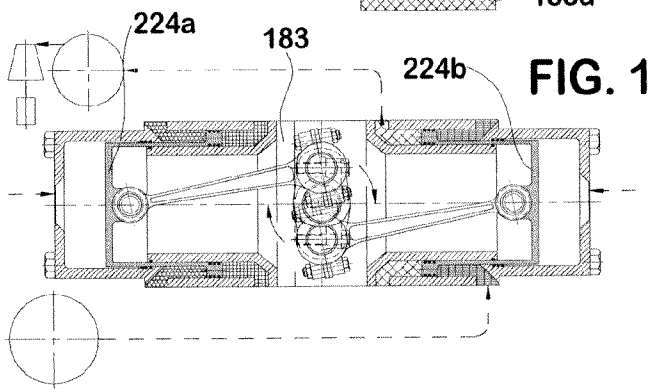
FIG. 19D is a cross section view showing two opposing 4-cycle cylinders of the third embodiment of the apparatus of the present invention, where cylinder 1 is in expansion/compression stroke while cylinder 2 is in intake/exhaust stroke.
Figure 19A:
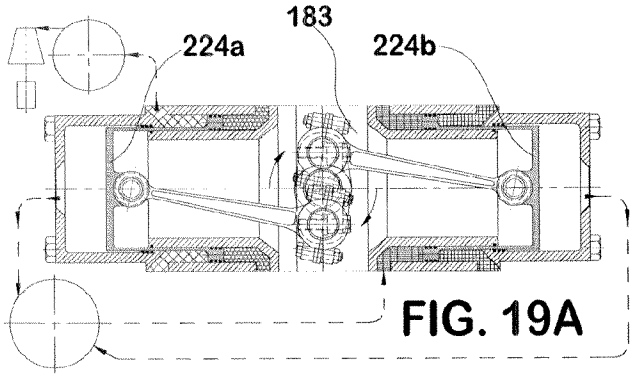
FIG. 19A is a cross section view showing two opposing 4-cycle cylinders of the third embodiment of the apparatus of the present invention, where cylinder 1 is in expansion/exhaust stroke while cylinder 2 is in intake/compression stroke.

FIG. 19A is a cross section view showing two opposing 4-cycle cylinders of the third embodiment of the apparatus of the present invention, where the left engine 20*a* piston assembly 224*a* is in expansion/exhaust stroke moving away from the crank case 183 while the right engine 20*b* piston assembly 224*b* is in intake/compression stroke moving away from the crank case 183.

FIG. 19B is a cross section view showing two opposing 4-cycle cylinders of the third embodiment of the apparatus of the present invention, where the left engine 20*a* piston assembly 224*a* is in intake/exhaust stroke moving toward the crank case 183 while the right engine 20*b* piston assembly 224*b* is in expansion/compression stroke moving toward the crank case 183.

Figure 19C:
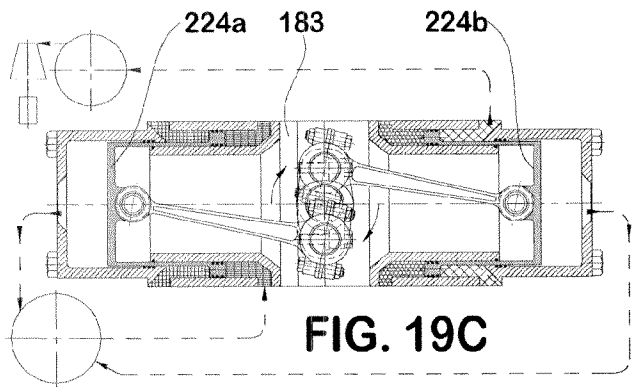
FIG. 19C is a cross section view showing two opposing 4-cycle cylinders of the third embodiment of the apparatus of the present invention, where cylinder 1 is in intake/compression stroke while cylinder 2 is in expansion/exhaust stroke.

FIG. 19C is a cross section view showing two opposing 4-cycle cylinders of the third embodiment of the apparatus of the present invention, where the left engine 20*a* piston assembly 224*a* is in intake/compression stroke moving away from the crank case 183 while the right engine 20*b* piston assembly 224*b* is in expansion/exhaust stroke moving away from the crank case 183.

FIG. 19D is a cross section view showing two opposing 4-cycle cylinders of the third embodiment of the apparatus of the present invention, where the left engine 20*a* piston assembly 224*a* is in expansion/compression stroke moving toward the crank case 183 while the right engine 20*b* piston assembly 224*b* is in intake/exhaust stroke moving toward the crank case 183.

FIG. 19E shows the hatch patterns of the intake 188*a*, compression 188*b*, expansion 188*c* and exhaust 188*d* used in the figures from 19A through 19D.

One-Stroke Two-Cycle Engine

Figures 20A, 20B:
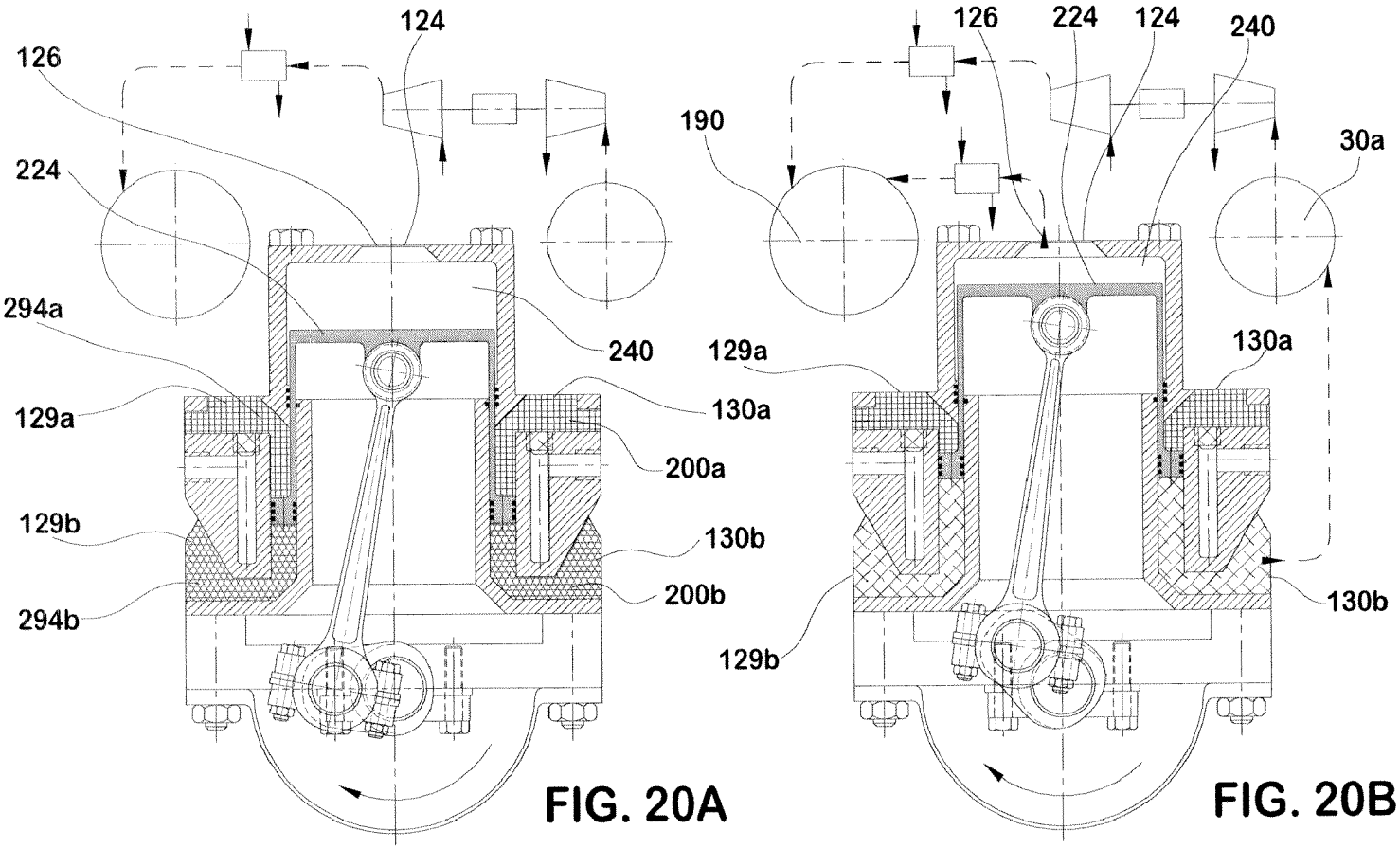
FIG. 20A shows the expansion/compression phase of a one-stroke 2-cycle cylinder during the piston up-stroke of the third embodiment of the apparatus of the present invention.
FIG. 20B shows the exhaust/compression phase of a one-stroke 2-cycle cylinder during the piston up-stroke of the third embodiment of the apparatus of the present invention.

FIG. 20A shows the expansion/compression phase of a one-stroke 2-cycle cylinder in the middle of the piston 224 up-stroke of the third embodiment of the apparatus of the present invention when top 294*a* and bottom 294*b* fixed volume pre-combustion chamber intake valves 129*a* 129*b* and exhaust valves 130*a* and 130*b* in the supercharged combustion air supply chambers 200*a* and 200*b* are closed. The supercharged air discharge port 126 and the ambient air intake port 124 at the top of the cylindrical air chamber 240 are closed.

FIG. 20B shows the exhaust/compression phase of a one-stroke 2-cycle cylinder of the third embodiment of the apparatus of the present invention during piston 224 up-stroke at about 80% of the expansion stroke permitting the escape of exhaust gases through the open bottom exhaust port 130*b* to the waste gas accumulator 30*a* and reducing the pressure in the cylinder. The top intake port 129*a*, the top exhaust port 130*a* and the bottom intake port 129*b* are closed. The supercharged air discharge port 126 at the top of the cylindrical air chamber 240 is open to let the supercharged air flow into the supercharged air accumulator 190. The ambient air intake port 124 at the top of the cylindrical air chamber 240 is closed.

Figure 20D:
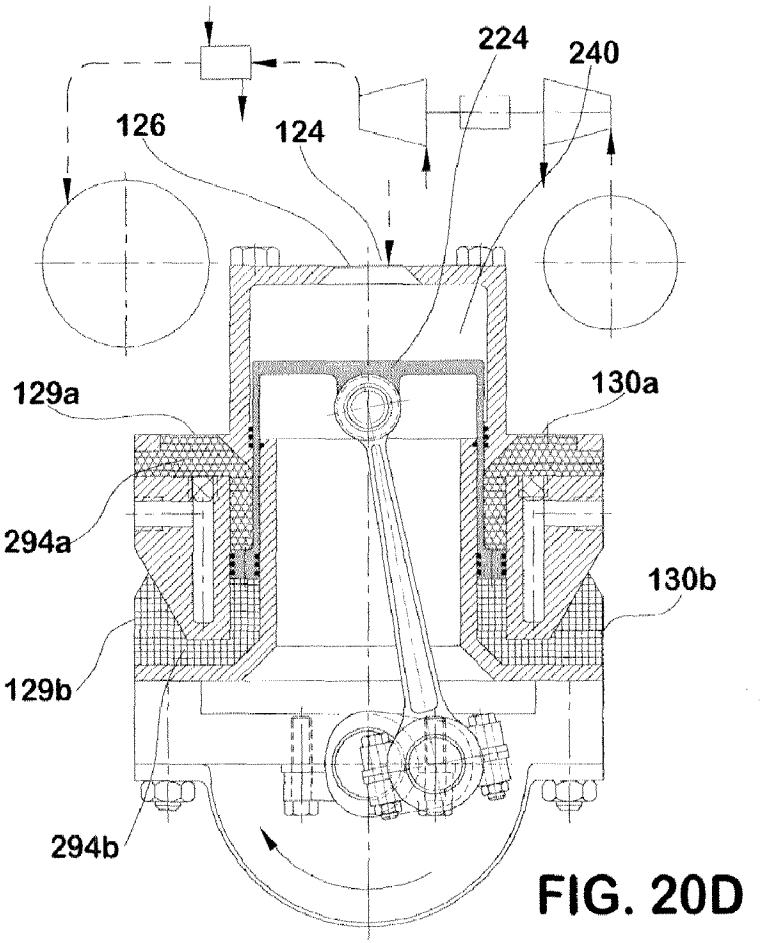
FIG. 20D shows the expansion/compression phase of a one-stroke 2-cycle cylinder during the piston down-stroke of the third embodiment of the apparatus of the present invention.
Figure 20C:
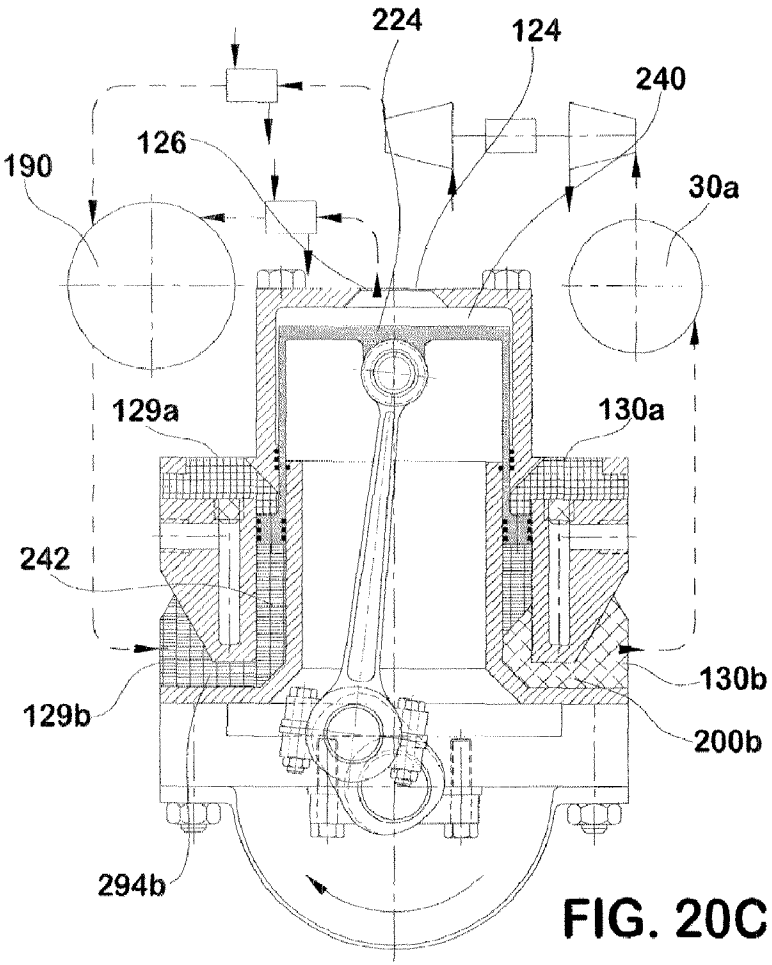
FIG. 20C shows the intake-scavenging/compression phase of a one-stroke 2-cycle cylinder during the piston up-stroke of the third embodiment of the apparatus of the present invention.

FIG. 20C shows the intake-scavenging/compression phase of a one-stroke 2-cycle cylinder of the third embodiment of the apparatus of the present invention during the piston 224 up-stroke at about 88% of the expansion stroke permitting the escape of exhaust gases through the bottom exhaust port 130*b* to the waste gas accumulator 30*a*. The bottom intake port 129*b* is opened to let the incoming supercharged air from the supercharged air accumulator 190 scavenge the remaining waste gases away from the bottom pre-combustion chamber 294*b*, the annular combustion chamber 242, and the bottom supercharged air combustion chamber 200*b* into the waste gas accumulator 30*a*. The supercharged air discharge port 126 at the top of the cylindrical air chamber 240 is open to let the supercharged air flow into the supercharged air accumulator 190. The ambient air intake port 124 at the top of the cylindrical air chamber 240 is closed.

FIG. 20D shows the expansion/compression phase of a one-stroke 2-cycle cylinder in the middle of the piston 224 down-stroke of the third embodiment of the apparatus of the present invention when top 294*a* and bottom 294*b* fixed volume combustion chamber intake valves 129*a* and 129*b*, and exhaust valves 130*a* and 130*b* are closed. The supercharged air discharge port 126 at the top of the cylindrical air chamber 240 is closed but the ambient air intake port 124 is open.

Figures 20E, 20F, 20G:
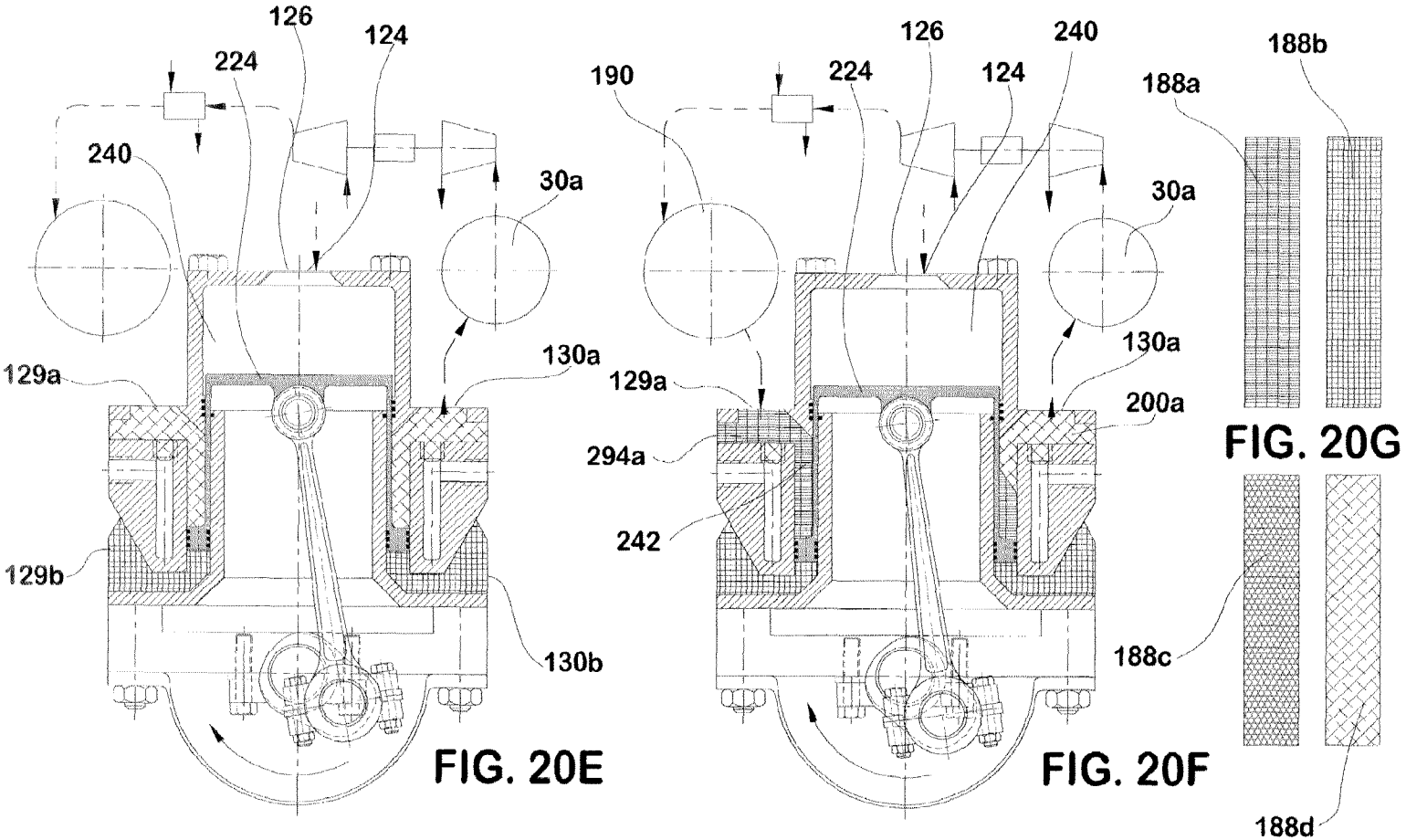
FIG. 20E shows the exhaust/compression phase of a one-stroke 2-cycle cylinder during the piston down-stroke of the third embodiment of the apparatus of the present invention.
FIG. 20F shows the intake-scavenging/compression phase of a one-stroke 2-cycle cylinder during the piston down-stroke of the third embodiment of the apparatus of the present invention.
FIG. 20G shows the hatch patterns of the intake, compression, expansion and exhaust used in the figures from 20A through 20F.

FIG. 20E shows the exhaust/compression phase of a one-stroke 2-cycle cylinder of the third embodiment of the apparatus of the present invention during piston 224 down-stroke at about 80% of the expansion stroke permitting the escape of exhaust gases through the open top exhaust port 130*a* to the waste gas accumulator 30*a* and reducing the pressure in the cylinder. The bottom intake port 129*b*, the bottom exhaust port 130*b*, and the top intake port 129*a* are closed. The supercharged air discharge port 126 at the top of the cylindrical air chamber 240 is closed. The ambient air intake port 124 at the top of the cylindrical air chamber 240 is open to let ambient air into the cylindrical air chamber 240.

FIG. 20F shows the intake-scavenging/compression phase of a one-stroke 2-cycle cylinder of the third embodiment of the apparatus of the present invention during the piston 224 down-stroke at about 88% of the expansion stroke permitting the escape of exhaust gases through the top exhaust port 130*a* to the waste gas accumulator 30*a*. The top intake port 129*a* is opened to let the incoming supercharged air from the supercharged air accumulator 190 scavenge the remaining waste gases away from the top pre-combustion chamber 294*a*, the annular combustion chamber 242, and the top supercharged air combustion chamber 200*a* into the waste gas accumulator 30*a*.

The supercharged air discharge port 126 at the top of the cylindrical air chamber 240 is closed. The ambient air intake port 124 at the top of the cylindrical air chamber 240 is open to let ambient air into the cylindrical air chamber.

FIG. 20G shows the hatch patterns of the intake 188*a*, compression 188*b*, expansion 188*c* and exhaust 188*d* used in the figures from 20A through 20F.

Description of the Fourth and Preferred Embodiment

Figure 21A:
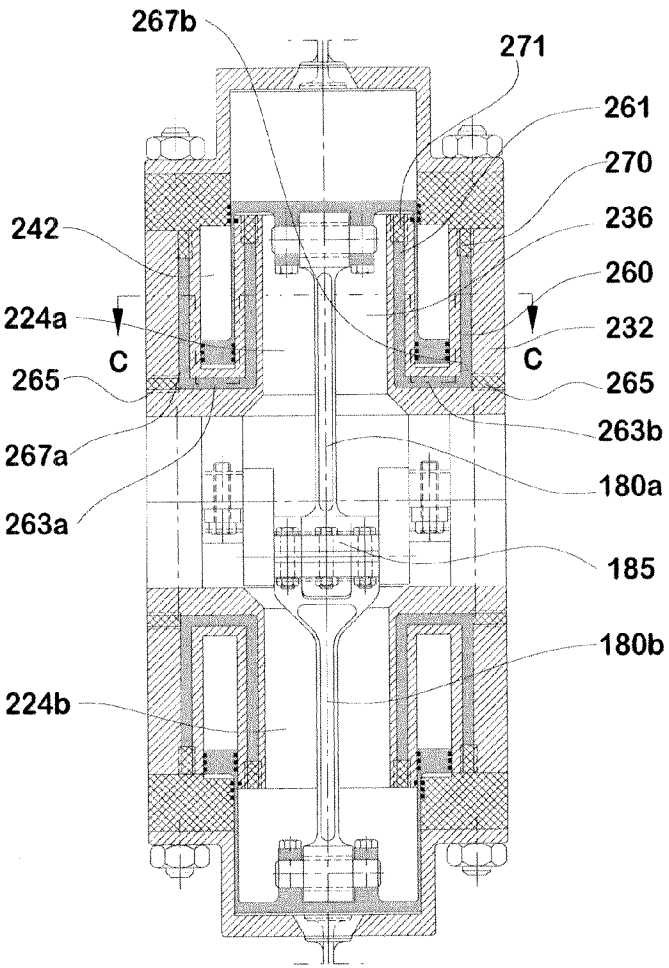
FIG. 21A is a cross section view showing two opposing cylinders of the fourth and preferred embodiment of the apparatus of the present invention, where both piston rods are connected to the same crankshaft pin.
Figure 21A:
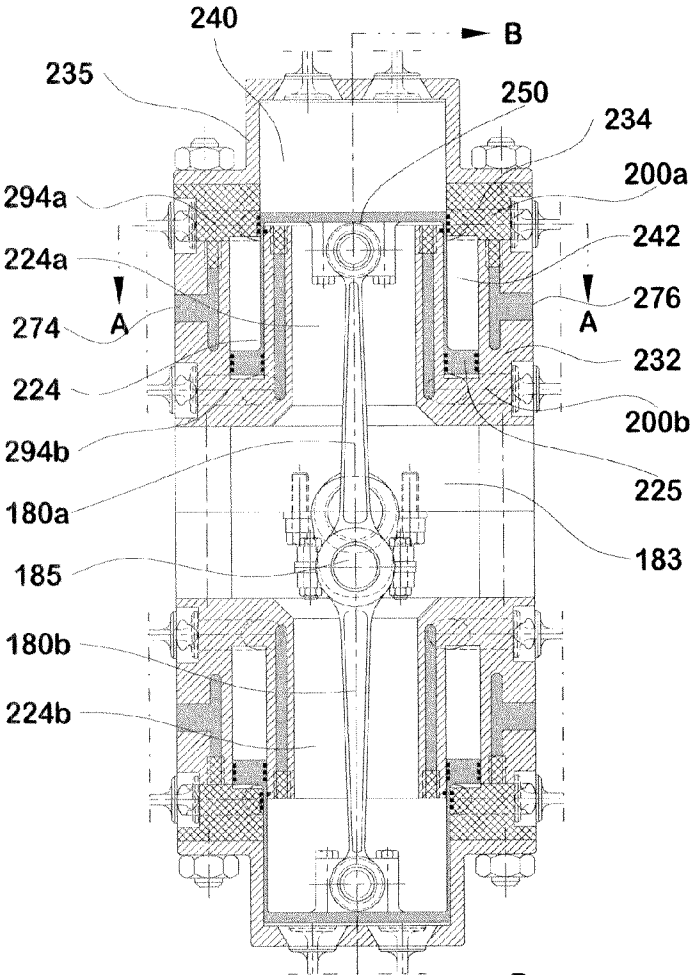

FIG. 21A is a cross section view showing two opposing cylinders 224*a* and 224*b* of the fourth and preferred embodiment of the apparatus of the present invention, where both piston rods 180*a* and 180*b* are connected to the same crankshaft pin 185.

FIG. 21B is a cross section view along line B-B of FIG. 21A showing two opposing cylinders 224*a* and 224*b* of the fourth and preferred embodiment of the apparatus of the present invention, where both piston rods 180*a* and 180*b* are connected to the same crankshaft pin 185.

The internal combustion engine of the fourth and preferred embodiment of the present invention is similar to the third embodiment comprising an annular shape variable combustion chamber 242 in the engine block 232 in which a close fitting annular shape piston 225 slides.

Similarly, the engine head block 234 together with its separate head cover 235 comprises a cylinder shape air chamber 240 in which a cylinder-shaped piston 250 slides.

The function of the in-and-out motion of the cylinder-shaped piston inside the cylindrical air chamber 240 has been described earlier.

The annular shape piston 225 and the cylinder shape piston 250 are manufactured as one unit to form a single combined piston assembly 224 as was described earlier in the description of the second and third embodiment.

Similarly to the third embodiment of the present invention

There are fixed volume pre-combustion chambers 294*a* at the top and 294*b* at the bottom of the variable combustion chamber 242. There are also fixed volume supercharged combustion air supply chambers 200*a* at the top and 200*b* at the bottom of the variable combustion chamber 242 thus making the close fitting annular shape piston 225 a double-acting piston.

However, there is an inner cooling chamber 261 similar to the outer cooling chamber 260 in the engine block 232 making the cooling chambers of this fourth embodiment different from the cooling chambers of the previous embodiments.

Cooling Chambers in the Engine Block

Reference is made to FIG. 21A and FIG. 21B. There is an annular shape inner cooling chamber 261 in the engine block 232 between the annular shape combustion chamber 242 and the cylinder shape bore 236 in the middle of the engine block 232. The open top end of this inner cooling chamber 261 is closed with an annular shape threaded or welded cover 271.

There is another outer annular shape cooling chamber 260 outwards from the annular shape combustion chamber 242. The open top end of this outer cooling chamber 260 is closed with an annular shape threaded or welded cover 270. The outer annular cooling chamber 260 has a cooling media intake port 274 through one side of the engine block 232 and a cooling media discharge port 276 through the other side of the engine block 232. To make the outer annular cooling chamber 260 to communicate with the inner annular cooling chamber 261 a set of horizontal holes 263*a* and 263*b* are drilled through opposite sides of the engine block to reach the inner annular cooling chamber 261. The outside ends of the holes 263*a* and 263*b* are capped with threaded or welded plugs 265.

A set of vertical holes 267*a* and 267*b* are drilled through the bottom of the outer annular shape cooling chamber 260 to reach and communicate with the horizontal holes 263*a* and 263*b* that communicate with the inner annular cooling chamber 261.

Figure 22:
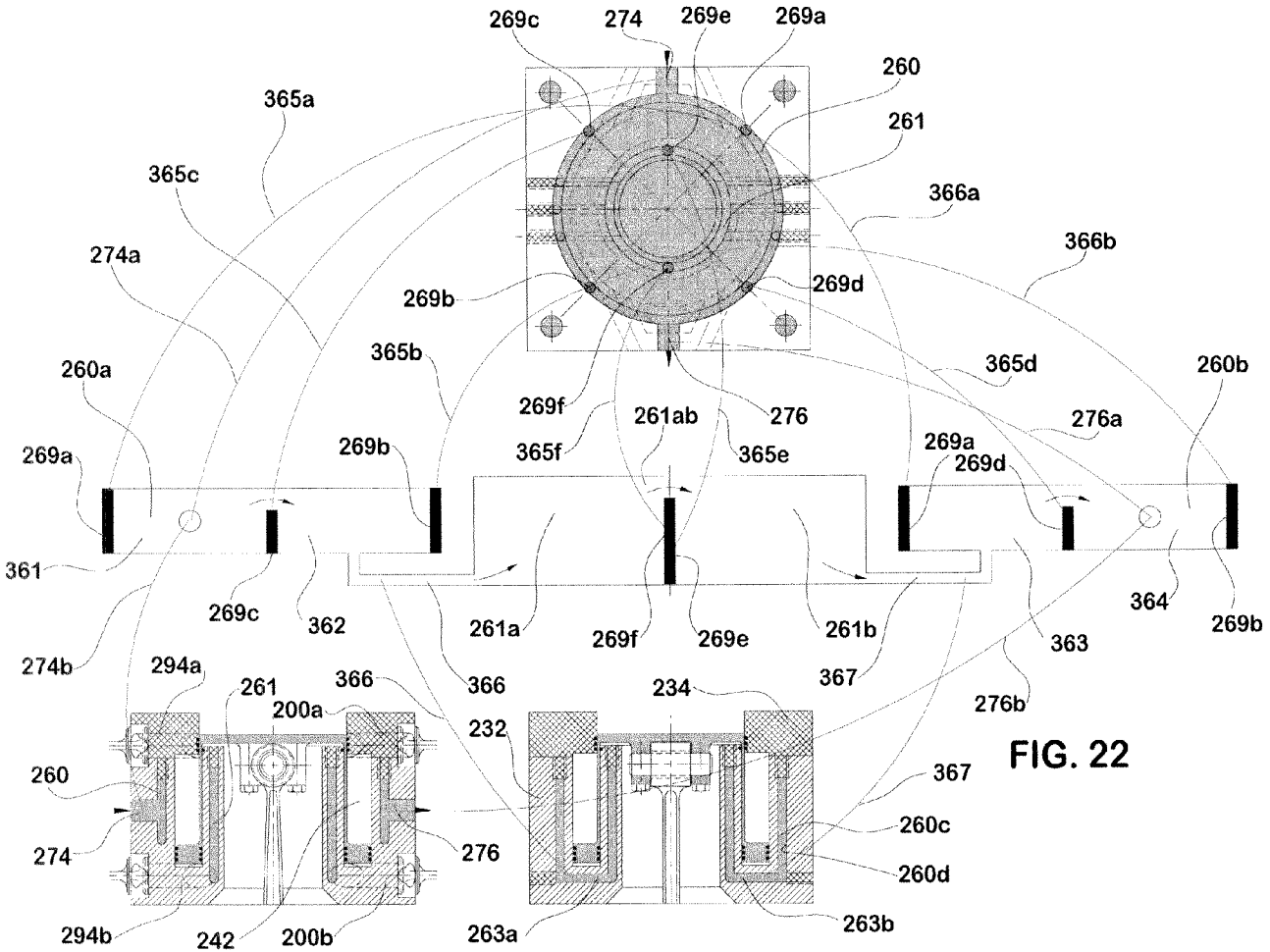
FIG. 22 shows the cooling liquid flow pattern over the weir pins in the cooling chambers of the fourth and preferred embodiment of the apparatus of the present invention.

To control the flow of the cooling media reasonably evenly through both annular cooling chambers a set of vertical weir pins 269 are used as shown in FIG. 21C and FIG. 22.

FIG. 21C is a cross section view along line C-C of FIG. 21B showing the location of the cooling liquid flow weir pins in the outer 260 and inner 261 cooling chambers of the fourth and preferred embodiment of the apparatus of the present invention.

FIG. 22 shows the cooling liquid flow pattern over the weir pins in the cooling chambers of the fourth and preferred embodiment of the apparatus of the present invention.

Copies of the cross sections of the top cylinder engine block 232 assembly from FIG. 21A and from FIG. 21B together with the copy of FIG. 21C are shown in FIG. 22. The middle of FIG. 22 shows the outer annular cooling chamber 260 straightened out in two halves 260*a* and 260*b* as if it were a straight rather than an annular chamber, the thickness of the straightened chamber being same as the distance between the inner cylindrical face 260*c* and outer cylindrical face 260*d* of the outer annular cooling chamber 260.

Between these imaginary two straightened halves 260*a* and 260*b* of the outer annular cooling chamber 260 is shown an imaginary straightened inner cooling chamber 261*ab* of the actual annular shape inner cooling camber 260.

Lines 274*a* and 274*b* point to the intake port 274 where cooling media (typically water or air) enters the outer cooling chamber 260.

Lines 365*a* and 366*a* point to blocking weir pin 269*a*, and lines 365*b* and 366*b* point to blocking weir pin 269*b*, which are separating the two halves 260*a* and 260*b* of the outer annular cooling chamber 260 from each other.

Line 365*c* points to over-flow weir pin 269*c* and line 365*d* points to over-flow weir pin 269*d*, which divide each half of the outer cooling cambers into two quarter sections. For later description of the flow pattern of the cooling media through both annular cooling cambers the outer annular shape cooling chamber 260 quarter sections are called first quarter 361, second quarter 362, third quarter 363, and fourth quarter 364. The over-flow weir pins are shorter than the height of the outer annular cooling chamber allowing the cooling media to flow over the weir from one quarter to the other.

Lines 365*e* and 365*f* point to two additional over-flow weir pins 269*e* and 269*f* which divide the inner cooling camber 261 into two half sections 261*a* and 261*b*. For later description of the flow pattern of the cooling media through both annular cooling cambers the inner cooling chamber half sections are called first half 261*a* and second half 261*b*. These two over-flow weir pins 269*e* and 269*f* are also shorter than the height of the inner annular cooling chamber allowing the cooling media to flow over the weirs from one half to the other.

Lines 276*a* and 276*b* point to the discharge port 276 where cooling media (typically water or air) leaves the outer cooling chamber 260.

The second quarter 362 of the first half 260*a* of the outer cooling chamber communicates with the first half 261*a* of the inner cooling chamber through the bottom passage way 366 which is a set of horizontal holes 263 as described earlier.

The second half 261*b* of the inner cooling chamber communicates with the third quarter 363 of the second half 260*b* of the outer cooling chamber through the passage way 367 which is a set of horizontal holes 263 as described earlier.

The cooling media enters the first quarter 361 of the outer annular cooling chamber 260 through intake port 274, passes over the over-flow weir pin 269*c* into the second quarter 362 of the outer annular cooling chamber 260. Through the bottom passage way 366 the cooling media flows from the second quarter 362 of the outer annular cooling chamber 260 to the bottom middle of the first half 261*a* of the inner annular cooling chamber 261. The cooling media flow splits into two flows over both of the over-flow weir pins 269*e* and 269*f* in the inner cooling camber 261 and enters the top of the second half 261*b* of the inner cooling chamber. Through the bottom passage way 367 the cooling media flows from the second half 261*b* of the inner cooling chamber 261 into the third quarter 363 of the outer annular cooling chamber 260.

From the third quarter 363 of the outer annular cooling chamber 260 the cooling media passes over the over-flow weir pin 269*d* into the fourth quarter 364 of the outer annular cooling chamber 360, and finally exits from there through the discharge port 276. In this manner the cooling media is forced to flow up and down as well as sideways through both of the annular cooling chambers ensuring efficient cooling of all surfaces to deliver the excess combustion heat away from the engine block.

Fixed Volume Pre-Combustion Chambers and Fixed Volume Supercharged Combustion Air Supply Chambers The shape and location of the top fixed volume combustion chambers 294*a* and 200*a* in the engine head block 234 and the bottom fixed volume combustion chambers 294*b* and 200*b* in the engine block 232 at both ends of the annular combustion chamber 242 make the fourth embodiment different from the third embodiment of the present invention.

The shape and location of the top fixed volume pre-combustion chamber 294*a* and of the top fixed volume supercharged combustion air supply chamber 200*a* in the engine head block 234 is shown in FIG. 21D, which is a cross section view along line A-A of FIG. 21A.

The bottom fixed volume pre-combustion chamber 294*b* and the bottom fixed volume supercharged combustion air supply chamber 200*b* in the engine block 232 are of same shape as the respective top fixed volume chambers in the engine head block 234.

The air or fuel mixture intake valves 229 and the waste gas exhaust valves 230, fuel injectors 228 (and/or spark plugs) are mounted in separate housings 229*b* attached to the sides of the engine block 232. Only the valve heads protrude into the fixed volume combustion chambers while in open position. From the valve head recesses 229*c* in each of the fixed volume combustion chambers typically two bored passage ways 295*a* and 295*b* penetrate through the engine block 232 and engine head block 234 into both top and bottom end of the annular combustion chamber 242. The passage ways enter the annular combustion chamber preferably tangentially to create maximum flame front turbulence in the annular combustion chamber 242 during the expansion cycle. The valve head recesses together with the passage ways form the fixed volume chambers. By directing the fuel injector 228 to spray directly into passage way 295*a* as shown in FIG. 21D passage way 295*b* also becomes a supercharged combustion air supply chamber.

Rest of the earlier description of the third embodiment applies to this fourth embodiment as well.

Again, a four-cycle operation is the preferred form of this fourth embodiment of the present invention making the engine a two-stroke four-cycle engine firing a power stroke once during every revolution of the crankshaft with each cylinder.

This fourth embodiment of the present invention suits also well for two-cycle operation making the engine a one-stroke two-cycle engine firing a power stroke twice during every revolution of the crankshaft with each cylinder.

The following three figures will demonstrate the sequences of the strokes in a two cylinder two-cycle engine of this fourth and preferred embodiment.

Figure 23C:
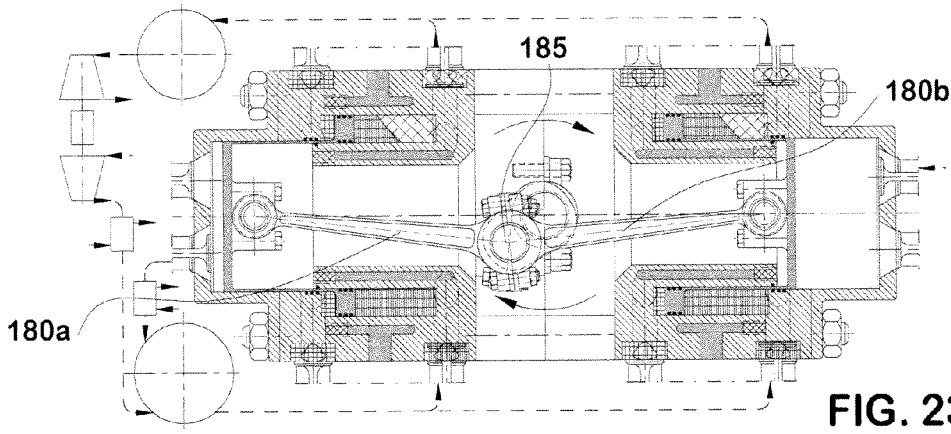
FIG. 23C shows the intake-scavenging/compression phase of two opposing 2-cycle cylinders of the fourth and preferred embodiment of the apparatus of the present invention, where both piston rods are connected to the same crankshaft pin.
Figure 23B:
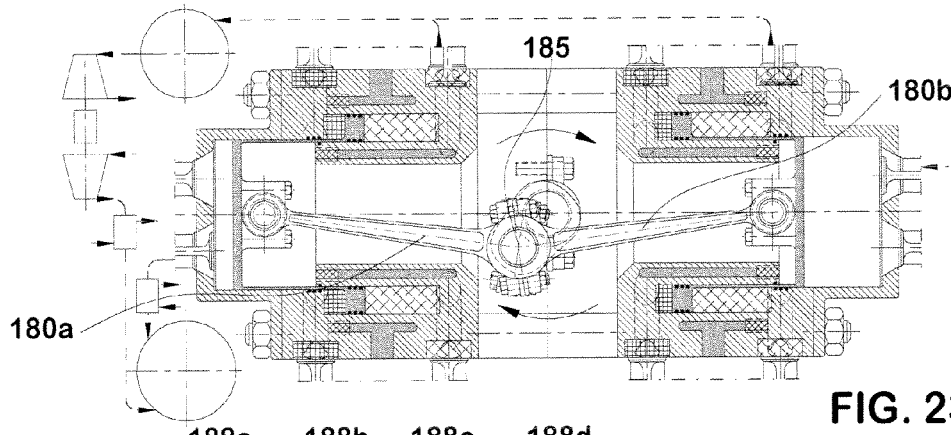
FIG. 23B shows the exhaust/compression phase of two opposing 2-cycle cylinders of the fourth and preferred embodiment of the apparatus of the present invention, where both piston rods are connected to the same crankshaft pin.
Figure 23D:
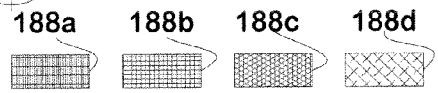
FIG. 23D shows the hatch patterns of the intake, compression, expansion and exhaust used in the figures from 23A through 23C.
Figure 23A:
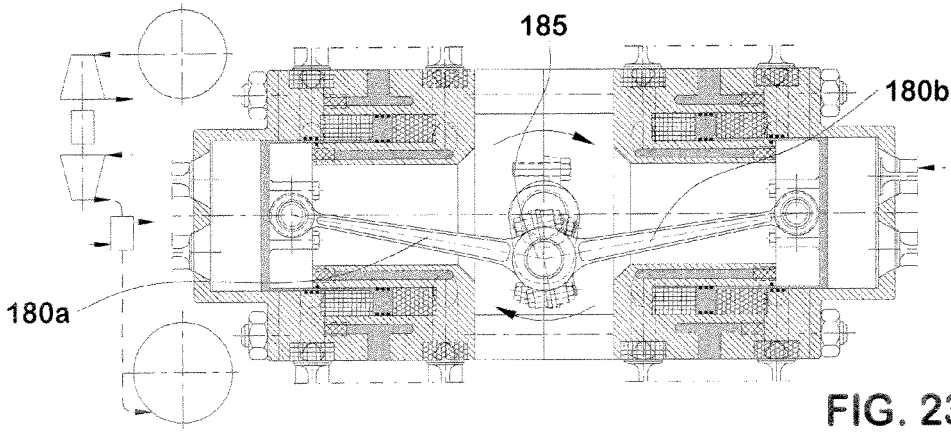
FIG. 23A shows the expansion/compression phase of two opposing 2-cycle cylinders of the fourth and preferred embodiment of the apparatus of the present invention, where both piston rods are connected to the same crankshaft pin.

FIG. 23A shows the expansion/compression phase of two opposing 2-cycle cylinders. Both piston rods 180*a* and 180*b* are connected to the same crankshaft pin 185 which results in both cylinders firing a power stroke at the same time every 180 degree of crank shaft revolution. The engine power output is typical to a conventional 8-cylinder 4-cycle engine.

FIG. 23B shows the exhaust/compression phase of two opposing 2-cycle cylinders. Both piston rods 180*a* and 180*b* are connected to the same crankshaft pin 185. In this manner the crank case pressure will not vary since the cylindrical air pistons always move together, one moving inwards toward the crank case while the other moves outwards maintaining the same volume in the crank case. The cylindrical air pistons perform a full supercharged air compression cycle once during every revolution of the crankshaft.

FIG. 23C shows the intake-scavenging/compression phase of two opposing 2-cycle cylinders. Both piston rods 180*a* and 180*b* are connected to the same crankshaft pin 185. By connecting the piston rods to two separate crankshaft pins 90 degrees apart one 2-cylinder engine will perform one power stroke every 90 degrees of crank shaft revolution.

FIG. 23D shows the hatch patterns of the intake 188*a*, compression 188*b*, expansion 188*c* and exhaust 188*d* used in the figures from 23A through 23C.

Supercharged Air Supply

The middle cylindrical supercharged air piston can be sized to produce all the necessary supercharged air volume for the engine or an exhaust-gas driven compressor can be used to reduce the size of the this cylindrical piston. This latter option gives a 5-10% better fuel economy but will add to the cost of the engine.

Description of Other Features of Present Invention

By aligning the centerlines of two opposing cylinders and connecting each piston pair with a straight common connecting rod, the cylindrical air chambers will work as an air compressor without having to convert the reciprocating motion of the combustion engine to a rotary motion through a crank shaft (see FIG. 24A through FIG. 24E).

Figures 24A, 24B, 24C, 24D, 24E:
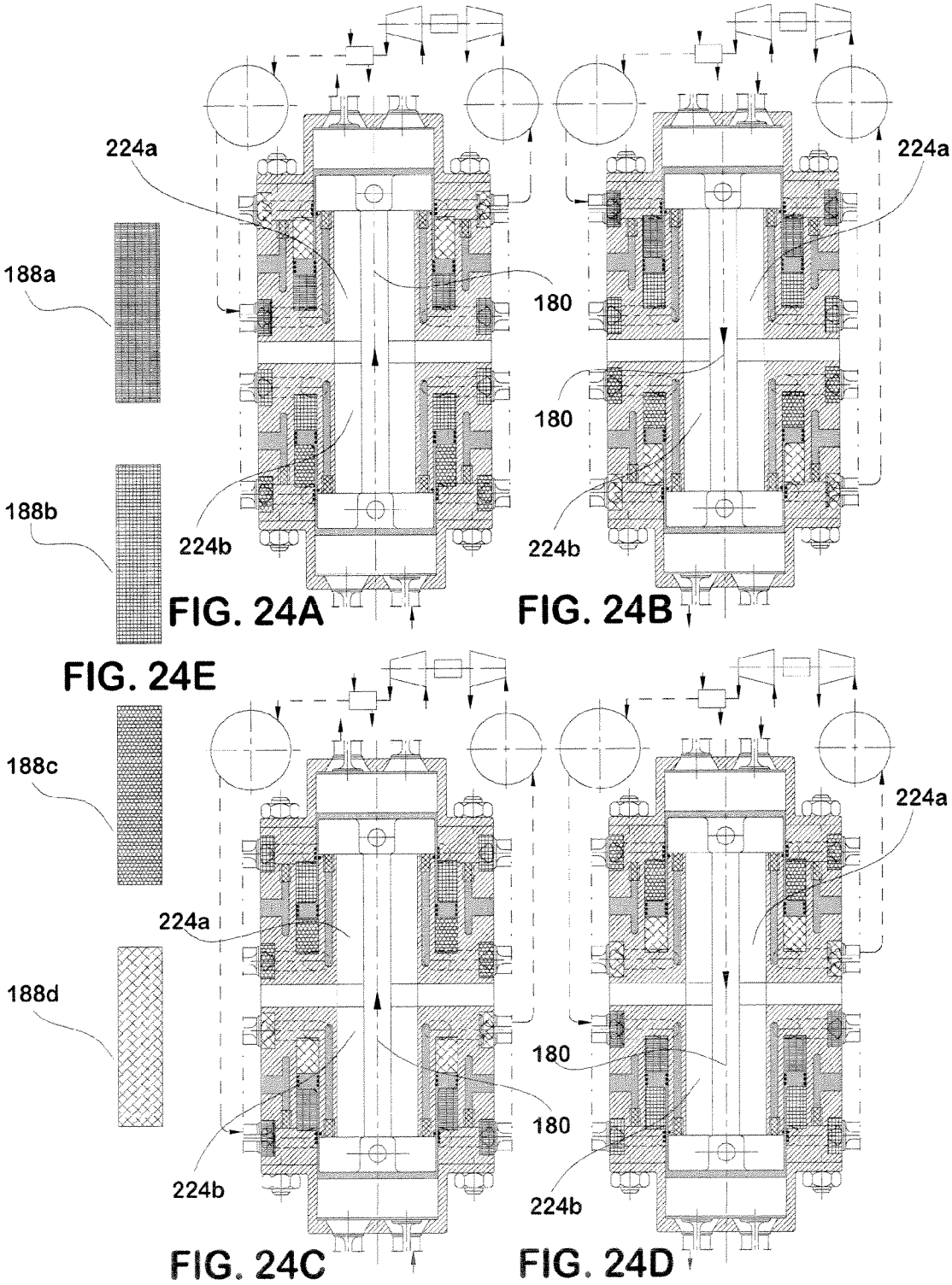
FIG. 24A is a cross section view showing two opposing 4-cycle cylinders of the fourth and preferred embodiment of the apparatus of the present invention connected with a common piston rod to function as a compressor, where cylinder 1 is in intake/exhaust stroke while cylinder 2 is in expansion/compression stroke.
FIG. 24B is a cross section view showing two opposing 4-cycle cylinders of the fourth and preferred embodiment of the apparatus of the present invention connected with a common piston rod to function as a compressor, where cylinder 1 is in intake/compression stroke while cylinder 2 is in expansion/exhaust stroke.
FIG. 24C is a cross section view showing two opposing 4-cycle cylinders of the fourth and preferred embodiment of the apparatus of the present invention connected with a common piston rod to function as a compressor, where cylinder 1 is in expansion/compression stroke while cylinder 2 is in intake/exhaust stroke.
FIG. 24D is a cross section view showing two opposing 4-cycle cylinders of the fourth and preferred embodiment of the apparatus of the present invention connected with a common piston rod to function as a compressor, where cylinder 1 is in expansion/exhaust stroke while cylinder 2 is in intake/compression stroke.
FIG. 24E shows the hatch patterns of the intake, compression, expansion and exhaust used in the figures from 24A through 24D.

FIG. 24A is a cross section view showing two opposing 4-cycle cylinders of the fourth and preferred embodiment of the apparatus of the present invention connected with a common piston rod 180 to function as a compressor, where piston 224*a* is in intake/exhaust stroke while piston 224*b* is in expansion/compression stroke.

FIG. 24B is a cross section view showing two opposing 4-cycle cylinders of the fourth and preferred embodiment of the apparatus of the present invention connected with a common piston rod 180 to function as a compressor, where piston 224*a* is in intake/compression stroke while piston 224*b* is in expansion/exhaust stroke.

FIG. 24C is a cross section view showing two opposing 4-cycle cylinders of the fourth and preferred embodiment of the apparatus of the present invention connected with a common piston rod 180 to function as a compressor, where piston 224*a* is in expansion/compression stroke while piston 224*b* is in intake/exhaust stroke.

FIG. 24D is a cross section view showing two opposing 4-cycle cylinders of the fourth and preferred embodiment of the apparatus of the present invention connected with a common piston rod 180 to function as a compressor, where piston 224*a* is in expansion/exhaust stroke while piston 224*b* is in intake/compression stroke.

FIG. 24E shows the hatch patterns of the intake 188*a*, compression 188*b*, expansion 188*c* and exhaust 188*d* used in the figures from 24A through 24D.

By aligning the centerlines of two opposing cylinders and using a combined cylindrical air piston assembly for both cylinders, the cylindrical air chambers will work as an air compressor without having to convert the reciprocating motion of the combustion engine to a rotary motion through a crank shaft. Three different piston assemblies are shown in the next four figures.

FIG. 25A is a cross section view showing two opposing 4-cycle cylinders of the fourth and preferred embodiment of the apparatus of the present invention in which the cylindrical shape air pistons and ring shaped combustion pistons are formed as one unit to function as a compressor. Piston 224*a* is in intake/exhaust stroke while piston 224*b* is in expansion/compression stroke.

FIG. 25B is a cross section view showing two opposing 4-cycle cylinders of the fourth and preferred embodiment of the apparatus of the present invention in which the cylindrical shape air pistons and ring shaped combustion pistons are formed as one unit to function as a compressor. Piston 224*a* is in intake/compression stroke while piston 224*b* is in expansion/exhaust stroke.

FIG. 25C is a cross section view showing two opposing 4-cycle cylinders of the fourth and preferred embodiment of the apparatus of the present invention in which the cylindrical shape air piston heads 251*a* and 251*b* are aligned with the ring shaped combustion pistons 225*a* and 225*b* and formed as one unit to function as a compressor. Cylinder 224*a* is in expansion/compression stroke while cylinder 224*b* is in intake/exhaust stroke.

FIG. 25D is a cross section view showing two opposing 4-cycle cylinders of the fourth and preferred embodiment of the apparatus of the present invention in which the cylindrical shape air pistons have one common head 251 in the middle of the piston assembly 224 and form one unit with the ring shaped combustion pistons to function as a compressor. Cylinder 224*a* is in expansion/exhaust stroke while cylinder 224*b* is in intake/compression stroke.

FIG. 25E shows the hatch patterns of the intake 188*a*, compression 188*b*, expansion 188*c*, and exhaust 188*d* used in the figures from 25A through 25D.

Further, it is to be recognized that the above possible modifications are given by way of example, and yet other possible modifications could be made without departing from the basic teachings of the present invention.

One-stroke Two-cycle Engine

The following seven figures will demonstrate the sequences of the strokes in a single cylinder one-stroke two-cycle engine in one embodiment.

Figures 26A, 26B, 26C, 26D:
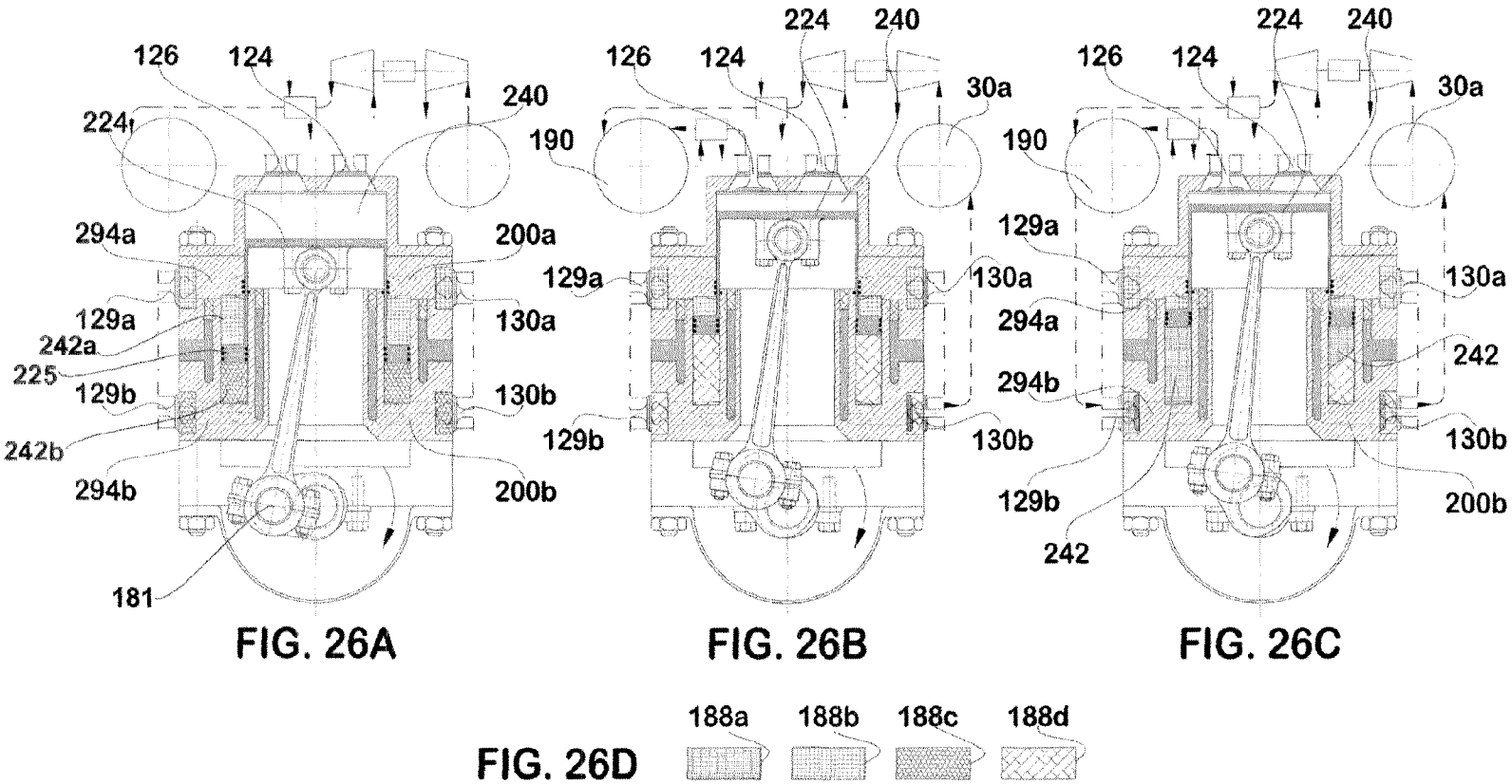
FIG. 26A shows the expansion/compression phase of a single 2-cycle cylinder.
FIG. 26B shows the exhaust/compression phase of a single 2-cycle cylinder.
FIG. 26C shows the intake-scavenging/compression phase of a single 2-cycle cylinder.
FIG. 26D shows the hatch patterns of the intake, compression, expansion and exhaust used in the figures from FIG. 26A through FIG. 26G.

FIG. 26A shows the expansion/compression phase of a single 2-cycle cylinder. A one cylinder engine will perform one power stroke every 180 degrees of crank shaft revolution and its power out-put and torque is equal or greater than a conventional 8-cylinder 4-cycle engine's with the same cylinder displacement volume per cylinder (see Air-standard Analysis and FIG. 14 below).

Looking at FIGS. 26A through 26C and 26E through 26G it can be seen how the annular combustion chamber 242 comprises a void 242A above the annular shape bottom end 225 of the piston assembly 224. This allows for two power strokes for every rotation of the crankshaft 181.

FIG. 26B shows the exhaust/compression phase of a single 2-cycle cylinder. The cylindrical air piston performs a full supercharged air compression cycle once during every revolution of the crankshaft.

FIG. 26C shows the intake-scavenging/compression phase of a single 2-cycle cylinder. By using 2 cylinders and connecting the piston rods to two separate crankshaft pins 90 degrees apart one 2-cylinder engine will perform one power stroke every 90 degrees of crank shaft revolution and its power out-put and torque is equal or greater than a conventional 16-cylinder 4-cycle engine's with the same cylinder displacement volume per cylinder (see Air-standard Analysis and FIG. 14 below).

FIG. 26D shows the hatch patterns of the intake 188*a*, compression 188*b*, expansion 188*c*, and exhaust 188*d* used in the figures from FIG. 26A through FIG. 26G.

Figure 26G:
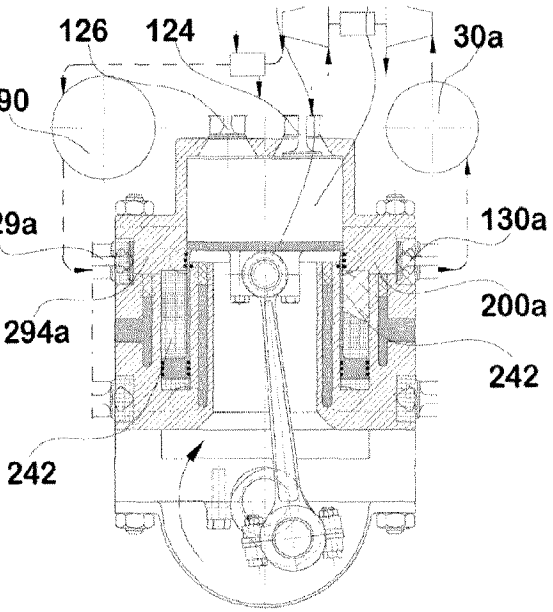
FIG. 26E through FIG. 26G show the expansion/compression phase, the exhaust/compression phase, and the intake-scavenging/compression phase of the same single 2-cycle cylinder during the piston down-stroke.
Figure 26F:
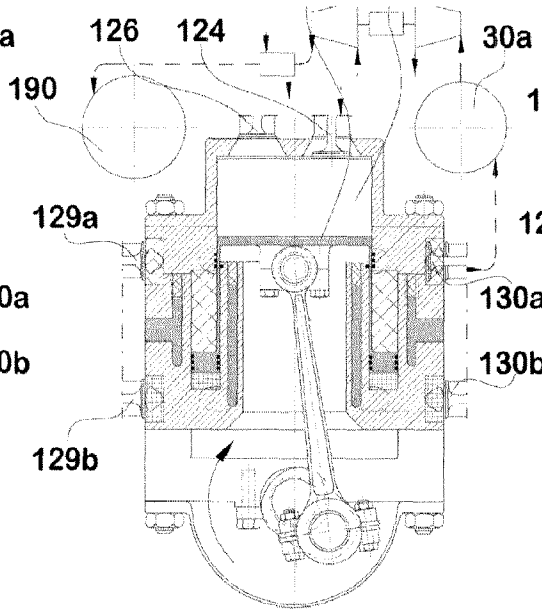
Figure 26E:
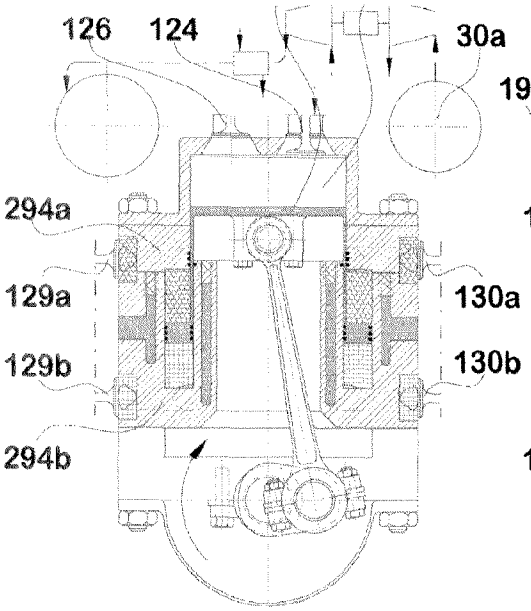

FIG. 26E through FIG. 26G show the expansion/compression phase, the exhaust/compression phase, and the intake-scavenging/compression phase of the same single 2-cycle cylinder during the piston down-stroke.

A more detailed description of this one-stroke 2-cycle cylinder engine with an annular double-acting power piston is given below.

FIG. 26A shows the expansion/compression phase of a one-stroke 2-cycle cylinder in the middle of the piston 224 up-stroke when top 294*a* and bottom 294*b* fixed volume pre-combustion chamber intake valves 129*a* and 129*b* and exhaust valves 130*a* and 130*b* in the supercharged combustion air supply chambers 200*a* and 200*b* are closed. The supercharged air discharge port 126 and the ambient air intake port 124 at the top of the cylindrical air chamber 240 are closed.

FIG. 26B shows the exhaust/compression phase of a one-stroke 2-cycle cylinder during piston 224 up-stroke at about 80% of the expansion stroke permitting the escape of exhaust gases through the open bottom exhaust port 130*b* to the waste gas accumulator 30*a* and reducing the pressure in the cylinder. The top intake port 129*a*, the top exhaust port 130*a* and the bottom intake port 129*b* are closed. The supercharged air discharge port 126 at the top of the cylindrical air chamber 240 is open to let the supercharged air flow into the supercharged air accumulator 190. The ambient air intake port 124 at the top of the cylindrical air chamber 240 is closed.

FIG. 26C shows the intake-scavenging/compression phase of a one-stroke 2-cycle cylinder during the piston 224 up-stroke at about 88% of the expansion stroke permitting the escape of exhaust gases through the bottom exhaust port 130*b* to the waste gas accumulator 30*a*. The bottom intake port 129*b* is opened to let the incoming supercharged air from the supercharged air accumulator 190 scavenge the remaining waste gases away from the bottom pre-combustion chamber 294*b*, the annular combustion chamber 242, and the bottom supercharged combustion air supply chamber 200*b* into the waste gas accumulator 30*a*. The supercharged air discharge port 126 at the top of the cylindrical air chamber 240 is open to let the supercharged air flow into the supercharged air accumulator 190. The ambient air intake port 124 at the top of the cylindrical air chamber 240 is closed.

FIG. 26D shows the hatch patterns of the intake 188*a*, compression 188*b*, expansion 188*c* and exhaust 188*d* used in the figures from 26A through 26F.

FIG. 26E shows the expansion/compression phase of a one-stroke 2-cycle cylinder in the middle of the piston 224 down-stroke when top 294*a* and bottom 294*b* fixed volume combustion chamber intake valves 129*a* and 129*b*, and exhaust valves 130*a* and 130*b* are closed. The supercharged air discharge port 126 at the top of the cylindrical air chamber 240 is closed but the ambient air intake port 124 is open.

FIG. 26F shows the exhaust/compression phase of a one-stroke 2-cycle cylinder during piston 224 down-stroke at about 80% of the expansion stroke permitting the escape of exhaust gases through the open top exhaust port 130*a* to the waste gas accumulator 30*a* and reducing the pressure in the cylinder. The bottom intake port 129*b*, the bottom exhaust port 130*b*, and the top intake port 129*a* are closed. The supercharged air discharge port 126 at the top of the cylindrical air chamber 240 is closed. The ambient air intake port 124 at the top of the cylindrical air chamber 240 is open to let ambient air into the cylindrical air chamber 240.

FIG. 26G shows the intake-scavenging/compression phase of a one-stroke 2-cycle cylinder during the piston 224 down-stroke at about 88% of the expansion stroke permitting the escape of exhaust gases through the top exhaust port 130*a* to the waste gas accumulator 30*a*. The top intake port 129*a* is opened to let the incoming supercharged air from the supercharged air accumulator 190 scavenge the remaining waste gases away from the top pre-combustion chamber 294*a*, the annular combustion chamber 242, and the top supercharged combustion air supply chamber 200*a* into the waste gas accumulator 30*a*.

The supercharged air discharge port 126 at the top of the cylindrical air chamber 240 is closed. The ambient air intake port 124 at the top of the cylindrical air chamber 240 is open to let ambient air into the cylindrical air chamber.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. An internal combustion engine comprising:

a. a substantially cylindrical air chamber having a circumferential interior wall and a substantially round upper interior wall, b. an annular shaped combustion chamber having a substantially circular inner wall surface substantially concentric with the cylindrical air chamber and a substantially circular outer wall surface substantially concentric with the cylindrical air chamber, c. a pre-combustion, fixed volume chamber in fluid communication with the annular shaped combustion chamber, d. a substantially cylindrical piston comprising a first surface cooperatively configured to fit within the substantially cylindrical air chamber, e. the substantially cylindrical piston further comprising a second ring shaped surface cooperatively configured to fit within the annular shaped combustion chamber.

2. The internal engine of claim 1 configured to operate through one power stroke in every 180 degree rotation of a crank shaft coupled to the substantially cylindrical piston.

3. The internal engine of claim 2 further comprising a second piston connected to the crankshaft at a 90 degree offset from the piston of claim 2.

4. The internal combustion engine of claim 1 further comprising a piston rod comprised of a substantially flexible material.

5. The internal combustion engine of claim 1 further comprising a cooling system having an annular shaped cooling chamber which has a circular inner wall surface, circular outer wall surface, closed annular shaped top surface, and an annular shaped open end opposite the top surface wherein the circular inner wall surface and circular outer wall surface are concentric with these substantially cylindrical air chamber.

6. The internal combustion engine of claim 1 further comprising a pre-combustion chamber in fluid communication with the combustion chamber.

7. The internal combustion engine of claim 1 further comprising a supercharged combustion air supply chamber in fluid communication with the combustion chamber.

8. The internal combustion engine of claim 7 further comprising a pre-combustion chamber in fluid communication with the combustion chamber wherein the supercharged combustion air supply chamber is radially opposite the pre-combustion chamber in relation to the substantially cylindrical air chamber.

9. An internal combustion engine comprising:

a. a substantially cylindrical air chamber having a circumferential interior wall and an upper interior wall, b. an annular shaped combustion chamber having a substantially cylindrical inner wall surface substantially concentric with the cylindrical air chamber and a substantially cylindrical outer wall surface substantially concentric with the cylindrical air chamber, c. a pre-combustion, fixed volume chamber in fluid communication with the annular shaped combustion chamber, d. a substantially cylindrical piston comprising a first surface cooperatively configured to fit within the substantially cylindrical air chamber, and e. a first pre-combustion chamber generally comprising a void having a longitudinal axis substantially tangential to the outer wall surface of the combustion chamber.

10. The internal combustion engine of claim 9 further comprising a second pre-combustion chamber generally comprising a void having a longitudinal axis substantially tangential to the outer wall surface of the combustion chamber and generally radially opposite the first pre-combustion chamber in relation to the air chamber.

11. The internal combustion engine of claim 9 wherein the substantially cylindrical piston is configured to fit within the substantially cylindrical air chamber such that a gap of between 0.5 and 3.0 mm exists between the cylindrical piston and the cylindrical air chamber configured to allow air to pass.

12. The internal combustion engine of claim 9 wherein the substantially cylindrical piston further comprises an annular shaped portion and is configured to fit within the annular shaped combustion chamber.

13. The internal combustion engine of claim 12 wherein the substantially cylindrical piston further comprises an annular shaped portion configured to fit within the annular shaped combustion chamber formed as a unitary structure.

14. An internal combustion engine comprising:

a. a first substantially cylindrical air chamber having a substantially cylindrical inner wall and an inner top wall;

b. a second substantially cylindrical air chamber concentric with the first substantially cylindrical air chamber having a substantially cylindrical inner wall and an inner top wall;

c. a first annular shaped combustion chamber having a substantially circular inner wall surface substantially concentric with the first cylindrical air chamber, the first annular shaped combustion chamber further having a substantially cylindrical outer wall surface substantially concentric with the first cylindrical air chamber;

d. a second annular shaped combustion chamber having a substantially circular inner wall surface substantially concentric with the second cylindrical air chamber, a substantially circular outer wall surface substantially concentric with the second cylindrical air chamber;

e. a first substantially cylindrical piston configured to fit within the first substantially cylindrical air chamber;

f. a second substantially cylindrical piston configured to fit within the second substantially cylindrical air chamber;

g. a crankshaft configured to rotate wherein the axis of rotation is perpendicular to the axis of the first and the second substantially cylindrical air chambers;

h. a crankshaft pin coupled to the crankshaft and configured to rotate about the axis of rotation of the crankshaft;

i. a first piston rod coupled at a first end to the first substantially cylindrical piston and coupled at a second end to the crankshaft pin; and j. a second piston rod coupled at a first end to the second substantially cylindrical piston and coupled at a second end to the crankshaft pin.

15. The internal combustion engine of claim 14 wherein the first piston rod and the second piston rod are coupled to the same crankshaft pin.

16. The internal combustion engine of claim 15 wherein the substantially cylindrical piston is configured to fit within the substantially cylindrical air chamber such that a gap of between 0.5 and 3.0 mm is between the cylindrical piston and the cylindrical air chamber configured to allow air to pass.

17. The internal combustion engine of claim 15 wherein the substantially cylindrical piston further comprises an annular shaped portion configured to fit within the annular shaped combustion chamber.

18. The internal combustion engine of claim 17 further comprising a pre-combustion chamber including communication with the combustion chamber.

19. The internal combustion engine of claim 18 further comprising a first annular shaped cooling chamber formed between the substantially cylindrical inner wall of the first substantially cylindrical air chamber and the substantially cylindrical outer wall surface of the first annular shaped combustion chamber is substantially concentric with the first substantially cylindrical air chamber and in fluid communication with a second cooling chamber having inlet ports and outlet ports to facilitate the flow of coolant through the first and second cooling chambers.

20. The internal combustion engine of claim 19 configured to operate through a full cycle in two strokes.

* * * * *